US007920779B2

(12) United States Patent
Shirai et al.

(10) Patent No.: US 7,920,779 B2
(45) Date of Patent: Apr. 5, 2011

(54) HEAT EXCHANGER AND WASHING APPARATUS COMPRISING THE SAME

(75) Inventors: Shigeru Shirai, Osaka (JP); Yasuhiro Umekage, Osaka (JP); Kazushige Nakamura, Osaka (JP); Mitsuyuki Furubayashi, Osaka (JP); Keiko Yasui, Osaka (JP); Koji Oka, Osaka (JP)

(73) Assignee: Panasonic Corporation, Osaka (JP)

( * ) Notice: Subject to any disclaimer, the term of this patent is extended or adjusted under 35 U.S.C. 154(b) by 1292 days.

(21) Appl. No.: 10/596,355

(22) PCT Filed: Dec. 9, 2004

(86) PCT No.: PCT/JP2004/018389

§ 371 (c)(1), (2), (4) Date: Jun. 9, 2006

(87) PCT Pub. No.: WO2005/057090

PCT Pub. Date: Jun. 23, 2005

(65) Prior Publication Data

US 2007/0143914 A1 Jun. 28, 2007

(30) Foreign Application Priority Data

| | | |
|---|---|---|
| Dec. 10, 2003 | (JP) | 2003/411438 |
| Dec. 10, 2003 | (JP) | 2003-411439 |
| Feb. 12, 2004 | (JP) | 2004-034665 |
| Feb. 12, 2004 | (JP) | 2004-034666 |
| Feb. 16, 2004 | (JP) | 2004-038201 |
| May 26, 2004 | (JP) | 2004-155816 |
| Jul. 22, 2004 | (JP) | 2004-214023 |

(51) Int. Cl.
*B05B 1/24* (2006.01)

(52) U.S. Cl. ..... 392/474; 392/491; 392/465

(58) Field of Classification Search ..... 392/465, 392/474

See application file for complete search history.

(56) References Cited

U.S. PATENT DOCUMENTS

| | | | |
|---|---|---|---|
| 4,583,585 | A | 4/1986 | Estienne et al. |
| 6,327,718 | B1 | 12/2001 | Ono et al. |
| 6,516,143 | B2 | 2/2003 | Toya et al. |
| 7,191,473 | B2 | 3/2007 | Matsumoto et al. |
| 2006/0151458 | A1 | 7/2006 | Shirai et al. |

FOREIGN PATENT DOCUMENTS

| | | | |
|---|---|---|---|
| CN | 2186904 | Y | 1/1995 |
| CN | 2349979 | Y | 11/1999 |
| CN | 1251634 | | 4/2000 |
| JP | 54-109943 | | 1/1953 |

(Continued)

OTHER PUBLICATIONS

English Language Abstract of JP 8-094175.

(Continued)

*Primary Examiner* — Thor S Campbell

(74) *Attorney, Agent, or Firm* — Greenblum & Bernstein P.L.C.

(57) ABSTRACT

A heat exchanger comprises a substantially pillar sheathed heater, a substantially cylindrical case, and a spiral spring. The sheathed heater is accommodated in the case. The spring is provided so as to be wound around an outer peripheral surface of the sheathed heater. Thus, a spiral flow path is formed among an outer peripheral surface of the sheathed heater, an inner peripheral surface of the case, and the spring. The spring functions as a flow velocity conversion mechanism, a turbulent flow generation mechanism, a flow direction conversion mechanism, and an impurity removal mechanism. A water inlet and a water outlet are respectively arranged at positions eccentric from a central axis of the case on a side surface of the case.

17 Claims, 46 Drawing Sheets

FOREIGN PATENT DOCUMENTS

| | | |
|---|---|---|
| JP | 59-65338 | 5/1984 |
| JP | 8-094175 | 4/1996 |
| JP | 8-094175 | 11/2000 |
| JP | 2000-329407 | 11/2000 |
| JP | 2000-279786 | 10/2001 |
| JP | 2001-279786 | 10/2001 |
| JP | 2002-277054 | 9/2002 |
| KR | 1997-0006466 | 4/1997 |
| KR | 2003-0061687 | 7/2003 |

OTHER PUBLICATIONS

Partial English Language Translation of KR 1997-0006466.
English language abstract of CN 1251634, Apr. 26, 2000.
English language Abstract of JP 2000-329407.
English language Abstract of JP 2002-277054.
U.S. Appl. No. 10/566,977 to Nakamura et al., which was filed Feb. 2, 2006.
English language partial translation of CN 2186904 Y.
English language partial translation of CN 2349979 Y.
English language partial translation of JP 2000-329407 A.
English language Abstract and machine translation of JP 08-094175, Apr. 12, 1996.
English language Abstract and machine translation of JP 2000-329407, Nov. 30, 2000.
Chinese Office Action (Certificate of Patent, Pamphlet of the announced patent specification) dated Oct. 13, 2010 that issued with respect to Chinese Patent Application No. 200810095827.X.

HEAT EXCHANGER AND WASHING APPARATUS COMPRISING THE SAME

TECHNICAL FIELD

The present invention relates to a heat exchanger for heating a fluid and a washing apparatus comprising the same.

BACKGROUND ART

Heat exchangers for heating water are used for sanitary washing apparatuses that wash the private parts of the human bodies, clothes washing apparatuses that wash clothes, and dish washing apparatuses that wash dishes (see Patent Document 1).

FIG. 48 is a schematic sectional view of a conventional heat exchanger. As shown in FIG. 48, the heat exchanger has a double pipe structure comprising a cylindrical base material pipe 801 and an outer cylinder 802. A heater 803 is provided outside the base material pipe 801. A spiral core 805 is inserted into an inner hole 804 of the base material pipe 801. Washing water flows along a screw thread 806 on the spiral core 805 in the inner hole 804 of the base material pipe 801. At this time, heat exchange between the heater 803 and water causes warm water to be generated.

In the conventional heat exchanger, however, water is heated to approximately 40° C. by the heater 803, so that a scale such as a calcium component contained in water is deposited on an inner surface of the base material pipe 801 and a surface of the spiral core 805 to adhere thereto. This results in reduced heat exchange efficiency. When the heat exchanger is employed for a long time period, the scale closes a flow path, so that water does not flow. Thus, a boil-dry state occurs. Similarly, other impurities such as a water stain and dust are also deposited on the inner surface of the base material pipe 801 and the surface of the spiral core 805 to adhere thereto. Consequently, the life of the heat exchanger is shortened.

Since the heater 803 is provided on an outer surface of the base material pipe 801, an outer cylinder 802 for thermally insulating and surrounding the heater 803 is required. Therefore, it is difficult to miniaturize the heat exchanger.

Furthermore, heat generated by the heater 803 provided on the outer surface of the base material pipe 801 escapes out of the base material pipe 801, resulting in poor heat exchange efficiency.

Since the spiral core 805 is inserted into and held in the inner hole 804, the spiral core 805 comes into contact with the inner surface of the base material pipe 801 heated by the heater 803. Therefore, the spiral core 805 must be formed of a material having high heat resistance. Consequently, a material for the spiral core 805 is limited, which makes it difficult to make the heat exchanger lightweight.

Such a conventional heat exchanger is used for a sanitary washing apparatus that washes the private parts of the human body, for example. However, impurities such as a scale are deposited on the conventional heat exchanger to adhere thereto due to long-term use. When a large number of fractions of the impurities that have adhered to the heat exchanger are discharged from the heat exchanger, a washing nozzle is clogged, so that washing water cannot be sprayed. As a result, the life of the sanitary washing apparatus is shortened.

Since the conventional heat exchanger is difficult to miniaturize, a sanitary washing apparatus using the heat exchanger is also difficult to miniaturize.

[Patent Document 1] JP 2001-279786 A

DISCLOSURE OF THE INVENTION

Means for Solving the Problems

An object of the present invention is to provide a heat exchanger in which the adhesion of impurities is prevented or reduced and that can be miniaturized, can be made highly efficient, and can have a longer life, and a washing apparatus including the same.

Another object of the present invention is to provide a heat exchanger in which the adhesion of impurities is prevented or reduced and that can be miniaturized, and can be made highly efficient, can have a longer life, and can be made lightweight, and a washing apparatus including the same.

A heat exchanger according to an aspect of the present invention includes a case, and a heating element accommodated in the case, a flow path through which a fluid flows is formed between an outer surface of the heating element and an inner surface of the case, and the heat exchanger further includes a flow velocity conversion mechanism that changes a flow velocity in at least a part of the flow path.

In the heat exchanger, the heating element is accommodated within the case, and the flow path through which the fluid flows is formed between the outer surface of the heating element and the inner surface of the case. Further, the flow velocity conversion mechanism that changes the flow velocity is provided in at least a part of the flow path.

In this case, thermal insulation is provided by the flow path provided in the outer periphery of the heating element, so that a thermal insulating layer need not be provided. Thus, the heat exchanger can be miniaturized.

Since the outer periphery of the heating element is surrounded by the flow path, heat hardly escapes out of the case. This can result in increased heat exchange efficiency, which makes it feasible to increase the efficiency of the heat exchanger.

Furthermore, the flow velocity of the fluid flowing within the flow path is changed by the flow velocity conversion mechanism. Thus, impurities do not easily adhere to the surface of the heating element or the inner surface of the case. Consequently, the adhesion of impurities on the surface of the heating element or the inner surface of the case can be prevented or reduced.

Since the flow velocity conversion mechanism can be held by an inner wall of the case having a low temperature, a material having low heat resistance can be employed for the flow velocity conversion mechanism. Thus, the processability of the flow velocity conversion mechanism is improved, and the flow velocity conversion mechanism can be made lightweight.

These results make it possible to realize a heat exchanger in which the adhesion of impurities is prevented or reduced and that is small in size, has a high efficiency, has a long life, and is lightweight.

The flow velocity conversion mechanism may change the flow velocity of the fluid so as to increase the flow velocity within the flow path.

In this case, the flow velocity of the fluid flowing within the flow path is raised by the flow velocity conversion mechanism. Thus, the thickness of a boundary layer in the flow velocity between the fluid and the heating element is reduced, so that heat generated by the heating element is efficiently transmitted to the fluid. Consequently, the rise in the surface temperature of the heating element is restrained. As a result, impurities are difficult to deposit on the surface of the heating element.

Even if impurities adhere to the surface of the heating element or the inner surface of the case, the impurities that have adhered are stripped by the fluid having a high flow velocity. Consequently, the adhesion of the impurities on the surface of the heating element or the inner surface of the case can be sufficiently prevented or reduced.

The flow velocity conversion mechanism may be configured so as to narrow at least a part of the flow path.

In this case, the flow velocity of the fluid can be raised in a simple configuration. Even when the impurities adhere to the surface of the heating element or the inner surface of the case, therefore, the impurities that have adhered are stripped by the fluid having a high flow velocity. Consequently, the adhesion of the impurities on the surface of the heating element or the inner surface of the case can be sufficiently prevented or reduced.

The flow velocity conversion mechanism may be configured so as to narrow the downstream side of the flow path.

In this case, the flow velocity of the fluid is raised on the downstream side of the flow path where the impurities relatively easily adhere. Even when the impurities adhere to the surface of the heating element or the inner surface of the case on the downstream side, therefore, the impurities that have adhered are stripped by the fluid having a high flow velocity. Consequently, the adhesion of the impurities on the surface of the heating element or the inner surface of the case can be sufficiently prevented or reduced.

The pressure loss in the flow path can be made smaller, as compared with that in a case where the whole space of the flow path is narrowed. Consequently, higher efficiency is made possible.

The flow velocity conversion mechanism may be configured such that a flow path cross section continuously narrows toward the downstream side of the flow path.

In this case, the flow velocity of the fluid is continuously raised toward a downstream region where impurities easily adhere. Thus, the adhesion of the impurities can be effectively prevented or reduced.

The pressure loss in the flow path can be made smaller, as compared with that in a case where the whole space of the flow path is narrowed. Consequently, higher efficiency is made possible.

The flow velocity conversion mechanism may be configured such that a flow path cross section gradually narrows toward the downstream side of the flow path.

In this case, the flow velocity of the fluid is gradually raised toward a downstream region where impurities easily adhere. Thus, the adhesion of the impurities can be effectively prevented or reduced.

The pressure loss in the flow path can be made smaller, as compared with that in a case where the whole space of the flow path is narrowed. Consequently, higher efficiency is made possible.

The case may have a plurality of fluid inlets provided from the upstream side to the downstream side of the flow path, and the flow velocity conversion mechanism may be composed of the plurality of fluid inlets.

In this case, the fluid is supplied from the plurality of fluid inlets so that the flow velocity of the fluid can be raised in a downstream region where impurities easily adhere. Even when the impurities adhere to the surface of the heating element or the inner surface of the case on the downstream side, therefore, the impurities that have adhered are stripped by the fluid having a high flow velocity. Consequently, the adhesion of the impurities on the surface of the heating element or the inner surface of the case can be sufficiently prevented or reduced.

Since the flow path need not be narrowed, the pressure loss in the flow path can be sufficiently reduced. Consequently, higher efficiency is made possible.

The flow velocity conversion mechanism may include another fluid introduction mechanism for introducing, in order to increase the flow velocity of the fluid within the flow path, another fluid into the flow path.

In this case, the flow velocity of the fluid is raised by the other fluid introduced by the other fluid introduction mechanism. Even when the impurities adhere to the surface of the heating element or the inner surface of the case, therefore, the impurities that have adhered are stripped by the fluid having a high flow velocity. Consequently, the adhesion of the impurities on the surface of the heating element or the inner surface of the case can be sufficiently prevented or reduced. Further, a value added by introducing the other fluid can be obtained.

The other fluid may include gas. In this case, the gas has a small thermal capacity, so that the flow velocity of the fluid can be raised without draining heat from the fluid. Thus, the adhesion of the impurities can be sufficiently prevented or reduced without reducing heat exchange efficiency.

The flow velocity conversion mechanism may include a turbulent flow generation mechanism that generates turbulent flow in at least a part of the flow path.

In this case, the turbulent flow is generated within the flow path by the turbulent flow generation mechanism. This makes it difficult for the impurities to adhere to the surface of the heating element or the inner surface of the case. Even when the impurities adhere to the surface of the heating element or the inner surface of the case, the impurities that have adhered are stripped by the turbulent flow. Consequently, the adhesion of the impurities on the surface of the heating element or the inner surface of the case can be sufficiently prevented or reduced.

The flow velocity conversion mechanism may be provided on an inner wall of the case. Even in this case, the adhesion of the impurities on the surface of the heating element or the inner surface of the case can be sufficiently prevented or reduced.

The flow velocity conversion mechanism may be provided on a surface of the heating element. In this case, the flow velocity conversion mechanism is provided on the surface of the heating element, so that the surface area of the heating element is increased. Thus, the heat radiation properties of the heating element are improved, so that the rise in the surface temperature of the heating element is restrained. As a result, the impurities are difficult to deposit on the surface of the heating element, so that the adhesion of the impurities on the surface of the heating element or the inner surface of the case can be sufficiently prevented or reduced.

The flow velocity conversion mechanism may be formed of a member separate from the heating element and the case. In this case, the flow velocity conversion mechanism can be held in a movable state by a force received from the flow of the fluid without being completely fixed to the case or the heating element. Thus, turbulent flow is generated within the flow path, so that the impurities do not easily adhere to the surface of the heating element or the inner surface of the case. Even when the impurities adhere to the surface of the heating element or the inner surface of the case, the impurities that have adhered are stripped by the turbulent flow. Consequently, the adhesion of the impurities on the surface of the heating element or the inner surface of the case can be sufficiently prevented or reduced.

The flow velocity conversion mechanism may include a flow velocity conversion member provided so as to form a clearance between the flow velocity conversion mechanism and the heating element.

In this case, the flow velocity conversion mechanism does not come into direct contact with the heating element, so that heat is not easily transmitted to the flow velocity conversion mechanism. Thus, thermal damage to the flow velocity conversion mechanism can be prevented. As a result, the life of the heat exchanger can be further lengthened.

The flow velocity conversion mechanism may include a flow velocity conversion member provided so as to form a clearance between the flow velocity conversion mechanism and the inner wall of the case.

In this case, the flow velocity conversion mechanism does not come into direct contact with the case, so that heat generated by the heating element is not easily transmitted to the case through the flow velocity conversion mechanism. Thus, thermal damage to the case can be prevented. As a result, the life of the heat exchanger can be further lengthened.

The flow velocity conversion mechanism may include a flow direction conversion mechanism that converts the flow direction of the fluid within the flow path.

In this case, the direction of the flow of the fluid within the flow path can be changed into the direction in which the apparent flow path cross-sectional area is reduced by the flow direction conversion mechanism, so that the flow velocity of the fluid can be raised. Thus, the thickness of a boundary layer in the flow velocity between the fluid and the heating element is reduced, so that the rise in the surface temperature of the heating element is restrained. As a result, the impurities are difficult to deposit on the surface of the heating element. The impurities, together with the fluid, can be discharged out of the heat exchanger by the fluid having a high flow velocity.

The direction of the flow of the fluid within the flow path is changed by the flow direction conversion mechanism, so that turbulent flow can be generated within the flow path. The impurities do not easily adhere to the surface of the heating element or the inner surface of the case. Even when the impurities adhere to the surface of the heating element or the inner surface of the case, the impurities that have adhered are stripped by the turbulent flow. Consequently, the adhesion of the impurities on the surface of the heating element or the inner surface of the case can be sufficiently prevented or reduced.

The flow velocity conversion mechanism may be provided in at least a part of the upstream or the downstream of the flow path. In this case, the pressure loss in the flow path can be made smaller, as compared with that in a case where the flow velocity conversion mechanism is provided in the whole space of the flow path, and it is feasible to make the heat exchanger lightweight and reduce the cost thereof.

The flow velocity conversion mechanism may be intermittently provided within the flow path. In this case, the pressure loss in the flow path can be made smaller, as compared with that in a case where the flow velocity conversion mechanism is provided in the whole space of the flow path, and it is feasible to make the heat exchanger lightweight and reduce the cost thereof.

The flow velocity conversion mechanism may be provided in a region where the surface temperature of the heating element is not less than a predetermined temperature.

In this case, the flow velocity of the fluid can be changed in a region where the temperature of the heating element is increased. Thus, it is possible to prevent the temperature of the heating element from being excessively raised as well as to effectively prevent or reduce the adhesion of the impurities.

The flow velocity conversion mechanism may be provided in a region where the surface temperature of the heating element is not less than a predetermined temperature and a region in the vicinity and on the upstream side thereof.

In this case, it is possible to prevent the effect on the flow velocity conversion mechanism by the increase in the temperature of the heating element. Further, the flow velocity of the fluid can be changed in the region where the temperature of the heating element is increased. Thus, it is possible to prevent the temperature of the heating element from being excessively raised as well as to effectively prevent or reduce the adhesion of the impurities.

The flow direction conversion mechanism may convert the flow direction of the fluid supplied to the flow path into the swirling direction. In this case, the flow direction of the fluid within the flow path can be changed without significantly increasing the pressure loss.

The flow direction conversion mechanism may include a guide provided in at least a part of the flow path. In this case, the flow direction of the fluid within the flow path can be changed in a simple configuration. Thus, space saving is made possible so that the heat exchanger can be further miniaturized.

The flow direction conversion mechanism may include a spiral member for converting the flow direction of the fluid within the flow path into the swirling direction.

In this case, the spiral member within the flow path can be held on the inner wall of the case having a low temperature, so that a material having low heat resistance can be employed for the spiral member. Thus, the processability of the spiral member is improved, and the spiral member can be made lightweight.

The direction of the flow of the fluid within the flow path can be changed into the swirling direction by the spiral member. Therefore, the apparent flow path cross-sectional area is reduced, so that the flow velocity of the fluid can be raised. Thus, the thickness of a boundary layer in the flow velocity between the fluid and the heating element is reduced, so that the rise in the surface temperature of the heating element is restrained. As a result, impurities are difficult to deposit on the surface of the heating element. The impurities, together with the fluid, can be discharged out of the heat exchanger by the fluid having a high flow velocity.

Furthermore, the direction of the flow of the fluid within the flow path can be introduced smoothly and in the swirling direction by the spiral member, which can realize a heat exchanger having a small pressure loss.

The spiral member may have a non-uniform pitch.

In this case, the flow velocity of the fluid can be raised in a portion with a small pitch, while the pressure loss in the flow path can be reduced in a portion with a large pitch.

A heat exchanger according to another aspect of the present invention includes a case, and a heating element accommodated in the case, a flow path through which a fluid flows is formed between an outer surface of the heating element and an inner surface of the case, and the heat exchanger further includes a fluid reducing material for lowering an oxidation/reduction potential of the fluid within the flow path.

In the heat exchanger, the heating element is accommodated within the case, and the flow path through which the fluid flows is formed between the outer surface of the heating element and the inner surface of the case. Further, there is provided a fluid reducing material for lowering the oxidation/reduction potential of the fluid within the flow path.

In this case, thermal insulation is provided by the flow path provided in the outer periphery of the heating element, so that a thermal insulating layer need not be provided. Thus, the heat exchanger can be miniaturized.

Since the outer periphery of the heating element is surrounded by the flow path, heat hardly escapes out of the case. This can result in increased heat exchange efficiency, which makes it feasible to increase the efficiency of the heat exchanger.

Furthermore, the oxidation/reduction potential of the fluid flowing within the flow path is reduced by the water reducing mechanism. Thus, impurities do not easily adhere to the surface of the heating element or the inner surface of the case. Even when the impurities adhere to the surface of the heating element or the inner surface of the case, the impurities can be dissolved and stripped. Consequently, the adhesion of the impurities on the surface of the heating element or the inner surface of the case can be prevented or reduced.

These results make it possible to realize a heat exchanger in which the adhesion of impurities is prevented or reduced and that is small in size, has a high efficiency, and has a long life.

The fluid reducing material may include magnesium or a magnesium alloy for lowering the oxidation/reduction potential of the fluid by reaction with the fluid.

In this case, magnesium or a magnesium alloy reacts with the fluid so that the oxidation/reduction potential of the fluid is lowered. Thus, a fluid having a low oxidation/reduction potential can be obtained in a simple configuration, so that impurities adhering to the surface of the heating element or the inner surface of the case can be dissolved and stripped. As a result, the heat exchanger can be miniaturized and made highly efficient.

The heat exchanger may further include a flow velocity conversion mechanism that changes the flow velocity in at least a part of the flow path, and the flow velocity conversion mechanism may be formed of the fluid reducing material.

In this case, the flow velocity of the fluid flowing within the flow path is changed by the flow velocity conversion mechanism. This makes it difficult for the impurities to adhere to the surface of the heating element or the inner surface of the case. Even when the impurities adhere to the surface of the heating element or the inner surface of the case, the impurities are dissolved and stripped by the fluid reducing material. Since the fluid reducing material is also used as the flow velocity conversion mechanism, the adhesion of the impurities on the surface of the heating element or the inner surface of the case can be prevented or reduced in a simple configuration. Consequently, the heat exchanger can be miniaturized and made highly efficient.

Furthermore, the water reducing mechanism is also used as the flow velocity conversion mechanism, so that the number of components and the number of assembling steps can be reduced.

A heat exchanger according to still another aspect of the present invention includes a case, and a heating element accommodated within the case, a flow path through which a fluid flows is formed between an outer surface of the heating element and an inner surface of the case, and the heat exchanger further includes an impurity removal mechanism that physically removes impurities within the flow path.

In the heat exchanger, the heating element is accommodated within the case, and the flow path through which the fluid flows is formed between the outer surface of the heating element and the inner surface of the case. Further, there is provided an impurity removal mechanism that physically removes the impurities within the flow path.

In this case, thermal insulation is provided by the flow path provided in the outer periphery of the heating element, so that a thermal insulating layer need not be provided. Thus, the heat exchanger can be miniaturized.

Since the outer periphery of the heating element is surrounded by the flow path, heat hardly escapes out of the case. This can result in increased heat exchange efficiency, which makes it feasible to increase the efficiency of the heat exchanger.

Furthermore, the impurities within the flow path are physically removed by the impurity removal mechanism. Thus, the adhesion of the impurities on the surface of the heating element or the inner surface of the case can be prevented or reduced. Consequently, it is possible to avoid problems due to the adhesion of the impurities and to carry out stable heat exchange.

Since the impurity removal mechanism can be held by an inner wall of a case having a low temperature, a material having low heat resistance can be employed for the impurity removal mechanism. Thus, the processability of the flow velocity conversion mechanism is improved, and the impurity removal mechanism can be made lightweight.

These results make is possible to realize a heat exchanger in which the adhesion of impurities is prevented or reduced and that is small in size, has a high efficiency, has a long life, and is lightweight.

The impurity removal mechanism may remove the impurities utilizing the flow of the fluid within the flow path.

In this case, it is possible to remove the impurities without providing a special device. Thus, it is feasible to miniaturize the heat exchanger and reduce the cost thereof.

The impurity removal mechanism may be so configured as to change the flow of the fluid within the flow path into turbulent flow.

In this case, the turbulent flow is generated within the flow path, so that the impurities do not easily adhere to the surface of the heating element or the inner surface of the case. Even when the impurities adhere to the surface of the heating element or the inner surface of the case, the impurities that have adhered are stripped by the turbulent flow. Consequently, the adhesion of the impurities on the surface of the heating element or the inner surface of the case can be sufficiently prevented or reduced.

Furthermore, the thickness of a boundary layer in the flow velocity between the fluid and the heating element is reduced, so that the rise in the surface temperature of the heating element is restrained. As a result, the impurities are difficult to deposit on the surface of the heating element. The impurities, together with the fluid, can be discharged out of the heat exchanger by the fluid having a high flow velocity.

The impurity removal mechanism may include a spiral spring. In this case, the spiral spring expands and contracts by a force of the fluid flowing within the flow path. Thus, the impurities that have adhered to the surface of the heating element or the inner surface of the case can be stripped. Consequently, the impurities adhering to the inside of the heat exchanger can be removed in a simple configuration.

The spiral spring may have at least one free end. In this case, it is possible to increase the expansion/contraction amount of the spiral spring. Thus, the effect of removing the impurities adhering to the inside of the heat exchanger can be increased.

The impurity removal mechanism may include a fluid supply device that supplies a fluid to the flow path at a pulsating pressure to remove the impurities at the pulsating pressure.

In this case, the fluid is supplied to the flow path at the pulsating pressure by the fluid supply device, and the impurities are removed at the pulsating pressure. Thus, the adhesion of the impurities on the surface of the heating element or the inner surface of the case can be effectively prevented or reduced without providing a special device. Consequently, it is feasible to miniaturize the heat exchanger and reduce the cost thereof.

The fluid supply device supplies the fluid to the flow path at the pulsating pressure after the heating element is increased to not less than a predetermined temperature.

In this case, the adhesion of the impurities on the surface of the heating element or the inner surface of the case can be effectively prevented or reduced after a state where the impurities easily adhere occurs. Thus, the life of the heat exchanger can be further lengthened.

A washing apparatus that sprays a fluid supplied from a water supply source on a portion to be washed according to still another aspect of the present invention includes a heat exchanger that heats the fluid supplied from the water supply source, a spray device that is connected to the downstream of the heat exchanger, to spray the fluid supplied from the heat exchanger on the portion to be washed, and a flow rate adjuster that adjusts the flow rate of the fluid supplied to the heat exchanger such that in an operation for washing the heat exchanger, the flow rate of the fluid supplied to the heat exchanger is higher than that at the time of an operation for washing the portion to be washed by the spray device.

In the washing apparatus, the fluid supplied from the water supply source is heated by the heat exchanger, and the fluid supplied from the heat exchanger is sprayed on the portion to be washed by the spray device. Thus, the portion to be washed is washed. In the operation for washing the heat exchanger, the flow rate of the fluid supplied to the heat exchanger is adjusted by the flow rate adjuster such that the flow rate of the fluid supplied to the heat exchanger is higher than that at the time of the operation for washing the portion to be washed by the spray device.

In this case, the fluid is supplied to the heat exchanger at a higher flow rate than that at the time of the operation for washing the portion to be washed. Thus, the flow velocity of the fluid within the heat exchanger is raised, so that the impurities do not easily adhere to the surface of the heating element or the inner surface of the case. Even when the impurities adhere to the surface of the heating element or the inner surface of the case, a shock is applied to the impurities by the fluid having a high flow velocity so that the impurities are stripped. Consequently, the adhesion of the impurities on the surface of the heating element or the inner surface of the case can be prevented or reduced. Consequently, stable heat exchange can be carried out for a long time period without causing defective operations.

Since the impurities are not deposited and made to adhere to the inside of the heat exchanger for a long time period, the spray device is not clogged with fractions of the impurities discharged from the heat exchanger. As a result, defective operations of the washing apparatus do not easily occur, which makes it feasible to increase the efficiency of the washing apparatus and lengthen the life thereof.

The heat exchanger need not be provided with a special device in order to prevent or reduce the adhesion of the impurities on the surface of the heating element or the inner surface of the case, so that the heat exchanger can be miniaturized and made lightweight. Thus, it is feasible to miniaturize the washing apparatus and make the washing apparatus lightweight. Consequently, the washing apparatus can be easily installed in a narrow toilet space.

The flow rate adjuster may adjust the flow rate of the fluid supplied to the heat exchanger at the time of the operation for washing the portion to be washed by the spray device.

In this case, the flow rate adjuster is also used for adjusting the flow rate for the operation for washing the heat exchanger and adjusting the flow rate at the time of the operation for washing the portion to be washed. Thus, it is feasible to further miniaturize the washing apparatus and reduce the cost thereof.

The washing apparatus may further include a main flow path that introduces the fluid into the spray device, a sub-flow path that introduces the fluid into a portion other than the spray device, and a flow path switcher that is provided between the heat exchanger and the spray device to selectively communicate one of the main flow path and the sub-flow path to the heat exchanger.

In this case, the flow path switcher communicates the main flow path to the heat exchanger at the time of the operation for washing the portion to be washed. Thus, the fluid is introduced into the spray device through the main flow path. Further, the flow path switcher communicates the sub-flow path to the heat exchanger at the time of the operation for washing the heat exchanger. Thus, the fluid is introduced into the portion other than the spray device through the sub-flow path, so that the heat exchanger is washed by the fluid having a high flow rate.

In a case where the portion to be washed is not washed by the spray device, therefore, the fluid is introduced into the sub-flow path. Therefore, the fluid having a high flow rate is not sprayed from the spray device, so that the fluid having a high flow rate does not strike the portion to be washed. Consequently, the washing apparatus can be employed safely and comfortably.

The flow rate adjuster and the flow path switcher may be integrally formed. In this case, it is feasible to further miniaturize the washing apparatus and reduce the cost thereof.

The sub-flow path may be provided so as to introduce the fluid into a surface of the spray device.

In this case, at the same time that the fluid having a high flow rate is supplied to the heat exchanger at the time of the operation for washing the heat exchanger, the surface of the spray device can be washed. Thus, the washing apparatus can be kept clean.

The washing apparatus may further include a by path flow path that is provided so as to branch off from the downstream of the heat exchanger and to which the fluid discharged from the heat exchanger is supplied at the time of the operation for washing the heat exchanger.

In this case, the fluid having a high flow rate discharged from the heat exchanger is supplied to the by path flow path at the time of the operation for washing the heat exchanger. Thus, the pressure loss at the time of the operation for washing the heat exchanger can be reduced, so that the fluid having a high flow rate can be easily supplied to the heat exchanger. Consequently, it is possible to strip the impurities that have adhered to the inside of the heat exchanger upon application of a shock to the impurities, so that the heat exchanger can be effectively washed. As a result, the life of the washing apparatus can be further lengthened.

The washing apparatus may further include a switch for issuing a command to perform the operation for washing the heat exchanger, and the flow rate adjuster may adjust the flow rate of the fluid supplied to the heat exchanger in response to an operation of the switch such that the flow rate of the fluid supplied to the heat exchanger is higher than that at the time of the operation for washing the portion to be washed by the spray device.

In this case, when a user operates the switch, the flow rate of the fluid supplied to the heat exchanger is adjusted by the flow rate adjuster such that the flow rate of the fluid supplied to the heat exchanger is higher than that at the time of the operation for washing the portion to be washed by the spray device. Consequently, the user operates the switch when the toilet must be cleaned, for example, so that the operation for washing the heat exchanger can be reliably performed.

The washing apparatus may further include a toilet seat, and a seating detector that detects seating on a toilet seat, and the flow rate adjustor may not adjust the flow rate at the time of the operation for washing the heat exchanger when the seating detector detects the seating.

In this case, the flow rate is not adjusted at the time of the operation for washing the heat exchanger when the seating detector detects that a user is seated. Thus, the operation for washing the heat exchanger is not performed when the user is seated, so that the washing apparatus can be employed safely and comfortably.

The flow rate adjuster may adjust the flow rate of the fluid supplied to the heat exchanger such that after the operation for washing the portion to be washed by the spray device, the flow rate of the fluid supplied to the heat exchanger is higher than that at the time of the operation for washing the portion to be washed by the spray device.

Immediately after the operation for washing the portion to be washed is performed using warm water by the spray device, the impurities are liable to be fixed in the heat exchanger. By washing the heat exchanger using the fluid having a high flow rate after the operation for washing the portion to be washed by a body washing nozzle, therefore, the adhesion of the impurities can be more effectively prevented or reduced.

The washing apparatus may be mounted on a toilet bowl, and may further include a human body detector that detects the human body employing the toilet boil, and the flow rate adjustor may not adjust the flow rate at the time of the operation for washing the heat exchanger when the human body detector detects the human body.

In this case, when the human body detector detects the human body, the flow rate at the time of the operation for washing the heat exchanger is not adjusted. Thus, the operation for washing the heat exchanger is not performed at the time of male's urine, so that the user can employ the washing apparatus safely and comfortably.

The washing apparatus may further include a power controller that changes power supplied to the heat exchanger at the time of the operation for washing the heat exchanger.

In this case, the power supplied to the heat exchanger is changed so that a thermal shock is generated by thermal expansion and thermal contraction of the heat exchanger. Thus, a shock is applied to the impurities that have adhered to the inside of the heat exchanger, so that the impurities are stripped. As a result, the adhesion of the impurities can be effectively prevented or reduced, which allows the life of the washing apparatus to be further lengthened.

A washing apparatus that sprays a fluid supplied from a water supply source on a portion to be washed of the human body according to still another aspect of the present invention includes a heat exchanger that heats the fluid supplied from the water supply source, and a spray device that sprays the fluid heated by the heat exchanger on the human body, the heat exchanger includes a case, and a heating element accommodated in the case, a flow path is formed between an outer surface of the heating element and an inner surface of the case, and the heat exchanger further includes a flow velocity conversion mechanism that changes a flow velocity in at least a part of the flow path.

In the washing apparatus, the fluid supplied from the water supply source is heated by the heat exchanger, and the heated fluid is sprayed on the human body by the spray device. Thus, the portion to be washed of the human body is washed.

A heat exchanger in which the adhesion of impurities is prevented or reduced and that is small in size, has a high efficiency, has a long life, and is lightweight is used for the washing apparatus. Consequently, stable heat exchange can be carried out for a long time period without causing defective operations.

Since the impurities are not deposited and made to adhere to the inside of the heat exchanger for a long time period, the spray device is not clogged with fractions of the impurities discharged from the heat exchanger. As a result, defective operations of the washing apparatus do not easily occur, which makes it feasible to increase the efficiency of the washing apparatus and lengthen the life thereof.

Furthermore, it is feasible to miniaturize the washing apparatus and make the washing apparatus lightweight. Consequently, the washing apparatus can be also easily installed in a narrow toilet space.

A washing apparatus that sprays a fluid supplied from a water supply source on a portion to be washed of the human body according to still another aspect of the present invention includes a heat exchanger that heats the fluid supplied from the water supply source, and a spray device that sprays the fluid heated by the heat exchanger on the human body, the heat exchanger includes a case, and a heating element accommodated in the case, a flow path is formed between an outer surface of the heating element and an inner surface of the case, and the heat exchanger further includes a fluid reducing material for lowering an oxidation/reduction potential of the fluid within the flow path.

In the washing apparatus, the fluid supplied from the water supply source is heated by the heat exchanger, and the heated fluid is sprayed on the human body by the spray device. Thus, the portion to be washed of the human body is washed.

A heat exchanger in which the adhesion of impurities is prevented or reduced and that is small in size, has a high efficiency, and has a long life is used for the washing apparatus. Consequently, stable heat exchange can be carried out for a long time period without causing defective operations.

Since the impurities are not deposited and made to adhere to the inside of the heat exchanger for a long time period, the spray device is not clogged with fractions of the impurities discharged from the heat exchanger. As a result, defective operations of the washing apparatus do not easily occur, which makes it feasible to increase the efficiency of the washing apparatus and lengthen the life thereof.

Furthermore, it is feasible to miniaturize the washing apparatus. Consequently, the washing apparatus can be also easily installed in a narrow toilet space.

A washing apparatus that sprays a fluid supplied from a water supply source on a portion to be washed of the human body according to still another aspect of the present invention includes a heat exchanger that heats the fluid supplied from the water supply source, and a spray device that sprays the fluid heated by the heat exchanger on the human body, the heat exchanger includes a case, and a heating element accommodated in the case, a flow path is formed between an outer surface of the heating element and an inner surface of the case, and the heat exchanger further includes an impurity removal mechanism that physically remove the impurities within the fluid.

In the washing apparatus, the fluid supplied from the water supply source is heated by the heat exchanger, and the heated fluid is sprayed on the human body by the spray device. Thus, the portion to be washed of the human body is washed.

A heat exchanger in which the adhesion of impurities is prevented or reduced and that is small in size, has a high efficiency, has a long life, and is lightweight is used for the washing apparatus. Consequently, stable heat exchange can be carried out for a long time period without causing defective operations.

Since the impurities are not deposited and made to adhere to the inside of the heat exchanger for a long time period, the spray device is not clogged with fractions of the impurities discharged from the heat exchanger. As a result, defective operations of the washing apparatus do not easily occur, which makes it feasible to increase the efficiency of the washing apparatus and lengthen the life thereof.

Furthermore, it is feasible to miniaturize the washing apparatus and make the washing apparatus lightweight. Consequently, the washing apparatus can be easily installed in a narrow toilet space.

A washing apparatus that washes a washing object using a fluid supplied from a water supply source according to still another aspect of the present invention includes a washing tub accommodating the washing object, a heat exchanger that heats the fluid supplied from the water supply source, and a supply device that supplies the fluid heated by the heat exchanger to the washing tub, the heat exchanger includes a case, and a heating element accommodated in the case, a flow path is formed between an outer surface of the heating element and an inner surface of the case, and the heat exchanger further includes a flow velocity conversion mechanism that changes a flow velocity in at least a part of the flow path.

In the washing apparatus, the fluid supplied from the water supply source is heated by the heat exchanger, and the heated fluid is supplied to the washing tub. Thus, the washing object within the washing tub is washed.

A heat exchanger in which the adhesion of impurities is prevented or reduced and that is small in size, has a high efficiency, has a long life, and is lightweight is used for the washing apparatus. Consequently, stable heat exchange can be carried out for a long time period without causing defective operations.

Since the impurities are not deposited and made to adhere to the inside of the heat exchanger for a long time period, the supply device is not clogged with fractions of the impurities discharged from the heat exchanger. As a result, defective operations of the washing apparatus do not easily occur, which makes it feasible to increase the efficiency of the washing apparatus and lengthen the life thereof.

Furthermore, it is feasible to miniaturize the washing apparatus and make the washing apparatus lightweight. Consequently, the washing apparatus can be also easily installed in a narrow space.

A washing apparatus that washes a washing object using a fluid supplied from a water supply source according to still another aspect of the present invention includes a washing tub accommodating the washing object, a heat exchanger that heats the fluid supplied from the water supply source, and a supply device that supplies the fluid heated by the heat exchanger to the washing tub, the heat exchanger includes a case, and a heating element accommodated in the case, a flow path is formed between an outer surface of the heating element and an inner surface of the case, and the heat exchanger further includes a fluid reducing material for lowering an oxidation/reduction potential of the fluid within the flow path.

In the washing apparatus, the fluid supplied from the water supply source is heated by the heat exchanger, and the heated fluid is supplied to the washing tub. Thus, the washing object within the washing tub is washed.

A heat exchanger in which the adhesion of impurities is prevented or reduced and that is small in size, has a high efficiency, and has a long life is used for the washing apparatus. Consequently, stable heat exchange can be carried out for a long time period without causing defective operations.

Since the impurities are not deposited and made to adhere to the inside of the heat exchanger for a long time period, the supply device is not clogged with fractions of the impurities discharged from the heat exchanger. As a result, defective operations of the washing apparatus do not easily occur, which makes it feasible to increase the efficiency of the washing apparatus and lengthen the life thereof.

Furthermore, it is feasible to miniaturize the washing apparatus. Consequently, the washing apparatus can be also easily installed in a narrow space.

A washing apparatus that washes a washing object using a fluid supplied from a water supply source according to still another aspect of the present invention includes a washing tub accommodating the washing object, a heat exchanger that heats the fluid supplied from the water supply source, and a supply device that supplies the fluid heated by the heat exchanger to the washing tub, the heat exchanger includes a case, and a heating element accommodated in the case, a flow path is formed between an outer surface of the heating element and an inner surface of the case, and the heat exchanger further includes an impurity removal mechanism that physically removes the impurities within the fluid.

In the washing apparatus, the fluid supplied from the water supply source is heated by the heat exchanger, and the heated fluid is supplied to the washing tub. Thus, the washing object within the washing tub is washed.

A heat exchanger in which the adhesion of impurities is prevented or reduced and that is small in size, has a high efficiency, has a long life, and is lightweight is used for the washing apparatus. Consequently, stable heat exchange can be carried out for a long time period without causing defective operations.

Since the impurities are not deposited and made to adhere to the inside of the heat exchanger for a long time period, the supply device is not clogged with fractions of the impurities discharged from the heat exchanger. As a result, defective operations of the washing apparatus do not easily occur, which makes it feasible to increase the efficiency of the washing apparatus and lengthen the life thereof.

Furthermore, it is feasible to miniaturize the washing apparatus and make the washing apparatus lightweight. Consequently, the washing apparatus can be also easily installed in a narrow space.

BEST MODE FOR CARRYING OUT THE INVENTION

Figure 1:
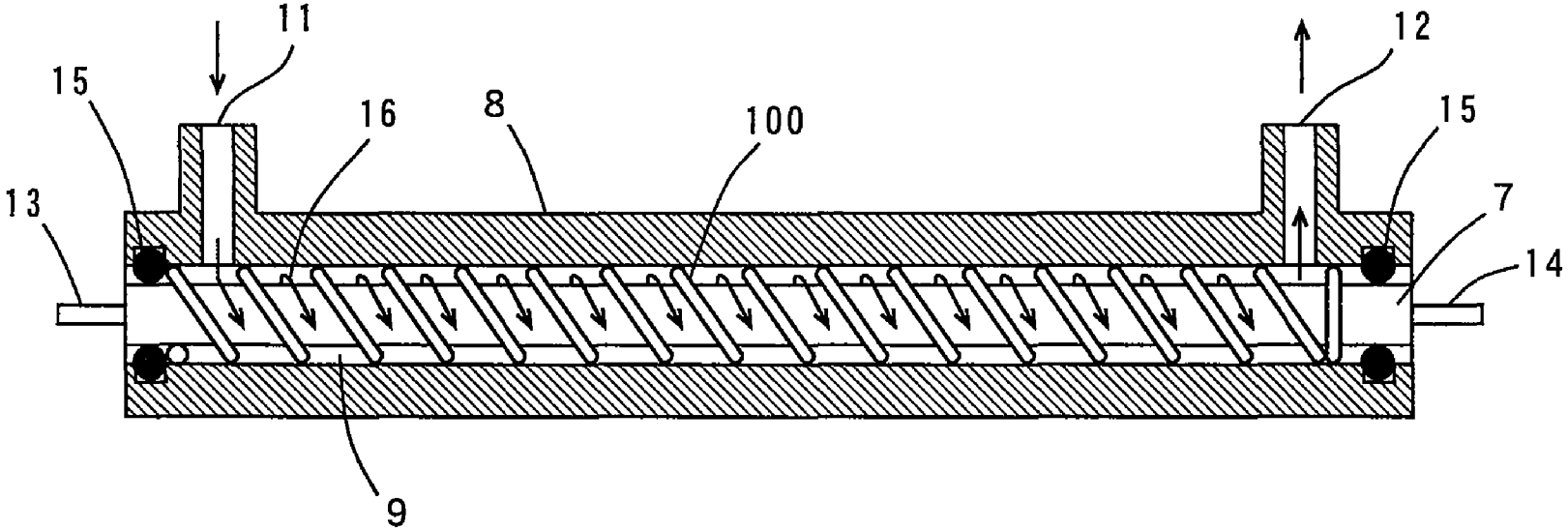
FIG. 1 is a cross-sectional view in the axial direction of a heat exchanger in a first embodiment of the present invention.

The embodiments of the present invention will be described referring to the drawings. The present invention is not limited to the embodiments.

First Embodiment

Figure 2:
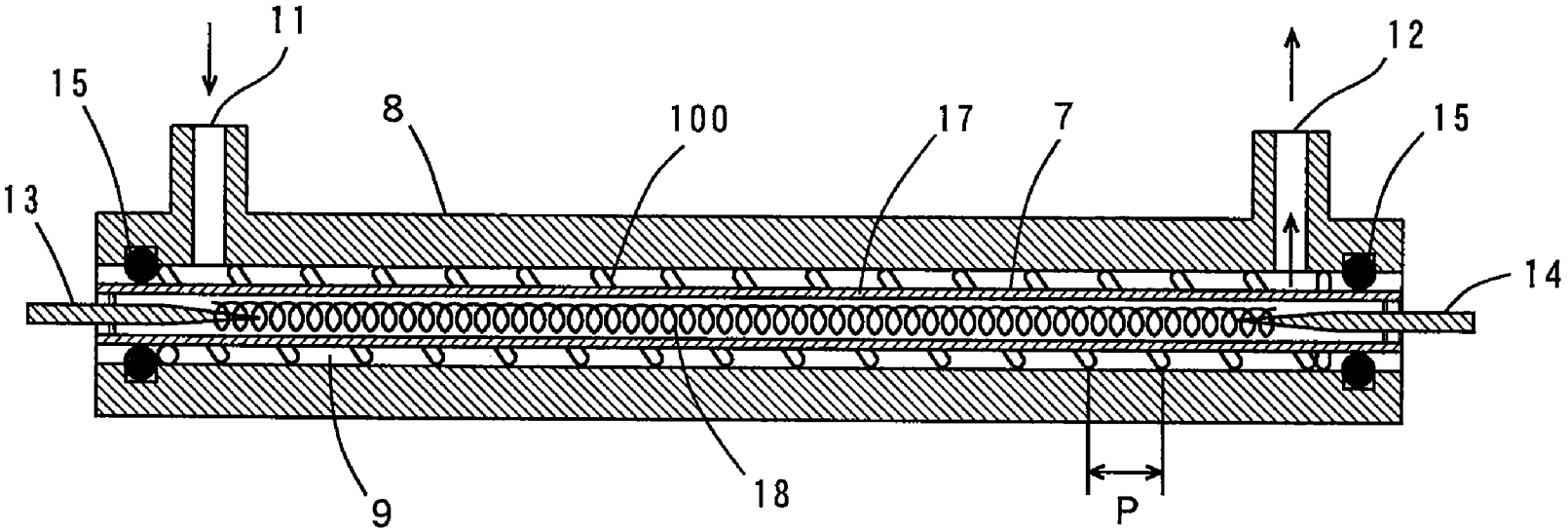
FIG. 2 is a cross-sectional view in the axial direction of the heat exchanger in the first embodiment of the present invention.
Figure 3:
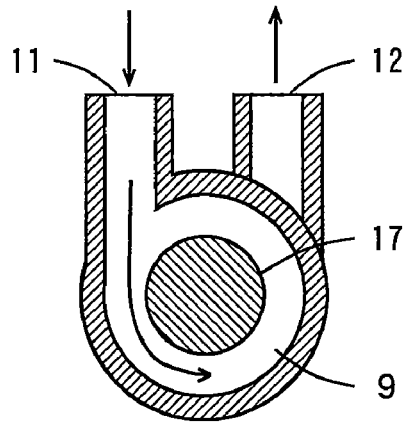
FIG. 3 is a horizontal sectional view of the heat exchanger shown in FIGS. 1 and 2.

FIGS. 1 and 2 are cross-sectional views in the axial direction of a heat exchanger in a first embodiment of the present invention, where FIG. 1 illustrates a cross section of a case and a side surface of a sheathed heater, and FIG. 2 illustrates respective cross sections of the case and the sheathed heater. FIG. 3 is a horizontal sectional view of the heat exchanger shown in FIGS. 1 and 2.

In FIG. 1, the heat exchanger comprises a substantially pillar sheathed heater 7, a substantially cylindrical case 8, and a spiral spring 100. The sheathed heater 7 is a heating element that heats water as a fluid, and is accommodated within the case 8. The case 8 has a cavity having a circular or elliptical cross section, and is provided so as to surround the outer periphery of the sheathed heater 7. The spring 100 is provided so as to be wound around an outer peripheral surface of the sheathed heater 7. Thus, a spiral flow path 9 is formed among the outer peripheral surface of the sheathed heater 7, an inner peripheral surface of the case 8, and the spring 100.

The spring 100 functions as a flow velocity conversion mechanism, a turbulent flow generation mechanism, a flow direction conversion mechanism, and an impurity removal mechanism, as described later.

A water inlet 11 is provided in the vicinity of one end on a side surface of the case 8, and a water outlet 12 is provided in the vicinity of the other end of the side surface of the case 8. As shown in FIG. 3, the water inlet 11 and the water outlet 12 are respectively arranged at positions eccentric from a central axis of the case 8 on the side surface of the case 8. The sheathed heater 7 has electrode terminals 13 and 14 at both its ends. O-rings 15 are respectively mounted in the vicinities of both the ends of the sheathed heater 7 in order to seal areas between the inner peripheral surface in the vicinities of both the ends of the case 8 and the outer peripheral surface in the vicinities of both the ends of the sheathed heater 7.

As shown in FIG. 2, the sheathed heater 7 comprises a copper pipe 17 in which a magnesium oxide (not shown) is sealed. A coil-shaped electrically-heated wire 18 is inserted into the copper pipe 17. Both ends of the electrically-heated wire 18 are respectively connected to the electrode terminals 13 and 14. The electrode terminals 13 and 14 are respectively mounted on both ends of the copper pipe 17.

The operation and the function of the heat exchanger configured as described above will be described.

As shown in FIG. 3, water flows onto an outer peripheral surface of the copper pipe 17 in the sheathed heater 7 from the water inlet 11 provided at the position eccentric from the central axis of the case 8, further flows while swirling in a spiral shape along the outer peripheral surface of the copper pipe 17 by the spiral spring 100, and flows out of the water outlet 12 provided at the position eccentric from the central axis of the case 8. Thus, water flows through the spiral flow path 9, so that swirling flow 16 is formed.

A current is supplied to the electrically-heated wire 18 through the electrode terminals 13 and 14 so that the electrically-heated wire 18 is heated. Heat is transmitted to the copper pipe 17 through a magnesium oxide from the electrically-heated wire 18, so that water flowing on the outer peripheral surface of the copper pipe 17 is heated. Heat exchange is thus carried out between the copper pipe 17 and water so that warm water is generated.

Here, in a case where the spring 100 does not exist, a cylindrical flow path (a doughnut-shaped flow path) is formed between the inner peripheral surface of the case 8 and the outer peripheral surface of the sheathed heater 7. In this case, water flowing into the case 8 flows along the axis of the sheathed heater 7 through the cylindrical flow path.

In the present embodiment, the winding direction and the pitch P of the spring 100 are set such that the flow path cross-sectional area of the spiral flow path 9 (the area of a cross section perpendicular to the direction of the swirling flow 16) is smaller than the flow path cross-sectional area of the cylindrical flow path (the area of a cross section perpendicular to the axial direction of the sheathed heater 7).

Consequently, the swirling flow 16 flowing in a spiral shape along the spring 100 is accelerated, so that the flow velocity of water flowing in the spiral flow path 9 is made higher than that in a case where the spring 100 does not exist. Thus, the spring 100 in the present embodiment functions as a flow velocity conversion mechanism that raises the flow velocity of a fluid, and also functions as a flow direction conversion mechanism that converts the direction of the flow of the fluid into the swirling direction. The apparent flow path cross-sectional area is expressed by the product of a clearance between the sheathed heater 7 and the case 8 and the pitch P of the spring 100.

The flow velocity of water flowing within the spiral flow path 9 is raised so that turbulent flow is generated. Thus, the spring 100 in the present embodiment also functions as a turbulent flow generation mechanism that generates turbulent flow.

Turbulent flow is a generic name meaning turbulence in flow including flow whose direction is changed, flow whose flow velocity is changed, and so on.

In a case where the outer diameter of the sheathed heater 7 is 6.5 mm, the inner diameter of the case 8 is 9 mm, and the pitch of the spring 100 is 6 mm, for example, the flow path cross-sectional area in a case where the spring 100 does not exist is approximately 30 $mm^2$, while the apparent flow path cross-sectional area in a case where the spring 10 exists is approximately 7.5 $mm^2$. When water is caused to flow at the same flow rate, therefore, the flow velocity in a case where the spring 100 exists can be set to approximately four times that in a case where the spring 100 does not exist. The flow of water is the swirling flow 16, so that the increase in pressure loss is relatively small even if the flow path cross-sectional area is small. Further, the water inlet 11 and the water outlet 12 are provided at the positions eccentric from the central axis of the case 8, so that the flow of water within the case 8 can be smoothly guided in the swirling direction. Thus, the pressure loss can be reduced.

In a case where the spring 100 does not exist, a cylindrical flow path surrounded by the case 8 and the sheathed heater 7 has a flow path cross section having a high aspect ratio. In this case, water flowing in from the water inlet 11 provided at the position eccentric from the central axis of the case 8 flows in a spiral shape along the outer peripheral surface of the sheathed heater 7 at the beginning. However, the rectification effect is gradually produced so that a flow component in the swirling direction is lost, and a flow component in the axial direction is a main component. As a result, the flow velocity of water is substantially lowered in a region on the downstream side near the water outlet 12.

Contrary to this, in the present embodiment, the spiral flow path 9 is formed by the spiral spring 100 on the outer peripheral surface of the sheathed heater 7. Thus, swirling flow in a turbulent flow state that is always deflected and has a high flow velocity continues, so that the thickness of a boundary layer in the flow velocity between the copper pipe 17 in the sheathed heater 7 and water is significantly reduced.

Figure 4:
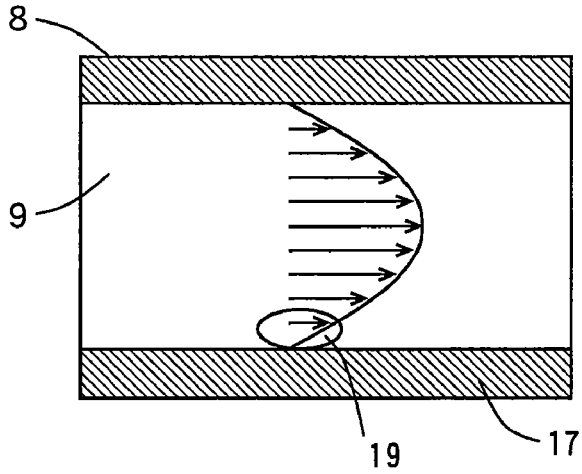
FIG. 4*a* is a diagram showing a flow velocity distribution within the heat exchanger in a case where the flow velocity is low.
FIG. 4*b* is a diagram showing a flow velocity distribution within the heat exchanger in a case where the flow velocity is high.
Figure 4:
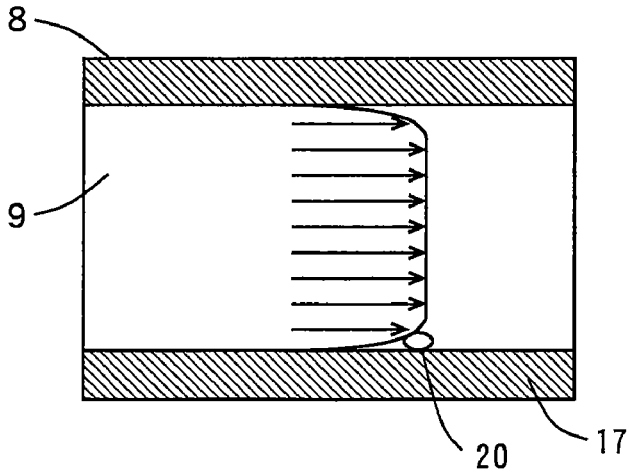

FIG. 4*a* shows a flow velocity distribution within the heat exchanger in a case where the flow velocity is low, and FIG. 4*b* shows a flow velocity distribution within the heat exchanger in a case where the flow velocity is high.

In a case where the flow velocity of water is low, the thickness of a boundary layer 19 in the flow velocity between water and the copper pipe 17 is increased, as shown in FIG.

4*a*. Thus, heat generated by the copper pipe 17 is not efficiently transmitted to the whole of water. Contrary to this, when the flow velocity of water is high and the flow of water is changed into turbulent flow, the thickness of a boundary layer 20 in the flow velocity between water and the copper pipe 17 is reduced, as shown in FIG. 4*b*. Thus, heat generated by the copper pipe 17 is efficiently transmitted to the whole of water. As a result, the surface temperature of the copper pipe 17 is prevented from being excessively raised.

Generally, as the temperature increases, the deposition amount of the scale increases. When the thickness of the boundary layer 20 in the flow velocity between water and the copper pipe 17 is reduced by raising the flow velocity of water within the spiral flow path 9, as in the present embodiment, therefore, the rise in the surface temperature of the copper pipe 17 can be restrained. As a result, the scale can be prevented from being deposited on the copper pipe 17, or the number of scale components deposited on the copper pipe 17 can be reduced.

Even when the scale is deposited, the scale has a high flow velocity, and is washed away toward the downstream side by fast flow while being pulverized by the swirling flow 16 in a turbulent flow state. Thus, the scale does not easily adhere to the inside of the heat exchanger, and the heat exchanger is not clogged with the scale on the downstream side. The scale that has adhered to the inside of the heat exchanger has a high flow velocity, and is stripped by the swirling flow in a turbulent flow state. Thus, the spring 100 in the present embodiment functions as an impurity removal mechanism. As a result, the life of the heat exchanger can be lengthened.

Furthermore, smooth spiral flow is formed, so that the pressure loss within the spiral flow path 9 can be reduced while having a high flow velocity. This results in improved heat exchange efficiency, and makes it feasible to miniaturize the heat exchanger.

Furthermore, thermal insulation is provided by the spiral flow path 9 formed in the outer periphery of the sheathed heater 7, so that a thermal insulating layer need not be provided. Consequently, the heat exchanger can be further miniaturized. Further, heat generated by the sheathed heater 7 can be prevented from escaping outward by the spiral flow path 9 formed in the outer periphery of the sheathed heater 7. Consequently, the heat exchange efficiency can be further improved.

As described in the foregoing, in the heat exchanger according to the present embodiment, the spiral spring 100 functions as a flow velocity conversion mechanism, a flow direction conversion mechanism, a turbulent flow generation mechanism, and an impurity removal mechanism, which causes the adhesion of the scale to be prevented or reduced, and makes it feasible to lengthen the life of, increase the efficiency of, and miniaturize the heat exchanger.

In the heat exchanger according to the present embodiment, not only the adhesion of the scale but also the adhesion of impurities such as a water stain and dust can be simultaneously prevented or reduced. In the following description, however, the scale will be described as a representative example of the impurities.

Since the swirling flow 16 has a high flow velocity, the generation of air bubbles is reduced, and the surface temperature of the copper pipe 17 in the sheathed heater 7 is kept low. Therefore, the production of a boiling sound can be reduced.

Furthermore, the spring 100 is held on the inner wall of the case 8 having a low temperature. Therefore, a material having a low heat-resistant temperature, for example, resin can be used as a material for the spring 100. Thus, the spring 100 can be produced by a material that is easy to process and is lightweight. Consequently, the heat exchanger can be made lightweight.

In the present embodiment, the flow velocity of the swirling flow 16 is raised until the flow of water is brought into a turbulent flow state by the spring 100 functioning as a flow velocity conversion mechanism, a flow direction conversion mechanism, and a turbulent flow generation mechanism in order to enhance the effect of reducing the scale. Even if the flow of water is in the turbulent flow state, however, the flow velocity of the swirling flow 16 is raised by the spring 100 so that the thickness of the boundary layer 20 in the flow velocity between water and the copper pipe 17 can be reduced. Thus, the effect of reducing the scale can be obtained.

The spring 100 is formed of a member separate from the sheathed heater 7 and the case 8, and is not completely fixed to the copper pipe 17 in the sheathed heater 7 or the case 8. In this case, a part of the spring 100 is held in a freely vibrated state. Thus, the spring 100 can be vibrated by a force received from the flow of water and elasticity, so that the effect of preventing or reducing the adhesion of the scale and the effect of stripping the scale are obtained.

Furthermore, the spring 100 serving as a separate member can be easily detached from the heat exchanger. In a case where the heat exchanger is employed in an area where there are few scale components in tap water or an area where the pressure of tap water is low, therefore, the spring 100 serving as a separate member is detached so that the shape of the spring 100 can be changed such that the pressure loss is lowered, or the spring 100 can be attached to a portion where the flow velocity is reduced within the heat exchanger. Thus, the pressure loss within the heat exchanger is further reduced, and the flow velocity is further raised. As a result, the adhesion of the scale can be sufficiently prevented or reduced. The spring 100 can be easily replaced at the abnormal time, resulting in improved maintenance properties.

Although in the present embodiment, the copper pipe 17 is used as a sheath of the sheathed heater 7, a member composed of another material such as an iron pipe or an SUS (stainless steel) pipe may be used as the sheath, in which case the same effect is obtained.

Various materials such as a metal and resin can be used as the material for the spring 100. In the present embodiment, various members having the same shape, for example, a spiral line having no spring properties can be used in place of the spiral spring 100 as a flow velocity conversion mechanism, a flow velocity conversion mechanism, a turbulent flow generation mechanism, and an impurity removal mechanism.

In a case where the heat exchanger according to the present embodiment is used for the sanitary washing apparatus, the flow rate thereof is approximately 100 to 2000 mL per minute. Therefore, it is preferable that the outer diameter of the copper pipe 17 is approximately 3 mm to 20 mm, and the pitch P of the spiral spring 100 is approximately 3 mm to 20 mm. It is preferable that the inner diameter of the case 8 is in a range from 5 mm to 30 mm. Consequently, the swirling flow 16 is accelerated so that the flow velocity is raised, and the turbulent flow state can be generated. In a case where the line diameter of the spring 100 is approximately 0.1 mm to 3 mm, the heat exchanger is superior in processability.

Although in the present embodiment, the pitch P of the spring 100 is constant, the pitch of the spring 100 may be partially narrowed or widened, or the pitch of the spring 100 may be gradually changed, as described in embodiments, described later. In this case, the spring 100 also functions as a flow velocity conversion mechanism, a flow direction conversion mechanism, a turbulent flow generation mechanism, and an impurity removal mechanism, so that the adhesion of the scale can be prevented or reduced.

Furthermore, although in the present embodiment, the spring 100 is provided in the whole of the flow path, the spring 100 may be provided in a part of the flow path, as described in embodiments, described later. In this case, the spring 100 also functions as a flow velocity conversion mechanism, a flow direction conversion mechanism, a turbulent flow generation mechanism, and an impurity removal mechanism, so that the adhesion of the scale can be prevented or reduced.

Although in the present embodiment, the spiral spring 100 is used as a flow velocity conversion mechanism, a flow direction conversion mechanism, a turbulent flow generation mechanism, and an impurity removal mechanism, the present invention is not limited to the same. The flow velocity conversion mechanism, the flow direction conversion mechanism, the turbulent flow generation mechanism, and the impurity removal mechanism may be realized by a member having another shape, for example, a turbulence promotion blade or guide. In such a case, the effect of preventing or reducing the adhesion of the scale is also obtained.

In a case where the heat exchanger according to the present embodiment is used as a main body of the sanitary washing apparatus, it is feasible to miniaturize the main body of the sanitary washing apparatus. Since the washing nozzle is prevented from being clogged with fractions of the scale, the sanitary washing apparatus having a long life can be obtained.

Second Embodiment

Figure 5:
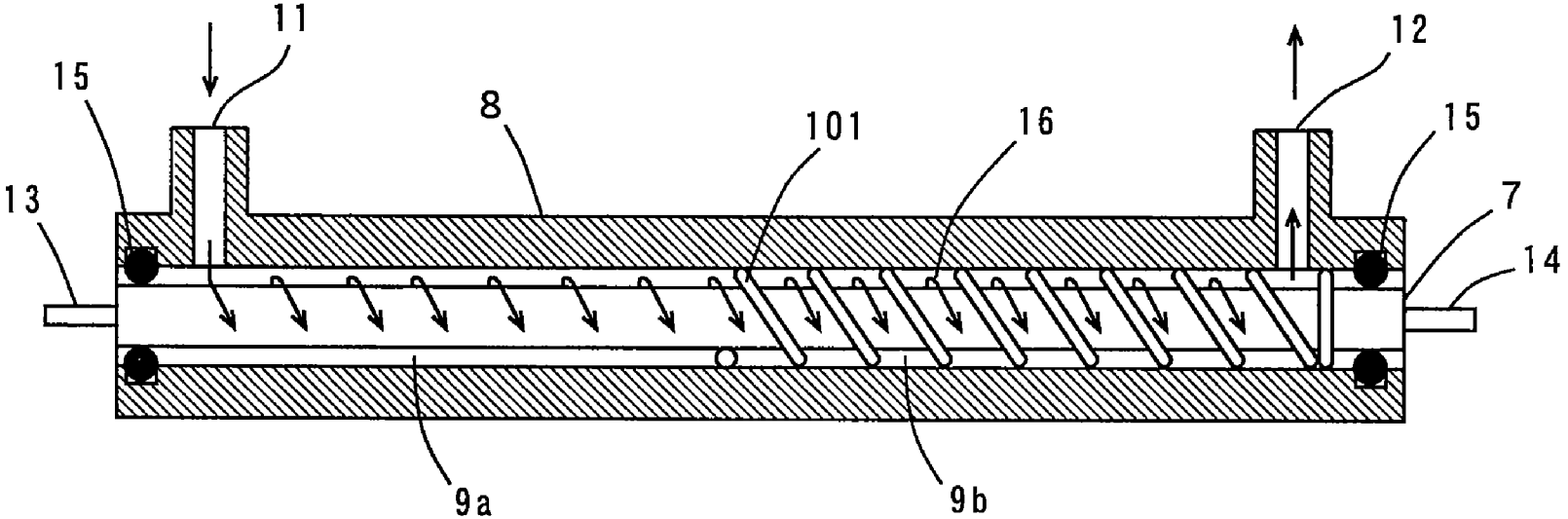
FIG. 5 is a cross-sectional view in the axial direction of a heat exchanger in a second embodiment of the present invention.

FIG. 5 is a cross-sectional view in the axial direction of a heat exchanger in a second embodiment of the present invention. The heat exchanger according to the second embodiment differs from the heat exchanger according to the first embodiment in that a spiral spring 101 is provided in a part on the downstream side within a case 8. Thus, a cylindrical flow path 9*a* is formed on the upstream side within the case 8, and a spiral flow path 9*b* is formed on the downstream side within the case 8. The spring 101 functions as a flow velocity conversion mechanism, a flow direction conversion mechanism, a turbulent flow generation mechanism, and an impurity removal mechanism.

The operation and the function of the heat exchanger shown in FIG. 5 will be described below. A water inlet 11 is provided at a position eccentric from a central axis of the case 8 on a side surface of the case 8, as in the first embodiment. Consequently, water flowing into the case 8 from the water inlet 11 flows while swirling in a spiral shape along the cylindrical flow path 9*a* in an upstream region where the spring 101 does not exist, as shown in FIG. 5, so that the state of swirling flow continues.

When water reaches the vicinity of an intermediate point between the water inlet 11 and a water outlet 12, a flow component in the swirling direction is attenuated. When the cylindrical flow path 9*a* continues to the downstream side, there is no flow component in the swirling direction, and there is only a flow component in the axial direction. In the present embodiment, the spiral spring 101 is provided in a portion where the flow component in the swirling direction starts to be attenuated, that is, in a region on the downstream side from the center where the flow velocity is low. Thus, the flow component in the swirling direction is recovered by the spiral flow path 9*b* formed on the downstream side. As a result, the flow velocity is raised on the downstream side.

That is, the spring 101 does not exist on the upstream side within the heat exchanger, so that the flow path cross-sectional area is made larger, as compared with that on the downstream side. As a result, a state where the flow velocity is low occurs on the upstream side. However, the spring 101 exists on the downstream side within the heat exchanger, so that the flow path cross-sectional area is made smaller. As a result, the flow velocity on the downstream side is made higher, as compared with that on the upstream side, so that turbulent flow is generated.

Since the spring 101 on the downstream side functions as a flow velocity conversion mechanism, a flow direction conversion mechanism, a turbulent flow generation mechanism, and an impurity removal mechanism, so that the adhesion of a scale on the downstream side can be prevented or reduced.

Particularly, the temperature of water increases toward the downstream side because heat exchange between the sheathed heater 7 and water is carried out, and the surface temperature of the copper pipe 17 in the sheathed heater 7, together with water, increases toward the downstream side. Thus, the generation of the scale increases toward the downstream side. In the present embodiment, the spring 101 is arranged on the downstream side, so that the adhesion of the scale on the downstream side can be prevented or reduced.

Since the spring 101 is arranged in only a region that is one-half the flow path within the heat exchanger, the pressure loss in the whole heat exchanger can be made smaller, as compared with that in a case where the spring is arranged on the whole space of the flow path. Thus, the exchange efficiency can be further improved.

Although in the present embodiment, the spring 101 is provided in a region on the downstream side from the center, the spring 101 may be provided in a region on the downstream side from a portion on the upstream side of the center, or the spring 101 may be provided so as to be movable depending on situations where the scale adheres.

Furthermore, the pitch of the spring 101 can be freely changed. In a case where tap water to which no scale adheres is used, therefore, the pitch of the spring 101 can be enlarged in order to make the pressure loss smaller. In this case, the copper pipe 17 in the sheathed heater 7 is easy to detach because it is only fixed to the case 8 by being held between O-rings 15. Consequently, the spring 101 is removed from the case 8 so that the pitch of the spring 101 can be easily changed.

Third Embodiment

Figure 6:
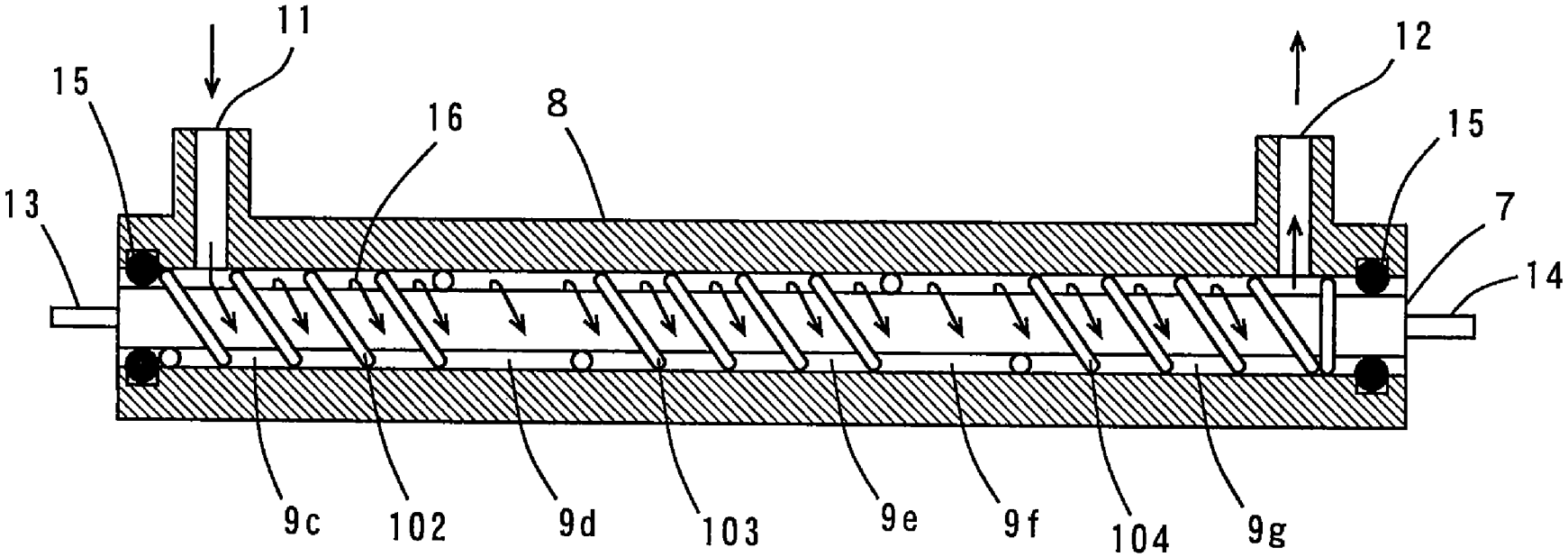
FIG. 6 is a cross-sectional view in the axial direction of a heat exchanger in a third embodiment of the present invention.

FIG. 6 is a cross-sectional view in the axial direction of a heat exchanger in a third embodiment of the present invention. The heat exchanger according to the third embodiment differs from the heat exchanger according to the first embodiment in that a plurality of spiral springs 102, 103, and 104 are intermittently provided within a case 8. Thus, spiral flow paths 9*c*, 9*e*, and 9*g* are intermittently formed within the case 8, and cylindrical flow paths 9*d* and 9*f* are formed there among. The springs 102, 103, and 104 function as a flow velocity conversion mechanism, a flow direction conversion mechanism, a turbulent flow generation mechanism, and an impurity removal mechanism.

The operation and the function of the heat exchanger shown in FIG. 6 will be described below. Water flowing into the case 8 from a water inlet 11 flows while swirling on an outer peripheral surface of a sheathed heater 7, to form swirling flow 16, as shown in FIG. 6. The springs 102, 103, and 104 are intermittently arranged, so that the flow velocity can be raised in a portion where it is lowered.

Swirling flow also continues for a while on the downstream side of the springs 102 and 103, so that the swirling flow 16 is also formed in the cylindrical flow paths 9*d* and 9*f* where no spring exists. A flow component in the swirling direction is recovered again by the springs 103 and 104 arranged in a portion where the flow component in the swirling direction is attenuated. Thus, the flow velocity is raised, so that turbulent flow is generated.

In the sheathed heater 7 using a long copper pipe 17, when a spring is arranged in the whole space of the case 8, the pressure loss within the heat exchanger is increased. In the present embodiment, the plurality of springs 102, 103, and 104 are intermittently arranged, so that the pressure loss within the heat exchanger can be reduced, and the flow velocity can be raised. As a result, the adhesion of the scale can be sufficiently prevented or reduced.

The plurality of springs 102, 103, and 104 are thus intermittently arranged so that at least a part of the flow path within the heat exchanger can be narrowed in a simple configuration. Even in a long heat exchanger, therefore, the adhesion of the scale is prevented or reduced, and it is feasible to increase the life of, increase the efficiency of, and miniaturize the heat exchanger.

Particularly when the flow path within the case 8 has a curve in a U shape, for example, a compact heat exchanger can be realized by arranging a spring in not a U-shaped portion of the flow path but a linear portion of the flow path.

Fourth Embodiment

Figure 7:
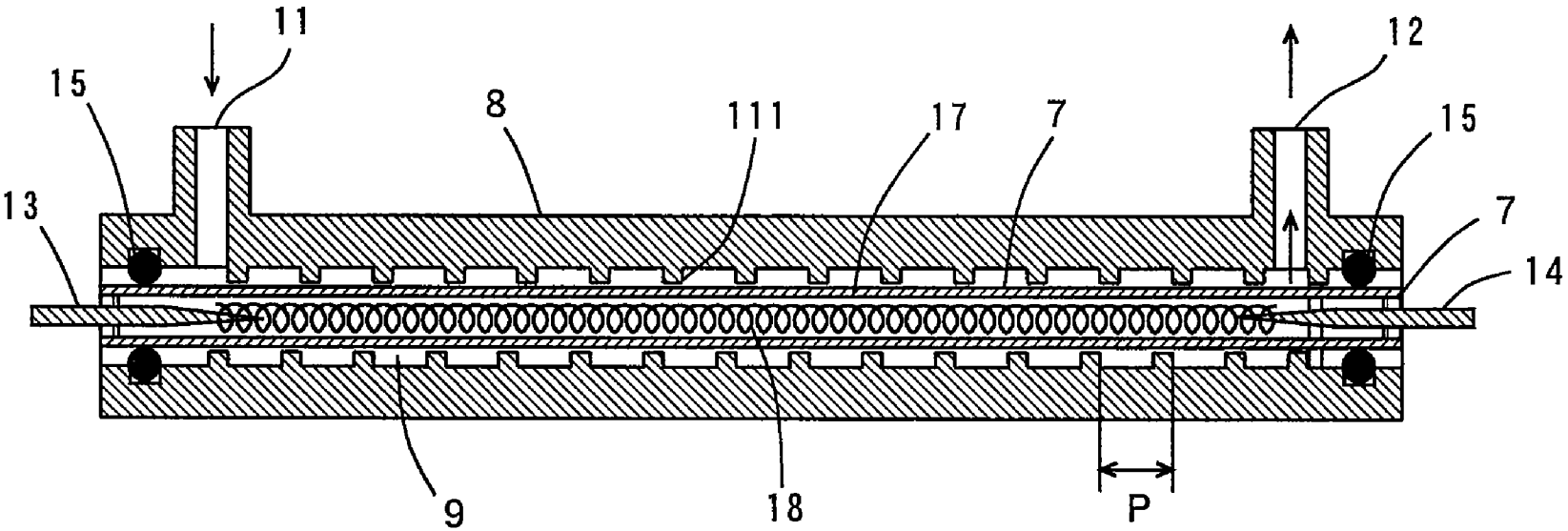
FIG. 7 is a cross-sectional view in the axial direction of a heat exchanger in a fourth embodiment of the present invention.

FIG. 7 is a cross-sectional view in the axial direction of a heat exchanger in a fourth embodiment of the present invention. The heat exchanger according to the fourth embodiment differs from the heat exchanger according to the first embodiment in that a spiral rib (guide) 111 is provided on an inner wall of a case 8 in place of the spiral spring 100. The spiral rib 111 is formed integrally with the case 8 by a resin mold. Thus, a spiral flow path 9 is formed within the case 8. The rib 111 functions as a flow velocity conversion mechanism, a flow direction conversion mechanism, a turbulent flow generation mechanism, and an impurity removal mechanism.

The operation and the function of the heat exchanger shown in FIG. 7 will be described below. A water inlet 11 and a water outlet 12 are respectively provided at positions eccentric from a central axis of the case 8, as in the first embodiment. Consequently, water that has entered from the water inlet 11 flows onto an outer peripheral surface of a copper pipe 17 in a sheathed heater 7, and further flows while swirling in a spiral shape along the spiral rib 111 provided on the inner wall of the case 8 by a centrifugal force, to flow out of the water outlet 12 as warm water. Water thus flows through the spiral flow path 9 so that swirling flow is formed.

In the present embodiment, the direction and the pitch P of the rib 111 are also set such that the flow path cross-sectional area of the spiral flow path 9 is smaller than the flow path cross-sectional area of the cylindrical flow path, as in the first embodiment.

Thus, the swirling flow flowing in a spiral shape along the rib 111 is accelerated, so that the flow velocity of water flowing through the spiral flow path 9 is higher, as compared with that in a case where the rib 111 does not exist. Thus, the rib 111 in the present embodiment functions as a flow velocity conversion mechanism that raises the flow velocity of a fluid, and also functions as a flow direction conversion mechanism that converts the direction of flow of the fluid into the swirling direction. The flow velocity of water flowing within the spiral flow path 9 is raised so that turbulent flow is generated. Thus, the rib 111 in the present embodiment also functions as a turbulent flow generation mechanism that generates turbulent flow.

These results cause the adhesion of a scale to be prevented or reduced and makes it feasible to lengthen the life of, increase the efficiency of, and miniaturize the heat exchanger.

Moreover, the necessity of using the spring 100 serving as a separate member, as in the first embodiment, is eliminated, and the spiral rib 111 can be integrally formed on the inner wall of the case 8, so that the number of components and the number of assembling steps can be reduced. As a result, the assembling properties of the heat exchanger are improved.

In a case where the heat exchanger according to the present embodiment is used for the sanitary washing apparatus, the flow rate thereof is approximately 100 to 2000 mL per minute. Therefore, it is preferable that the outer diameter of the copper pipe 17 is approximately 3 mm to 20 mm, and the pitch P of the spiral spring 111 is approximately 3 mm to 20 mm. It is preferable that the inner diameter of the case 8 is in a range from 5 mm to 30 mm. Consequently, the swirling flow 16 is accelerated so that the flow velocity is raised, and a turbulent flow state can be generated. In a case where the height of the rib 111 is approximately 0.1 mm to 3 mm, the heat exchanger is superior in processability.

Although in the present embodiment, the pitch P of the rib 111 is constant, the pitch of the rib 111 may be partially narrowed or widened, or the pitch of the rib 111 may be gradually changed, as described in embodiments, described later. In this case, the rib 111 also functions as a flow velocity conversion mechanism, a flow direction conversion mechanism, a turbulent flow generation mechanism, and an impurity removal mechanism, so that the adhesion of the scale can be prevented or reduced.

Furthermore, although in the present embodiment, the rib 111 is provided in the whole of the flow path, the rib 111 may be provided in apart of the flow path, as described in embodiments, described later. In this case, the rib 111 also functions as a flow velocity conversion mechanism, a flow direction conversion mechanism, a turbulent flow generation mechanism, and an impurity removal mechanism, so that the adhesion of the scale can be prevented or reduced.

Although in the present embodiment, the spiral rib 111 is used as a flow velocity conversion mechanism, a flow direction conversion mechanism, a turbulent flow generation mechanism, and an impurity removal mechanism, the present invention is not limited to the same. The flow velocity conversion mechanism, the flow direction conversion mechanism, the turbulent flow generation mechanism, and the impurity removal mechanism may be realized by a member having another shape, for example, a turbulence promotion blade or guide. In such a case, the effect of preventing or reducing the adhesion of the scale is also obtained.

Although in the present embodiment, the rib 111 is formed integrally with the case 8, the rib may be formed of a member separate from the case 8 to adhere to the inner wall of the case 8, provided that the rib functions as a flow velocity conversion mechanism, a flow direction conversion mechanism, a turbulent flow generation mechanism, and an impurity removal mechanism in contact with the inner wall of the case 8.

Fifth Embodiment

Figure 8:
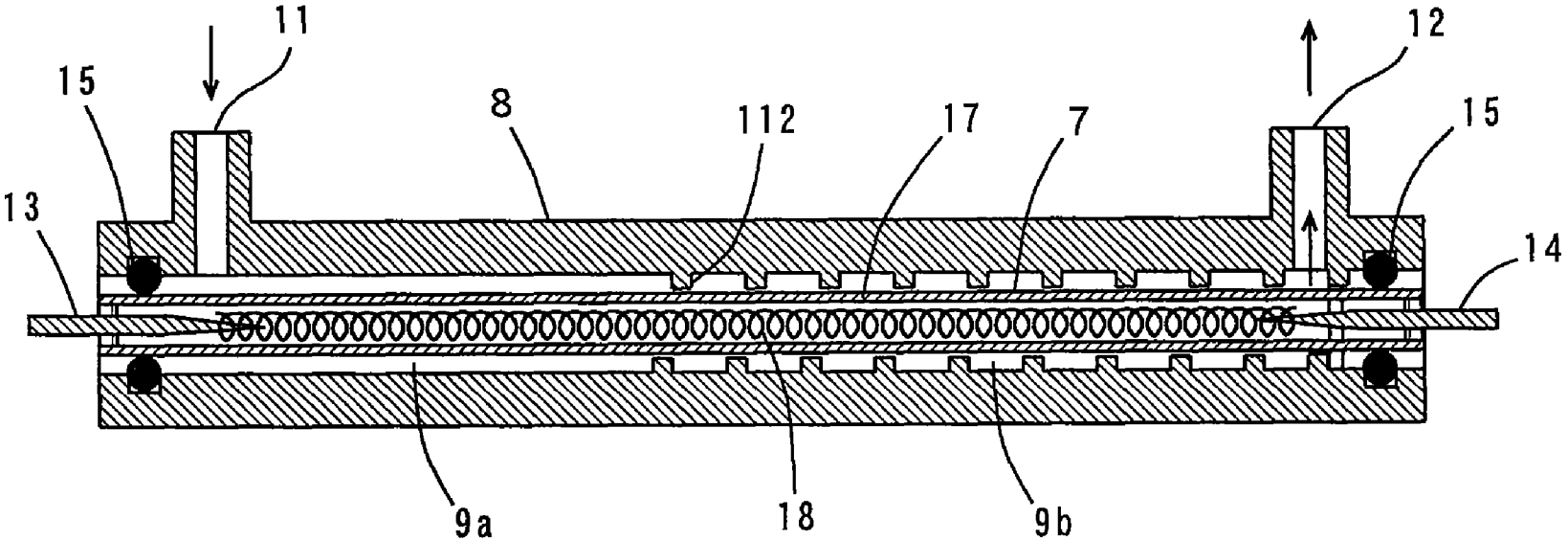
FIG. 8 is a cross-sectional view in the axial direction of a heat exchanger in a fifth embodiment of the present invention.

FIG. 8 is a cross-sectional view in the axial direction of a heat exchanger in a fifth embodiment of the present invention. The heat exchanger according to the fifth embodiment differs from the heat exchanger according to the second embodiment in that a spiral rib (guide) 112 is provided on an inner wall on the downstream side of a case 8 in place of the spiral spring 101. The spiral rib 112 is formed integrally with the case 8 by a resin mold. Thus, a cylindrical flow path 9*a* is formed on the upstream side within the case 8, and a spiral flow path 9*b* is formed on the downstream side within the case 8. The rib 112 functions as a flow velocity conversion mechanism, a flow direction conversion mechanism, a turbulent flow generation mechanism, and an impurity removal mechanism.

The operation and the function of the heat exchanger shown in FIG. 8 are the same as those of the heat exchanger shown in FIG. 5. In the heat exchanger according to the present embodiment, the spiral rib 112 is arranged on the downstream side, so that the flow path cross-sectional area on the downstream side is reduced. Thus, the flow velocity can be raised by the spiral flow path 9*b* in a downstream region where a scale easily adheres. In this case, the pressure loss in the flow path can be made smaller, as compared with that in a case where the flow path cross-sectional area in the whole space of the flow path is reduced. As a result, the adhesion of the scale can be effectively prevented or reduced while reducing the whole pressure loss.

Moreover, the number of components and the number of assembling steps can be reduced. As a result, the assembling properties of the heat exchanger are improved.

Sixth Embodiment

Figure 9:
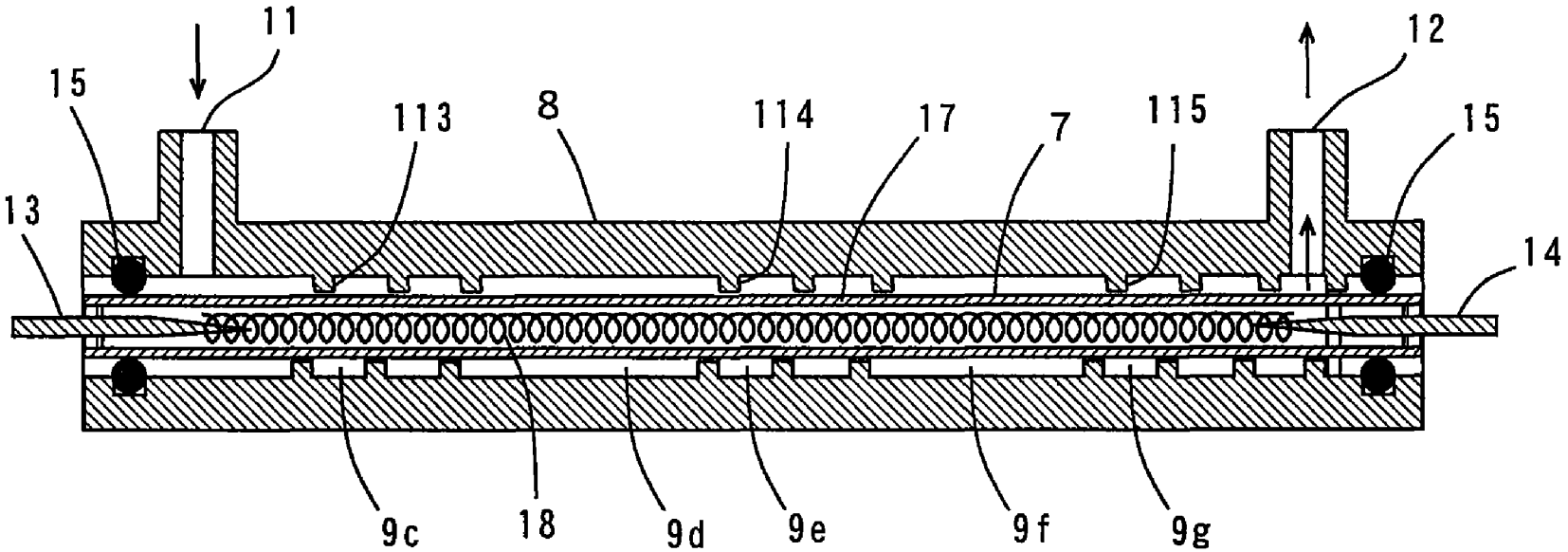
FIG. 9 is a cross-sectional view in the axial direction of a heat exchanger in a sixth embodiment of the present invention.

FIG. 9 is a cross-sectional view in the axial direction of a heat exchanger in a sixth embodiment of the present invention. The heat exchanger according to the sixth embodiment differs from the heat exchanger according to the third embodiment in that a plurality of spiral ribs (guides) 113, 114, and 115 are intermittently provided on an inner wall of a case 8 in place of the plurality of spiral springs 102, 103, and 104. The plurality of spiral ribs 113, 114, and 115 are formed integrally with the case 8 by a resin mold. Thus, spiral flow paths 9*c*, 9*e*, and 9*g* are intermittently formed within the case 8, and cylindrical flow paths 9*d* and 9*f* are formed thereamong. The ribs 113, 114, and 115 function as a flow velocity conversion mechanism, a flow direction conversion mechanism, a turbulent flow generation mechanism, and an impurity removal mechanism.

The operation and the function of the heat exchanger shown in FIG. 9 are the same as those of the heat exchanger shown in FIG. 6. In the heat exchanger according to the present embodiment, the plurality of ribs 113, 114, and 115 are intermittently arranged, so that the flow path cross-sectional area is intermittently reduced. Thus, the flow velocity can be intermittently raised by the plurality of spiral flow paths 9*c*, 9*e*, and 9*g* toward a downward region where a scale easily adheres. In this case, the pressure loss in the flow path can be made smaller, as compared with that in a case where the flow path cross-sectional area in the whole space of the flow path is reduced. As a result, the adhesion of the scale can be effectively prevented or reduced while reducing the whole pressure loss.

Moreover, the number of components and the number of assembling steps can be reduced. As a result, the assembling properties of the heat exchanger are improved.

Seventh Embodiment

Figure 10:
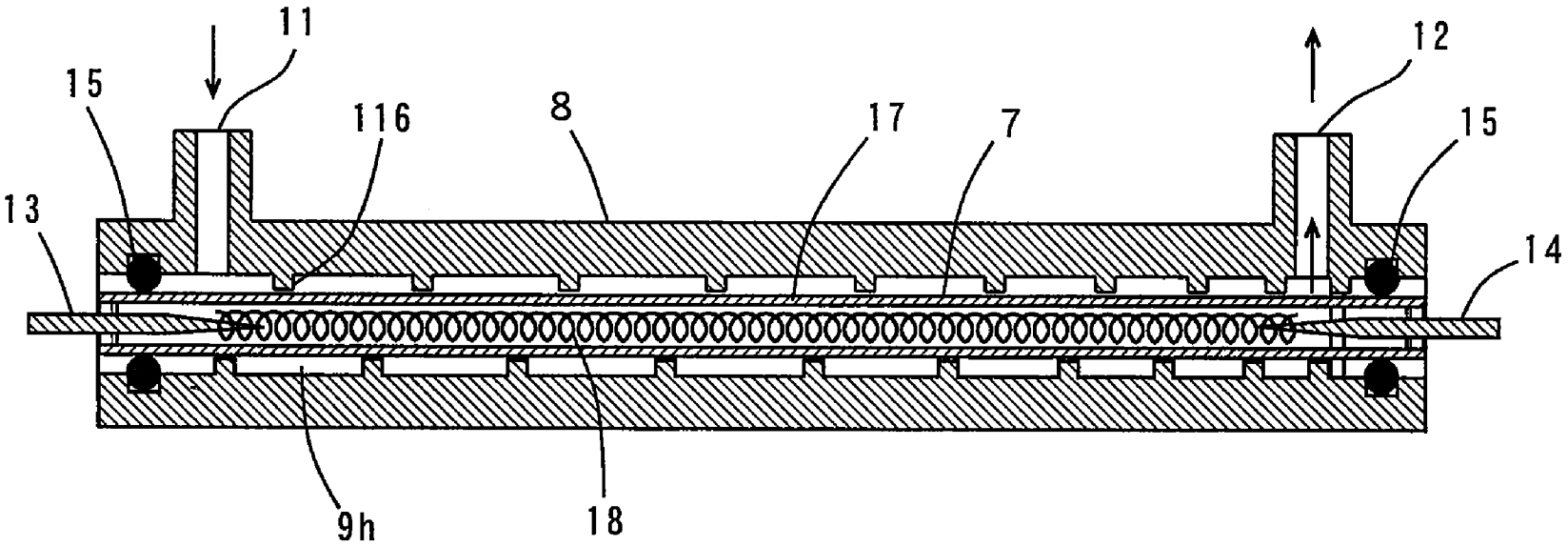
FIG. 10 is a cross-sectional view in the axial direction of a heat exchanger in a seventh embodiment of the present invention.

FIG. 10 is a cross-sectional view in the axial direction of a heat exchanger in a seventh embodiment of the present invention. The heat exchanger according to the seventh embodiment differs from the heat exchanger according to the fourth embodiment in that a spiral rib (guide) 116 having a pitch that continuously decreases from the upstream side to the downstream side is provided on an inner wall of a case 8 in place of the spiral rib 111 having an equal pitch P. The spiral rib 116 is formed integrally with the case 8 by a resin mold. Thus, a spiral flow path 9*h* is formed within the case 8. The rib 116 functions as a flow velocity conversion mechanism, a flow direction conversion mechanism, a turbulent flow generation mechanism, and an impurity removal mechanism.

In the heat exchanger according to the present embodiment, the pitch of the spiral rib 116 continuously decrease from the upstream side to the downstream side, as shown in FIG. 10, so that the flow path cross-sectional area of the spiral flow path 9*h* formed within the case 8 gradually decreases from the upstream side to the downstream side. Thus, the flow velocity can be continuously raised by the spiral flow path 9*h* toward a downstream region where a scale easily adheres. In this case, the pressure loss in the flow path can be made smaller, as compared with that in a case where the flow path cross-sectional area in the whole space of the flow path is reduced. As a result, the adhesion of the scale can be effectively prevented or reduced while reducing the whole pressure loss.

Moreover, the number of components and the number of assembling steps can be reduced. As a result, the assembling properties of the heat exchanger are improved.

Although in the present embodiment, the pitch of the spiral rib 116 continuously decreases from the upstream side to the downstream side so that the flow path cross-sectional area gradually decreases from the upstream side to the downstream side, the spiral rib 116 may not be provided on the inner wall of the case 8, and the cylindrical inner wall of the case 8 may be provided with a taper such that the diameter of the cylindrical inner wall of the case 8 gradually decreases from the upstream side to the downstream side. In this case, the flow path cross-sectional area can be also gradually reduced from the upstream side to the downstream side. Thus, the flow velocity can continuously increase toward the downstream region where the scale easily adheres, so that the adhesion of the scale can be prevented or reduced.

Eighth Embodiment

Figure 11:
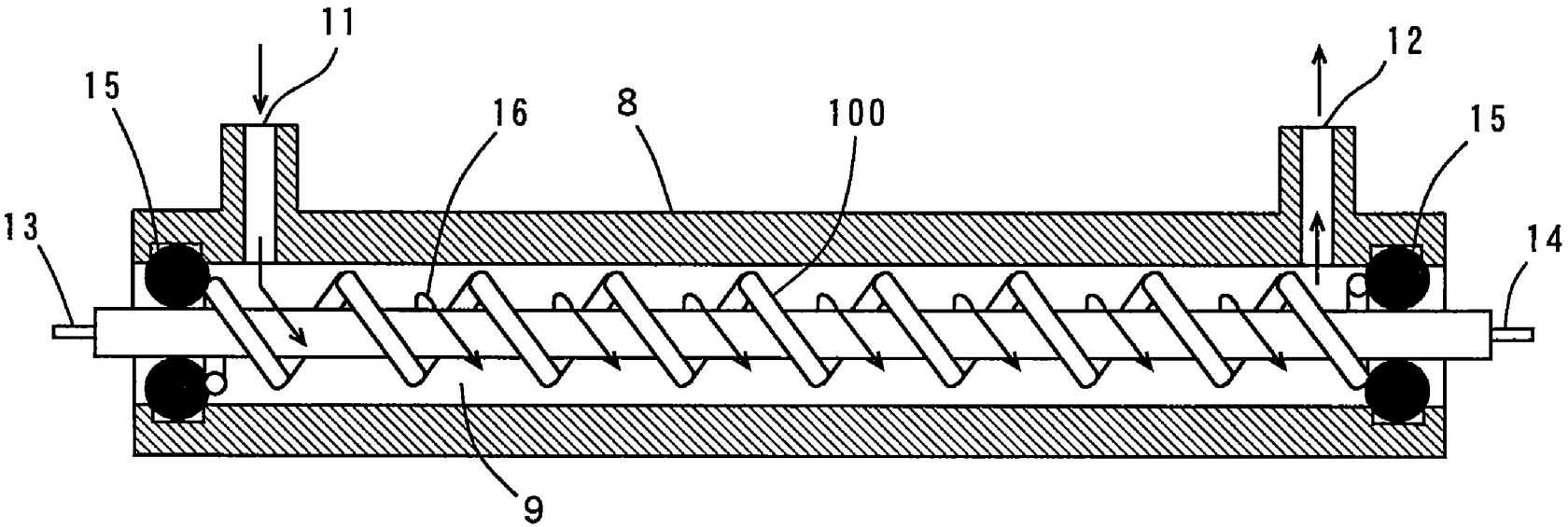
FIG. 11 is a cross-sectional view in the axial direction of a heat exchanger in an eighth embodiment of the present invention.
Figure 12:
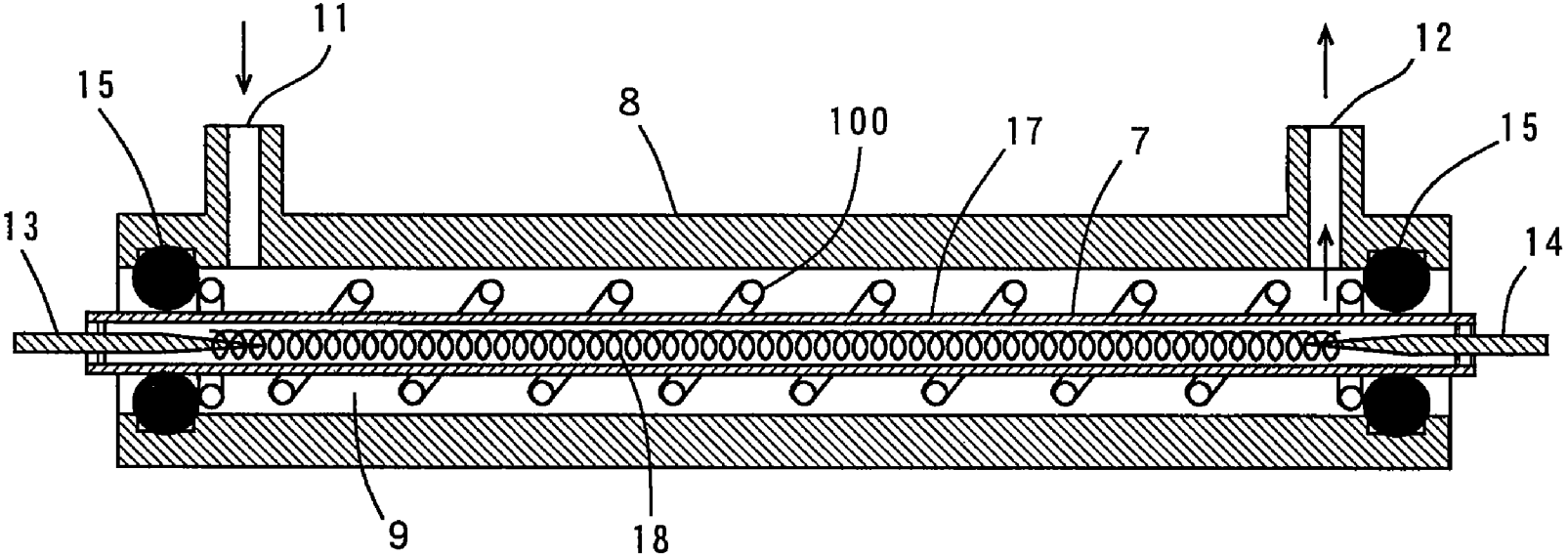
FIG. 12 is a cross-sectional view in the axial direction of the heat exchanger in the eighth embodiment of the present invention.

FIGS. 11 and 12 are cross-sectional views in the axial direction of a heat exchanger in an eighth embodiment of the present invention, where FIG. 11 illustrates a cross section of a case and a side surface of a sheathed heater, and FIG. 12 illustrates respective cross sections of the case and the sheathed heater.

The heat exchanger according to the eighth embodiment differs from the heat exchanger according to the first embodiment in that a spiral spring 100 is provided so as not to come into direct contact with an outer peripheral surface of a sheathed heater 7 and an inner peripheral surface of a case 8. In this case, a spiral flow path 9 is also formed within the case 8. The spring 100 functions as a flow velocity conversion mechanism, a flow direction conversion mechanism, a turbulent flow generation mechanism, and an impurity removal mechanism.

The operation and the function of the heat exchanger shown in FIGS. 11 and 12 are the same as those of the heat exchanger shown in FIGS. 1 and 2. In the present embodiment, the direction and the pitch P of the spring 100 are set such that the flow path cross-sectional area of the spiral flow path 9 is smaller than the flow path cross-sectional area of a cylindrical flow path, as in the first embodiment. Thus, swirling flow 16 flowing in a spiral shape along the spring 100 is accelerated, so that the flow velocity of water flowing in the spiral flow path 9 is higher, as compared with that in a case where the spring 100 does not exist. As a result, in the heat exchanger according to the present embodiment, the same effect as that in the first embodiment is obtained.

In the heat exchanger according to the present embodiment, a clearance is provided between the spring 100 and an outer peripheral surface of the sheathed heater 7, so that the spring 100 does not come into direct contact with the sheathed heater 7. Thus, heat generated by the sheathed heater 7 is not easily transmitted to the spring 100. Therefore, thermal damage to the spring 100 is prevented, so that the life of the spring 100 is lengthened. A material having a low heat-resistant temperature, for example, resin can be used as a material for the spring 100. Thus, the spring 100 can be produced by a material that is easy to process and is lightweight. Consequently, the heat exchanger can be made lightweight.

In the whole range of the case 8, a clearance need not be provided between the spring 100 and the outer peripheral surface of the sheathed heater 7, for example, the spring 100 and the sheathed heater 7 may come into partial contact with each other. In the case, however, it is preferable that the spring 100 is formed of a nonmetal or the same metal as a metal for a sheath of the sheathed heater 7 in order to prevent the spring 100 from corroding.

Since a clearance is provided between the spring 100 and an inner peripheral surface of the case 8, the spring 100 does not come into direct contact with the case 8. Thus, heat generated by the sheathed heater 7 is not easily transmitted to the case 8 through the spring 100. Therefore, thermal damage to the spring 8 is prevented, so that the life of the spring 8 is lengthened.

Furthermore, water attempts to flow along an inner wall of the case 8 by a centrifugal force, so that a stripped scale flows along the inner wall of the case 8 in the clearance between the spring 100 and the case 8. Thus, the scale is prevented from being caught in the spring 10 and deposited on a surface of a copper pipe 17 in the sheathed heater 7 again. As a result, the life of the heat exchanger is lengthened.

A clearance need not be provided between the spring 100 and the inner peripheral surface of the case 8 in the whole range of the case 8. For example, the spring 100 and the inner peripheral surface of the case 8 may come into partial contact with each other.

Furthermore, in a case where clearances are respectively provided between the spring 100 and the sheathed heater 7 and between the spring 100 and the case 8, the spring 100 is easily attached and detached to and from the heat exchanger, resulting in improved assembling properties.

Ninth Embodiment

Figure 13:
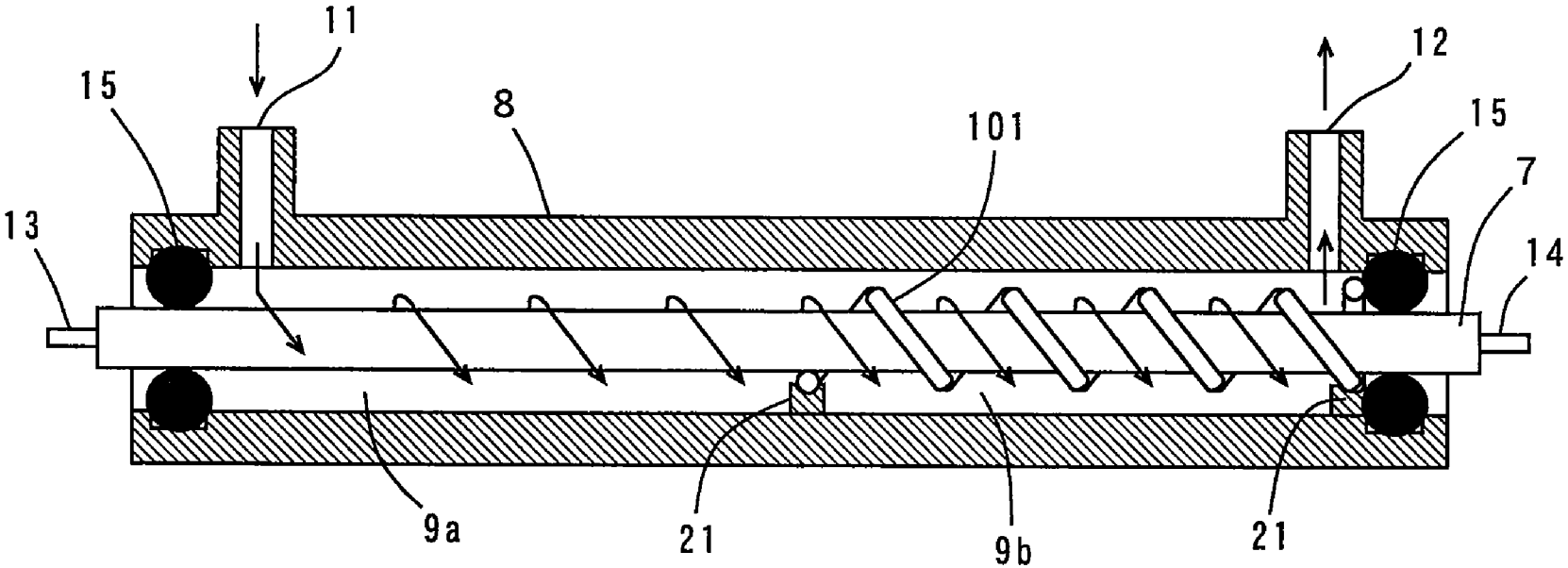
FIG. 13 is a cross-sectional view in the axial direction of a heat exchanger in a ninth embodiment of the present invention.

FIG. 13 is a cross-sectional view in the axial direction of a heat exchanger in a ninth embodiment of the present invention. The heat exchanger according to the ninth embodiment differs from the heat exchanger according to the second embodiment in that a spiral spring 101 is provided so as not to come into direct contact with an outer peripheral surface of a sheathed heater 7 and an inner peripheral surface of a case 8 and in that a spring supporting stand 21 for supporting the spring 101 such that an end of the spring 101 does not come into contact with the inner peripheral surface of the case 8. Also in this case, a cylindrical flow path 9*a* is formed on the upstream side within the case 8, and a spiral flow path 9*b* is also formed on the downstream side within the case 8. The spring 101 functions as a flow velocity conversion mechanism, a flow direction conversion mechanism, a turbulent flow generation mechanism, and an impurity removal mechanism.

The operation and the function of the heat exchanger shown in FIG. 13 are the same as those of the heat exchanger shown in FIG. 5. In the present embodiment, the spiral spring 101 is also arranged on the downstream side, so that the flow path cross-sectional area on the downstream side is reduced, as in the second embodiment. Thus, the flow velocity can be raised by the spiral flow path 9*b* in a downstream region where a scale easily adheres. In this case, the pressure loss in the flow path can be made smaller, as compared with that in a case where the flow path cross-sectional area in the whole space of the flow path is reduced. As a result, in the heat exchanger according to the present embodiment, the same effect as that in the second embodiment is obtained.

In the heat exchanger according to the present embodiment, clearances are respectively provided between the spring 101 and the outer peripheral surface of the sheathed heater 7 and between the spring 101 and the inner peripheral surface of the case 8. Therefore, it is possible to lengthen the life of the heat exchanger and make the heat exchanger lightweight.

Furthermore, the spring 101 can be easily moved depending on situations where the scale adheres by providing the spring supporting stand 21 so as to be slidable or providing a plurality of spring supporting stands 21.

Tenth Embodiment

Figure 14:
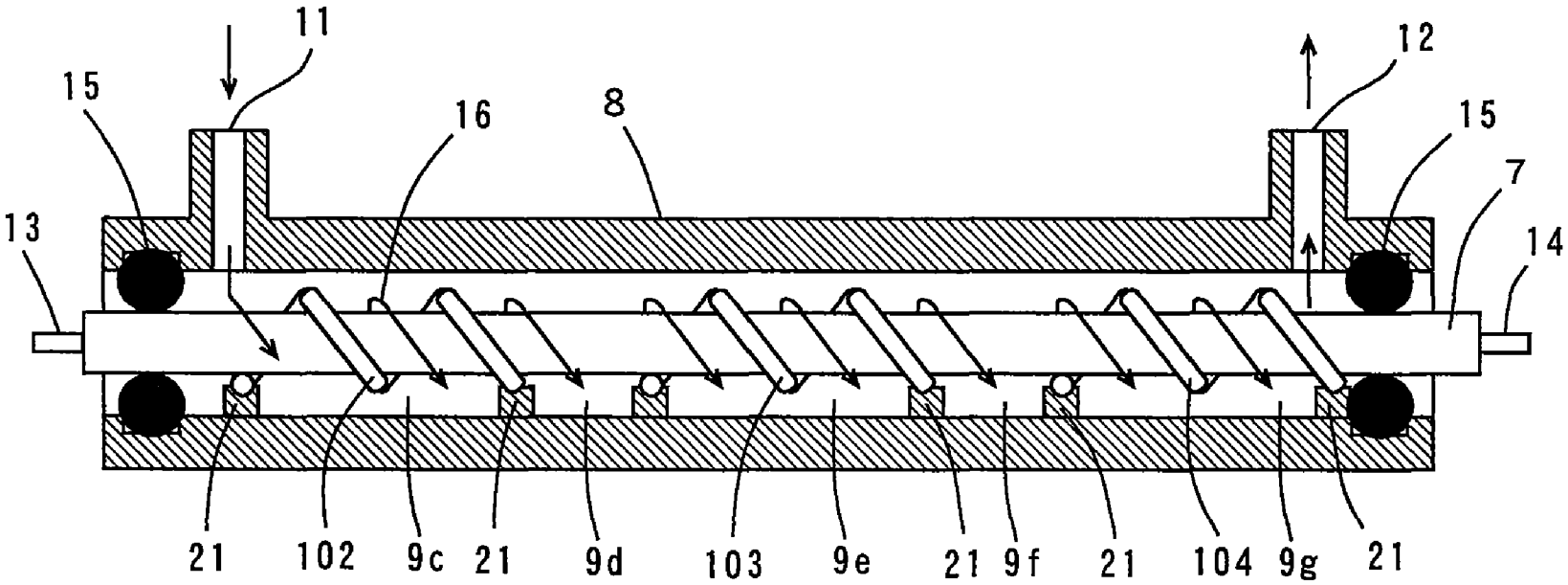
FIG. 14 is a cross-sectional view in the axial direction of a heat exchanger in a tenth embodiment of the present invention.

FIG. 14 is a cross-sectional view in the axial direction of a heat exchanger in a tenth embodiment of the present invention. The heat exchanger according to the tenth embodiment differs from the heat exchanger according to the third embodiment in that a plurality of spiral springs 102, 103, and 104 are provided so as not to come into direct contact with an outer peripheral surface of a sheathed heater 7 and an inner peripheral surface of a case 8 and in that a plurality of spring supporting stands 21 for supporting the springs 102, 103, and 104 such that respective ends of the springs 102, 103, and 104 do not come into contact with the inner peripheral surface of the case 8. Also in this case, spiral flow paths 9*c*, 9*e*, and 9*g* are intermittently formed within the case 8, and cylindrical flow paths 9*d* and 9*f* are formed thereamong. The springs 102, 103, and 104 function as a flow velocity conversion mechanism, a flow direction conversion mechanism, a turbulent flow generation mechanism, and an impurity removal mechanism.

The operation and the function of the heat exchanger shown in FIG. 14 are the same as those of the heat exchanger shown in FIG. 6. In the present embodiment, the plurality of spiral springs 102, 103, and 104 are also intermittently arranged, so that the flow path cross-sectional area is intermittently reduced, as in the third embodiment. Thus, the flow velocity can be intermittently raised by the plurality of spiral flow paths 9*c*, 9*e*, and 9*g* toward a downstream region where a scale easily adheres. In this case, the pressure loss in the flow path can be made smaller, as compared with that in a case where the flow path cross-sectional area in the whole space of the flow path is reduced. As a result, in the heat exchanger according to the present embodiment, the same effect as that in the heat exchanger according to the third embodiment is obtained.

In the heat exchanger according to the present embodiment, clearances are respectively provided between the springs 102, 103, and 104 and the outer peripheral surface of the sheathed heater 7 and between the springs 102, 103, and 104 and the inner peripheral surface of the case 8. Therefore, it is possible to lengthen the life of the heat exchanger and make the heat exchanger lightweight.

Eleventh Embodiment

Figure 15:
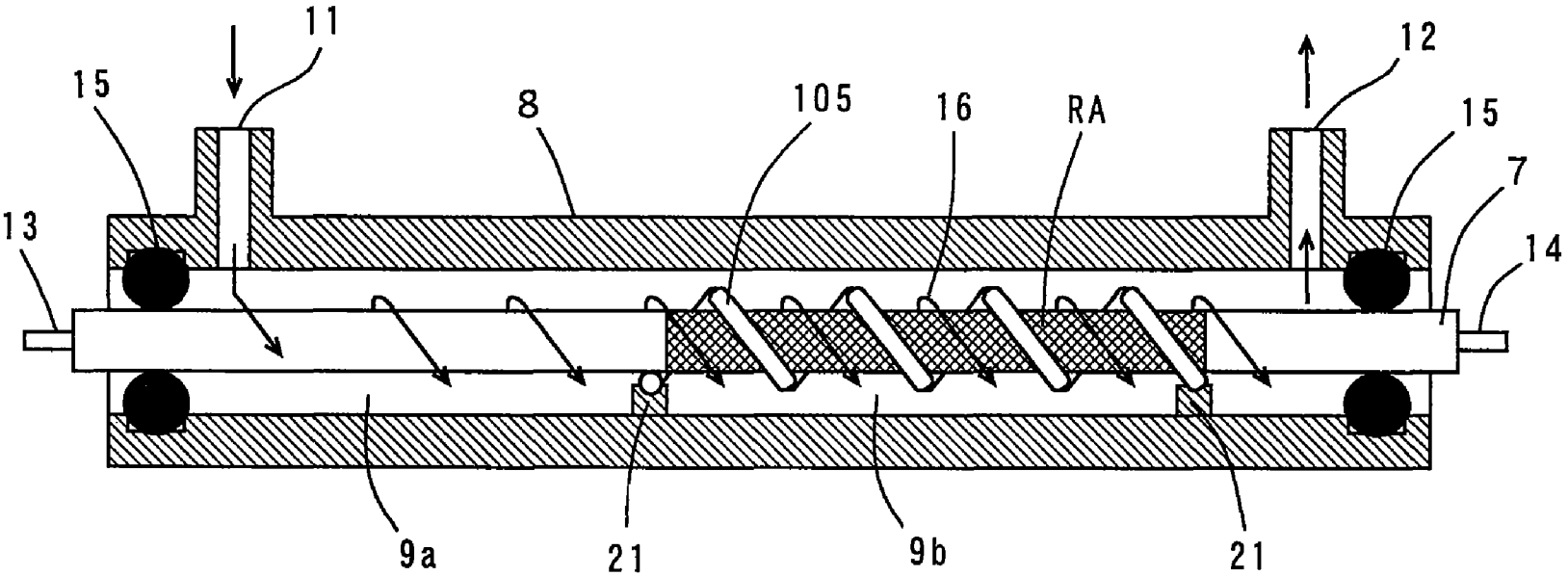
FIG. 15 is a cross-sectional view in the axial direction of a heat exchanger in an eleventh embodiment of the present invention.

FIG. 15 is a cross-sectional view in the axial direction of a heat exchanger in an eleventh embodiment of the present invention. The heat exchanger according to the eleventh embodiment differs from the heat exchanger according to the ninth embodiment in that a spiral spring 105 is provided in a region RA where the surface temperature of a copper pipe 17 in a sheathed heater 7 becomes not less than a predetermined temperature. The region RA is a region centered on the slightly downward side from the center of the copper pipe 17. In this case, a spiral flow path 9*b* is formed around the region RA where the surface temperature of the copper pipe 17 within a case 8 becomes not less than a predetermined temperature, and a cylindrical flow path 9*a* is formed around the other region. The spring 105 functions as a flow velocity conversion mechanism, a flow direction conversion mechanism, a turbulent flow generation mechanism, and an impurity removal mechanism.

The operation and the function of the heat exchanger shown in FIG. 15 are the same as those of the heat exchanger shown in FIG. 13 except for the following points. As shown in FIG. 12, a coil-shaped electrically-heated wire 18 within the sheathed heater 7 generates heat so that water is heated. In this case, the electrically-heated wire 18 has the property of the temperature at the center most rising by thermal interference or the like among a plurality of portions. Further, the temperature of water increases toward the downstream side by heat exchange between the copper pipe 17 and water, and the surface temperature of the copper pipe 17, together with water, also increases. Thus, the surface temperature of the copper pipe 17 in the region RA centered on the slightly downstream side from the center of the sheathed heater 7 is made higher than those in the other portions, as shown in FIG. 15. As a result, the amount of adhesion of a scale in the region RA is increased.

In the present embodiment, the spring 105 is provided in the region RA where the surface temperature of the copper pipe 17 is not less than a predetermined temperature. Thus, the flow velocity of water in the region RA can be raised, so that the surface temperature of the copper pipe 17 is prevented from rising, and the amount of adhesion of the scale can be reduced.

The predetermined temperature is preferably 60° C., and is more preferably 45° C. The reason for this is that when the temperature of water including scale components exceeds approximately 60° C., the amount of adhesion of the scale is liable to be rapidly increased.

Furthermore, in the heat exchanger according to the present embodiment, the spring 105 is also arranged in only a partial region of the flow path, as in the heat exchanger according to the ninth embodiment, so that the pressure loss becomes smaller, as compared with that in a case where the spring is arranged in the whole space of the flow path. This results in improved heat exchange efficiency.

Twelfth Embodiment

Figure 16:
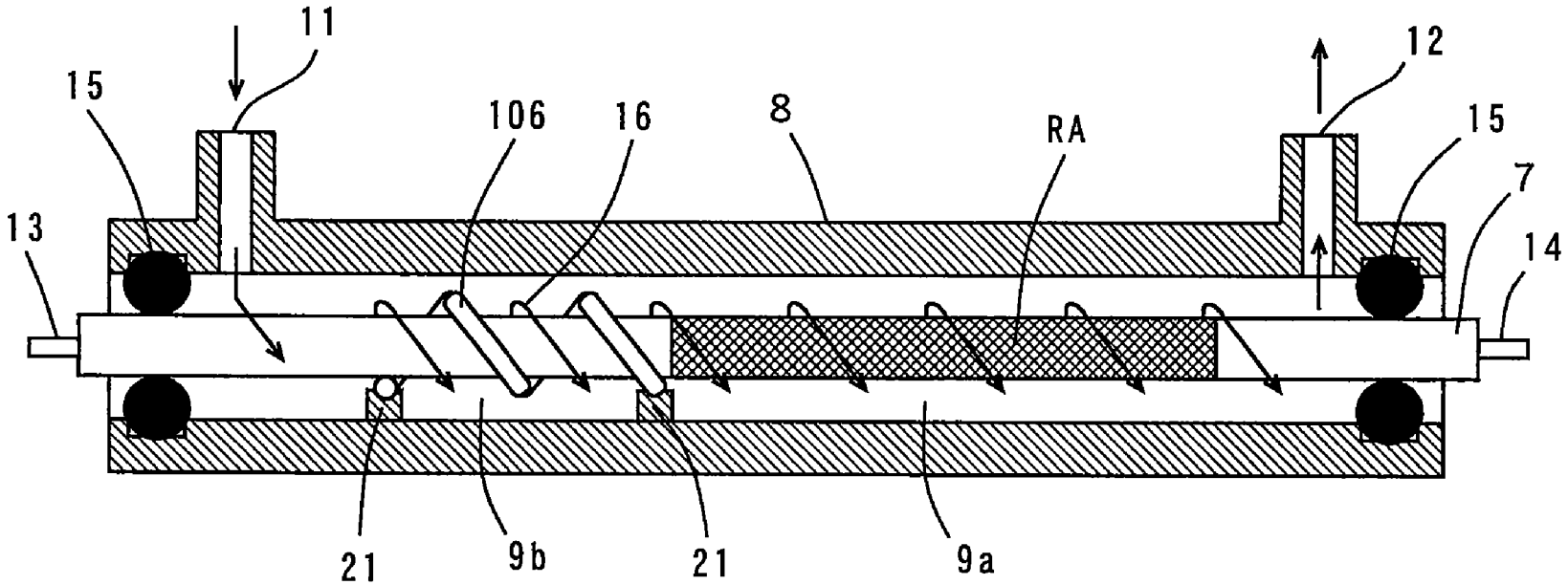
FIG. 16 is a cross-sectional view in the axial direction of a heat exchanger in a twelfth embodiment of the present invention.

FIG. 16 is a cross-sectional view in the axial direction of a heat exchanger in a twelfth embodiment of the present invention. The heat exchanger according to the twelfth embodiment differs from the heat exchanger according to the eleventh embodiment in that a spiral spring 106 is provided in the vicinity of and on the upstream side of a region RA where the surface temperature of a copper pipe 17 in a sheathed heater 7 becomes not less than a predetermined temperature. The region RA is a region centered on the slightly downward side from the center of the copper pipe 17. In this case, a cylindrical flow path 9*a* is formed around the region RA where the surface temperature of the copper pipe 17 within a case 8 becomes not less than the predetermined temperature, and a spiral flow path 9*b* is formed in the vicinity of and on the upstream side of the region RA. The spring 106 functions as a flow velocity conversion mechanism, a flow direction conversion mechanism, a turbulent flow generation mechanism, and an impurity removal mechanism.

The operation and the function of the heat exchanger shown in FIG. 16 are the same as those of the heat exchanger shown in FIG. 15 except for the following points. In the heat exchanger according to the present embodiment, a spring 106 is provided in the vicinity of and on the upstream side of the region RA where the surface temperature of the copper pipe 17 is not less than the predetermined temperature, as shown in FIG. 16. That is, the spring 106 is arranged at a position where the surface temperature of the copper pipe 17 is low. Even when the spring 106 is made of a material having low heat resistance, therefore, the spring 106 is not damaged and degraded by heat.

In this case, swirling flow 16 caused by the spring 106 also continues for a while in the downstream of the spring 106, so that the swirling flow 16 is also formed around the region RA where the spring 106 does not exist. Thus, the flow velocity of water in the region RA can be raised, so that the surface temperature of the copper pipe 17 is prevented from being raised, and the amount of adhesion of a scale can be reduced.

In the heat exchanger according to the present embodiment, the spring 106 is arranged in only a partial region of the flow path, as in the heat exchanger according to the eleventh embodiment, so that the pressure loss becomes smaller, as compared with that in a case where the spring is arranged in the whole space of the flow path. This results in improved heat exchange efficiency.

Another structure such as a rib (guide) functioning as a flow velocity conversion mechanism, a flow direction conversion mechanism, a turbulent flow generation mechanism, and an impurity removal mechanism may be provided integrally with the case 8 or the sheathed heater 7 in place of the springs 105 and 106 in the eleventh and twelfth embodiments.

Thirteenth Embodiment

Figure 17:
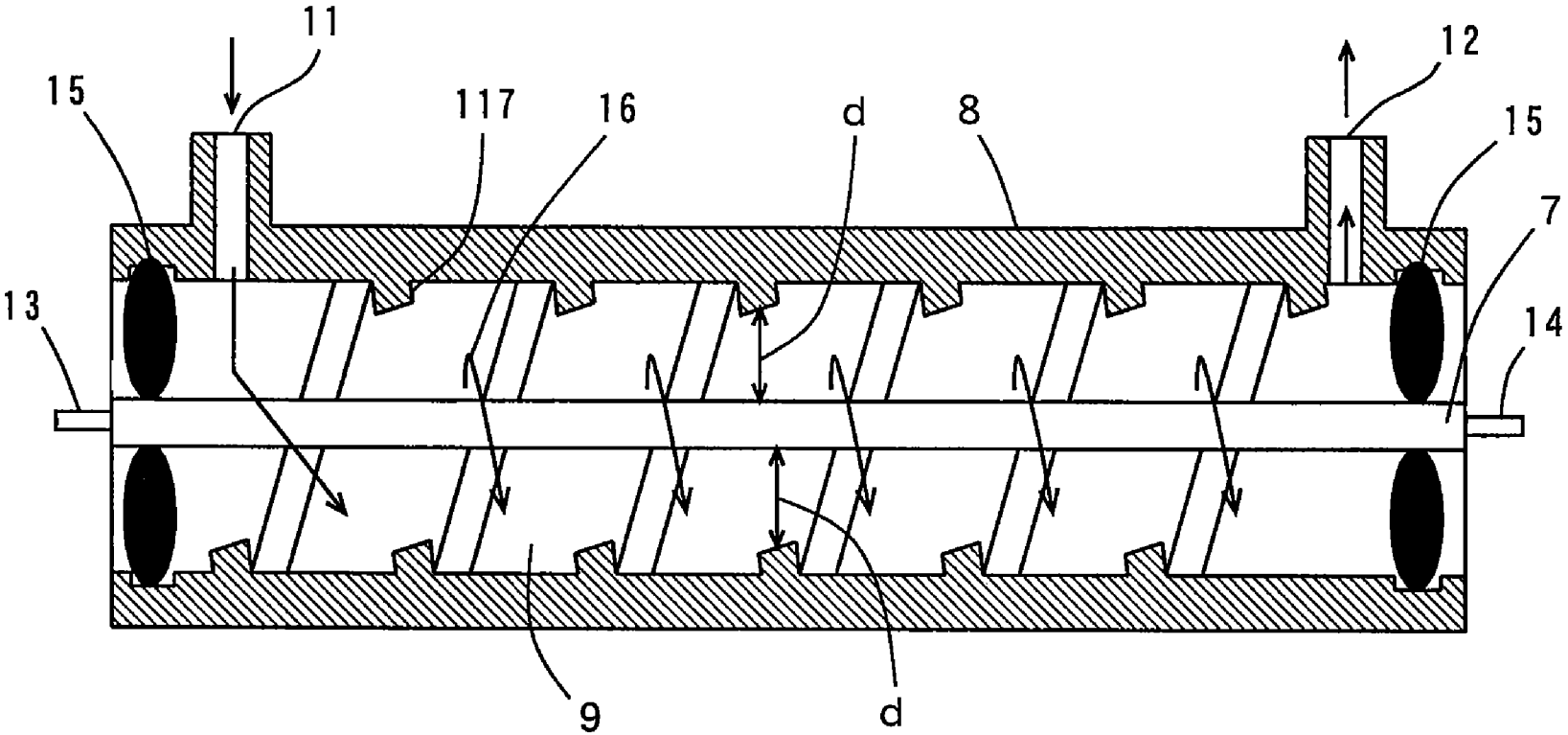
FIG. 17 is a cross-sectional view in the axial direction of a heat exchanger in a thirteenth embodiment of the present invention.
Figure 18:
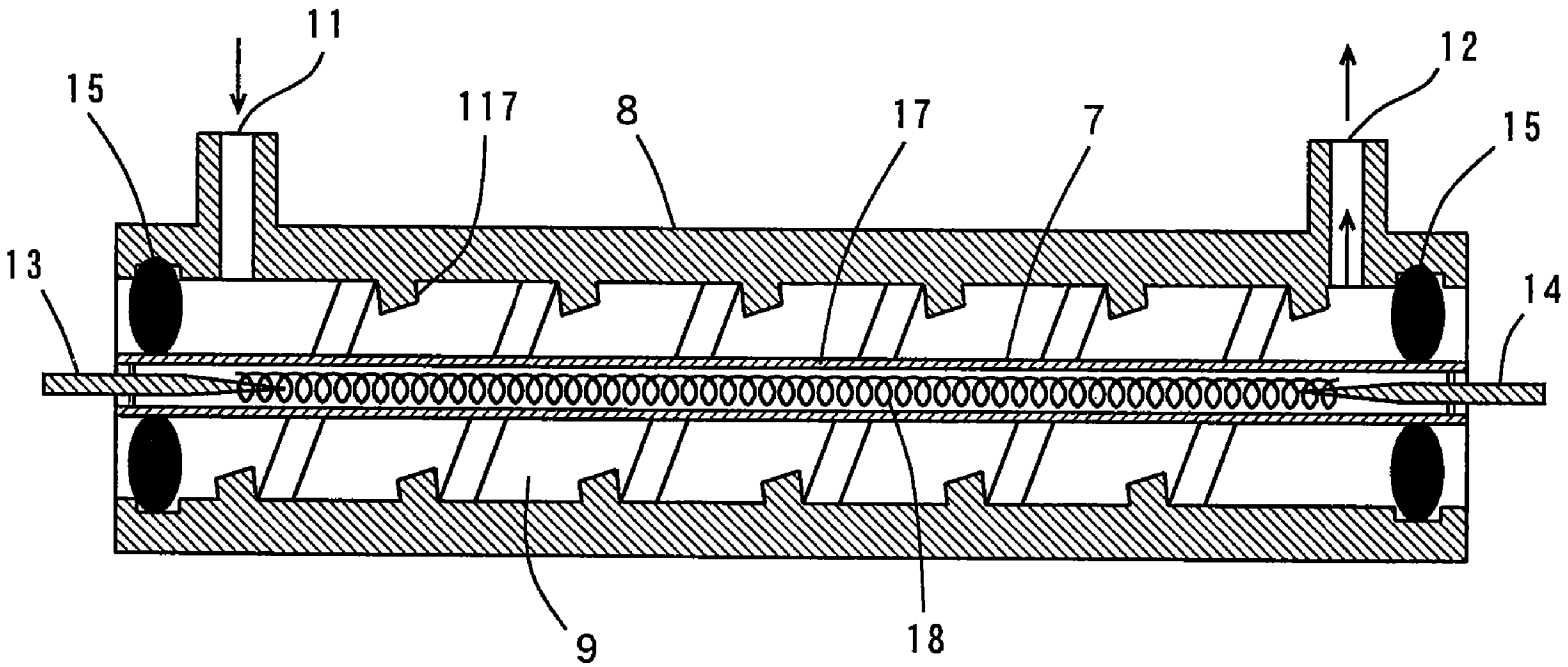
FIG. 18 is a cross-sectional view in the axial direction of the heat exchanger in the thirteenth embodiment of the present invention.

FIGS. 17 and 18 are cross-sectional views in the axial direction of a heat exchanger in a thirteenth embodiment of the present invention, where FIG. 17 illustrates a cross section of a case and a side surface of a sheathed heater, and FIG. 18 illustrates respective cross sections of the case and the sheathed heater.

The heat exchanger according to the thirteenth embodiment differs from the heat exchanger according to the fourth embodiment in that a clearance d is provided between a spiral rib (guide) 117 and an outer peripheral surface of a sheathed heater 7. In this case, a spiral flow path 9 is also formed within a case 8. The rib 117 functions as a flow velocity conversion mechanism, a flow direction conversion mechanism, a turbulent flow generation mechanism, and an impurity removal mechanism.

The operation and the function of the heat exchanger shown in FIGS. 17 and 18 are the same as those of the heat exchanger shown in FIG. 7. In the present embodiment, the direction and the pitch of the rib 117 are set such that the flow path cross-sectional area of the spiral flow path 9 is smaller than the flow path cross-sectional area of a cylindrical flow path, as in the fourth embodiment. Thus, swirling flow 16 flowing in a spiral shape along the rib 117 is accelerated, so that the flow velocity of water flowing in the spiral flow path 9 is higher, as compared with that in a case where the rib 117 does not exist. As a result, in the heat exchanger according to the present embodiment, the same effect as that in the heat exchanger according to the fourth embodiment is obtained.

In the heat exchanger according to the present embodiment, a clearance d is provided between the rib 117 and an outer peripheral surface of the sheathed heater 7, so that the rib 117 does not come into direct contact with the sheathed heater 7. Thus, heat generated by the sheathed heater 7 is not easily transmitted to the rib 117. Therefore, thermal damage to the rib 117 is prevented, so that the life of the rib 117 is lengthened. Further, heat generated by the sheathed heater 7 is not easily transmitted to the case 8 through the rib 117. Therefore, thermal damage to the case 8 is prevented, so that the life of the case 8 is lengthened.

A material having a low heat-resistant temperature, for example, resin can be used as a material for the case 8 and the rib 117. Thus, the case 8 and the rib 117 can be produced by a material that is easy to process and is lightweight. Consequently, the heat exchanger can be made lightweight.

Furthermore, a scale stripped from the sheathed heater 7 can flow along the sheathed heater 7 in the clearance d between the rib 117 and the outer peripheral surface of the sheathed heater 7. Thus, the scale is prevented from being caught in the rib 117 and deposited on a surface of a copper pipe 17 in the sheathed heater 7 again. As a result, the life of the heat exchanger is lengthened.

In the whole range of the case 8, the clearance d need not be provided between the rib 117 and the outer peripheral surface of the sheathed heater 7. For example, the rib 117 and the outer peripheral surface of the sheathed heater 7 may come into partial contact with each other.

Fourteenth Embodiment

Figure 19:
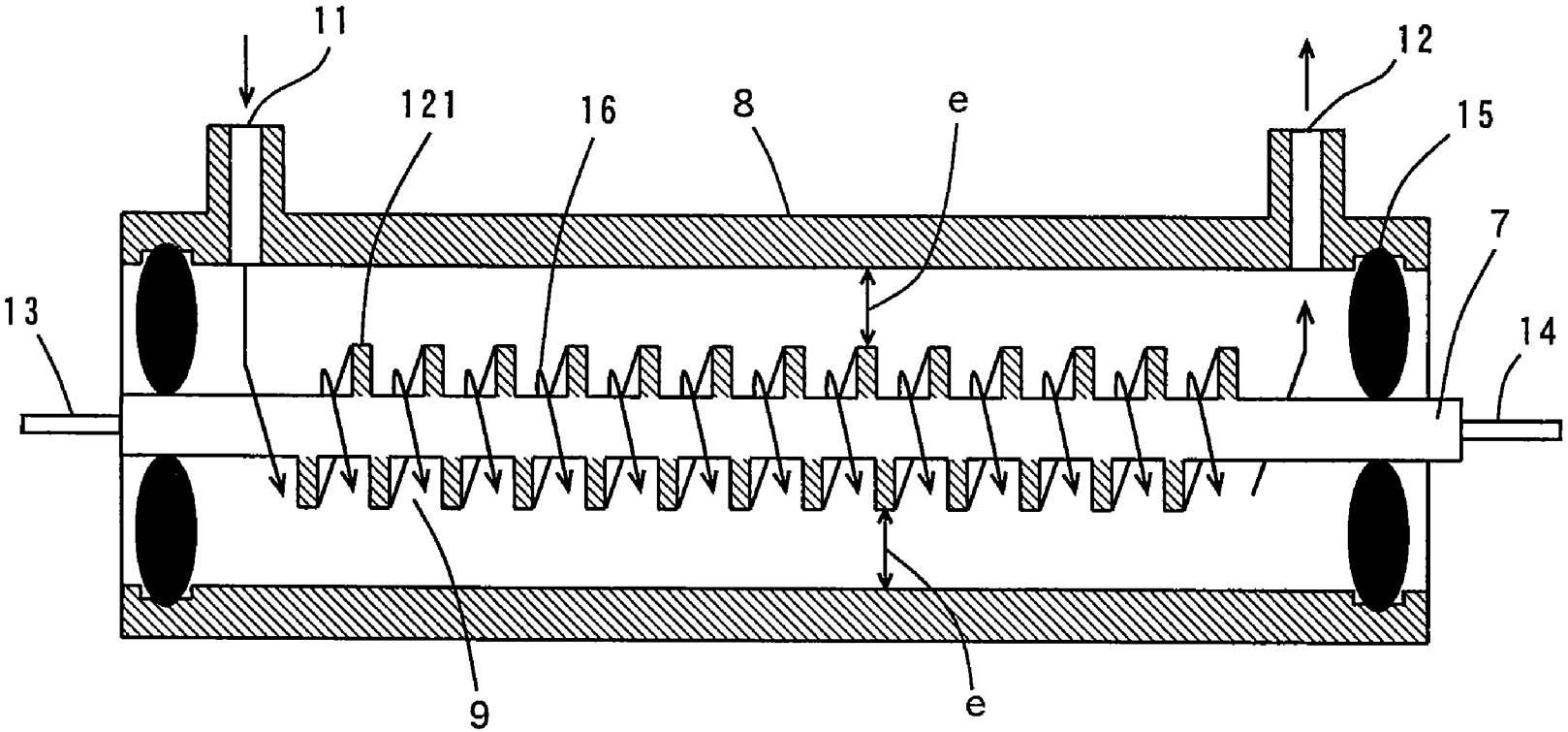
FIG. 19 is a cross-sectional view in the axial direction of a heat exchanger in a fourteenth embodiment of the present invention.

FIG. 19 is a cross-sectional view in the axial direction of a heat exchanger in a fourteenth embodiment of the present invention. The heat exchanger according to the fourteenth embodiment differs from the heat exchanger according to the thirtieth embodiment in that a spiral rib (guide) 121 is integrally provided on an outer peripheral surface of a sheathed heater 7 and a clearance e is provided between the rib 121 and an inner peripheral surface of a case 8. Thus, a spiral flow path 9 is formed with in the case 8. The rib 121 functions as a flow velocity conversion mechanism, a flow direction conversion mechanism, a turbulent flow generation mechanism, and an impurity removal mechanism.

The operation and the function of the heat exchanger shown in FIG. 19 are the same as those of the heat exchanger shown in FIGS. 17 and 18 except for the following points.

In the heat exchanger according to the present embodiment, the rib 121 is provided on the outer peripheral surface of the sheathed heater 7, so that the surface area of the sheathed heater 7 is increased. Thus, the heat radiation properties of the sheathed heater 7 are improved, so that the rise in the surface temperature of the sheathed heater 7 is restrained. As a result, the deposition and adhesion of a scale on a surface of the sheathed heater 7 can be sufficiently prevented or reduced. The watt density of the sheathed heater 7 is lowered, so that it is possible to increase the efficiency of the heat exchanger and lengthen the life thereof. Further, the surface area of the sheathed heater is increased, so that the watt density of the sheathed heater 7 can be also increased. Thus, the responsive properties of the heat exchanger are improved.

Since the sheathed heater 7 and the rib 121 are integrally formed, the assembling properties of the heat exchanger are improved.

Since a clearance e is provided between the rib 121 and an inner peripheral surface of the case 8, the rib 121 does not come into direct contact with the case 8. Thus, heat generated by the sheathed heater 7 is not easily transmitted to the case 8 through the rib 121. Therefore, thermal damage to the case 8 is prevented, so that the life of the case 8 is lengthened.

Furthermore, water attempts to flow along an inner wall of the case 8 by a centrifugal force, so that a stripped scale flows along the inner wall of the case 8 in the clearance between the rib 121 and the case 8. Thus, the scale is prevented from being caught in the rib 121 and deposited on a surface of a copper pipe 17 in the sheathed heater 7 again. As a result, the life of the heat exchanger is lengthened.

A clearance e need not be provided between the rib 121 and the inner peripheral surface of the case 8 in the whole range of the case 8. For example, the rib 121 and the inner peripheral surface of the case 8 may come into partial contact with each other.

Furthermore, although in the present embodiment, the rib 121 is provided in the whole of the flow path, the rib 121 may be provided in a part of the flow path. In this case, the rib 121 also functions as a flow velocity conversion mechanism, a flow direction conversion mechanism, a turbulent flow generation mechanism, and an impurity removal mechanism, so that the adhesion of the scale can be prevented or reduced.

Although in the present embodiment, the spiral rib 121 is used as a flow velocity conversion mechanism, a flow direction conversion mechanism, a turbulent flow generation mechanism, and an impurity removal mechanism, the present invention is not limited to the same. The flow velocity conversion mechanism, the flow direction conversion mechanism, the turbulent flow generation mechanism, and the impurity removal mechanism may be realized by a member having another shape, for example, a turbulence promotion blade or a turbulence promotion guide. In such a case, the effect of preventing or reducing the adhesion of the scale is also obtained.

Although in the present embodiment, the rib 121 is formed integrally with the sheathed heater 7, the rib 121 may be formed of a member separate from the sheathed heater 7 to adhere to the outer peripheral surface of the sheathed heater 7 or be soldered thereto, provided that it functions as a flow velocity conversion mechanism, a flow direction conversion mechanism, a turbulent flow generation mechanism, and an impurity removal mechanism in contact with the outer peripheral surface of the sheathed heater 7.

Fifteenth Embodiment

Figure 20:
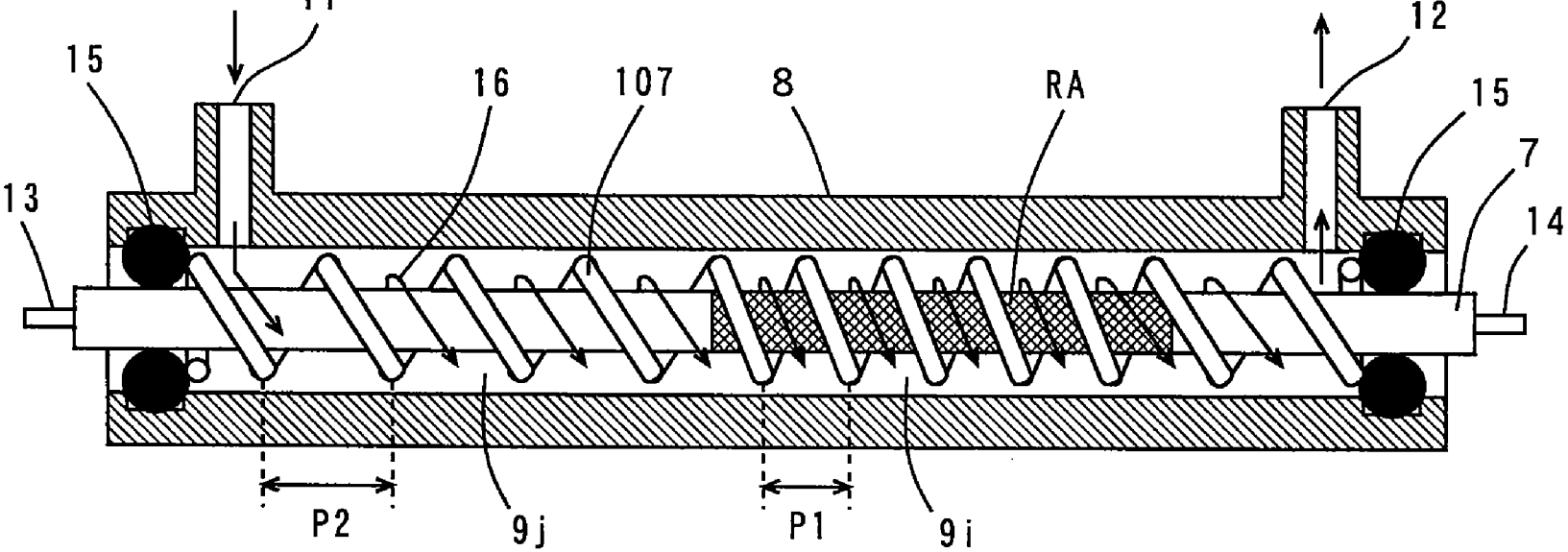
FIG. 20 is a cross-sectional view in the axial direction of a heat exchanger in a fifteenth embodiment of the present invention.

FIG. 20 is a cross-sectional view in the axial direction of a heat exchanger in a fifteenth embodiment of the present invention. The heat exchanger according to the fifteenth embodiment differs from the heat exchanger according to the eighth embodiment in that around a region RA where the surface temperature of a copper pipe 17 in a sheathed heater 7 is not less than a predetermined temperature, the pitch P1 of a spiral spring 107 is set smaller than the pitch P2 around the other region. The region RA is a region centered on the slightly downward side from the center of the copper pipe 17. In this case, spiral flow paths 9*i* and 9*j* are respectively formed around the region RA where the surface temperature of the copper pipe 17 within a case 8 becomes not less than the predetermined temperature and around the other region. The spring 107 functions as a flow velocity conversion mechanism, a flow direction conversion mechanism, a turbulent flow generation mechanism, and an impurity removal mechanism.

The operation and the function of the heat exchanger shown in FIG. 20 are the same as those of the heat exchanger shown in FIGS. 11 and 12 except for the following points. The surface temperature of the copper pipe 17 in the region RA centered on the slightly downstream side from the center of the sheathed heater 7 is made higher than those in the other portions, as described using FIG. 15. As a result, the amount of adhesion of a scale in the region RA is increased.

In the present embodiment, the pitch P1 of the spring 107 around the region RA where the surface temperature of the copper pipe 17 becomes not less than the predetermined temperature is set smaller than the pitch P2 around the other region. Thus, the flow path cross-sectional area of the spiral flow path 9*i* formed around the region RA where the surface temperature is not less than the predetermined temperature is smaller than the flow path cross-sectional area of the spiral flow path 9*j* formed around the other region. As a result, the flow velocity of water in the region RA can be raised. Therefore, the surface temperature of the copper pipe 17 is prevented from being raised, so that the amount of adhesion of the scale can be reduced.

The predetermined temperature is preferably 60° C., and is more preferably 45° C. The reason for this is that when the temperature of water containing scale components exceeds approximately 60° C., the amount of adhesion of the scale is liable to be rapidly increased.

For example, the pitch P2 of the spring 107 is set to 10 mm around a region where the surface temperature of the copper pipe 17 is less than 60° C., and the pitch P1 is set to 6 mm around a region where the surface temperature is not less than 60° C.

In the heat exchanger according to the present embodiment, the pitch P1 of the spring 107 is set small in only a partial region of the flow path, so that the pressure loss becomes smaller, as compared with that in a case where the pitch of the spring is set small in the whole space of the flow path. This results in improved heat exchange efficiency.

Although in the present embodiment, the pitch of the spring 107 is changed in two stages, the pitch of the spring 107 may be changed in three or more stages. For example, the pitch of the spring 107 is set to 10 mm around a region where the surface temperature of the copper pipe 17 is less than 45° C., the pitch is set to 8 mm around a region where the surface temperature is not less than 45° C. and less than 60° C., and the pitch is set to 6 mm around a region where the surface temperature is not less than 60° C.

Another structure such as a rib (guide) functioning as a flow velocity conversion mechanism, a flow direction conversion mechanism, a turbulent flow generation mechanism, and an impurity removal mechanism may be provided integrally with the case 8 or the sheathed heater 7 in place of the spring 107.

Sixteenth Embodiment

Figure 21:
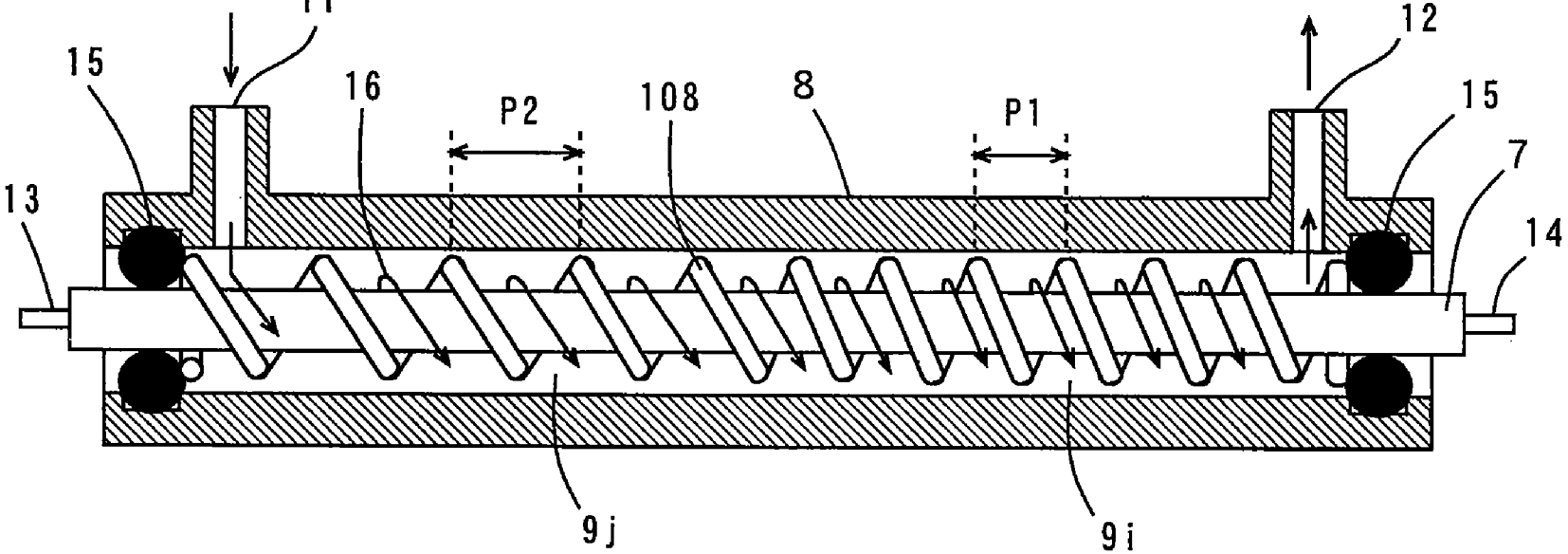
FIG. 21 is a cross-sectional view in the axial direction of a heat exchanger in a sixteenth embodiment of the present invention.

FIG. 21 is a cross-sectional view in the axial direction of a heat exchanger in a sixteenth embodiment of the present invention. The heat exchanger according to the sixteenth embodiment differs from the heat exchanger according to the eighth embodiment in that the pitch P1 of a spiral spring 108 on the downstream side within a case 8 is set smaller, as compared with the pitch P2 on the upstream side. In this case, spiral flow paths 9*i* and 9*j* are respectively formed on the downstream side and the upstream side within the case 8. The spring 108 functions as a flow velocity conversion mechanism, a flow direction conversion mechanism, a turbulent flow generation mechanism, and an impurity removal mechanism.

The operation and the function of the heat exchanger shown in FIG. 21 are the same as those of the heat exchanger shown in FIGS. 11 and 12. As described above, heat exchange between a sheathed heater 7 and water is carried out so that the temperature of water increases toward the downstream side, and the surface temperature of a copper pipe 17 in the sheathed heater 7, together with water, also increases toward the downstream side. Thus, the generation of the scale increases toward the downstream side.

In the present embodiment, the pitch P1 of the spring 108 on the downstream side is set smaller, as compared with the pitch P2 on the upstream side. Thus, the flow path cross-sectional area of the spiral flow path 9*i* on the downstream side is smaller than the flow path cross-sectional area of the spiral flow path 9*j* on the upstream side. As a result, the flow velocity of water on the downstream side can be raised. Therefore, it is possible to prevent the surface temperature of the copper pipe 17 from being raised and to reduce the amount of adhesion of a scale.

In the heat exchanger according to the present embodiment, the pitch P1 of the spring 108 is set small in only a partial region of the flow path, so that the pressure loss becomes smaller, as compared with that in a case where the pitch of the spring is set small in the whole space of the flow path. This results in improved heat exchange efficiency.

Another structure such as a rib (guide) functioning as a flow velocity conversion mechanism, a flow direction conversion mechanism, a turbulent flow generation mechanism, and an impurity removal mechanism may be provided integrally with the case 8 or the sheathed heater 7.

Seventeenth Embodiment

Figure 22:
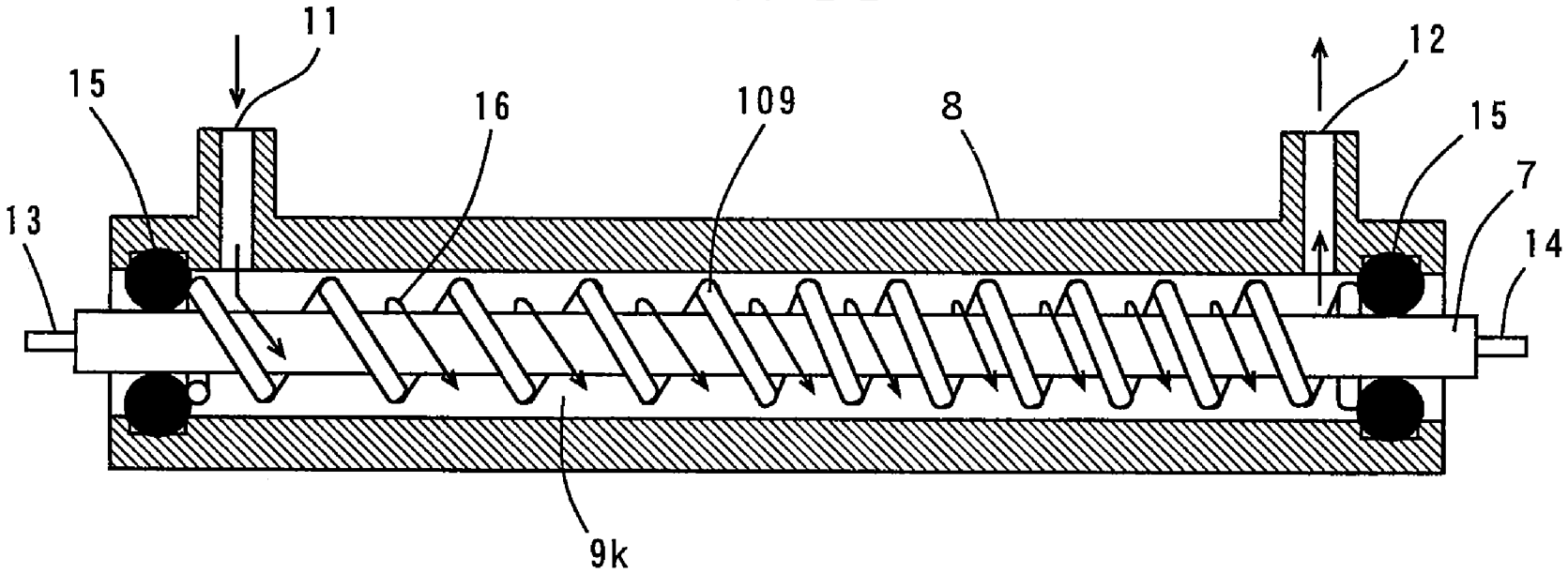
FIG. 22 is a cross-sectional view in the axial direction of a heat exchanger in a seventeenth embodiment of the present invention.

FIG. 22 is a cross-sectional view in the axial direction of a heat exchanger in a seventeenth embodiment of the present invention. The heat exchanger according to the seventeenth embodiment differs from the heat exchanger according to the sixteenth embodiment in that the pitch of a spiral spring 109 continuously decreases from the upstream side to the downstream side within a case 8. In this case, a spiral flow path 9*k* is formed from the upstream side to the downstream side within the case 8. The spring 109 functions as a flow velocity conversion mechanism, a flow direction conversion mechanism, a turbulent flow generation mechanism, and an impurity removal mechanism.

In the present embodiment, the pitch of the spring 109 continuously decreases from the upstream side to the downstream side. Thus, the flow path cross-sectional area of the spiral flow path 9*k* continuously decreases from the upstream side to the downstream side. As a result, the flow velocity of water can be smoothly raised from the upstream side to the downstream side. Therefore, it is possible to prevent the surface temperature of a copper pipe 17 from being raised and to effectively reduce the amount of adhesion of a scale.

In the heat exchanger according to the present embodiment, the pitch of the spring 109 continuously decreases from the upstream side to the downstream side, so that the pressure loss becomes smaller, as compared with that in a case where the pitch of the spring is set small in the whole space of the flow path. This results in improved heat exchange efficiency.

Another structure such as a rib (guide) functioning as a flow velocity conversion mechanism, a flow direction conversion mechanism, a turbulent flow generation mechanism, and an impurity removal mechanism may be provided integrally with the case 8 or a sheathed heater 7 in place of the spring 109.

Eighteenth Embodiment

Figure 23:
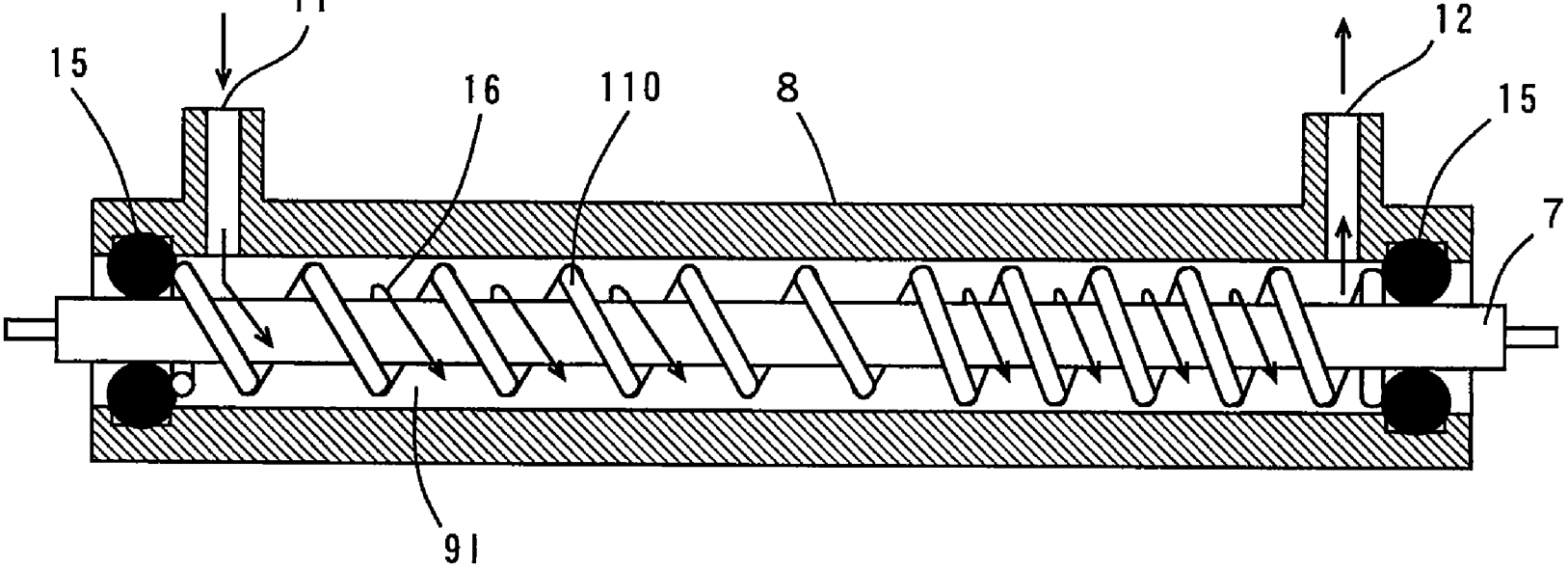
FIG. 23 is a cross-sectional view in the axial direction of a heat exchanger in an eighteenth embodiment of the present invention.

FIG. 23 is a cross-sectional view in the axial direction of a heat exchanger in an eighteenth embodiment of the present invention. The heat exchanger according to the eighteenth embodiment differs from the heat exchanger according to the sixteenth embodiment in that the pitch of a spiral spring 110 gradually decreases from the upstream side to the downstream side within a case 8. In this case, a spiral flow path 91 is formed from the upstream side to the downstream side within the case 8. The spring 110 functions as a flow velocity conversion mechanism, a flow direction conversion mechanism, a turbulent flow generation mechanism, and an impurity removal mechanism.

In the present embodiment, the pitch of the spring 110 gradually decreases from the upstream side to the downstream side. Thus, the flow path cross-sectional area of the spiral flow path 91 gradually decreases from the upstream side to the downstream side. As a result, the flow velocity of water can be gradually raised from the upstream side to the downstream side. Therefore, it is possible to prevent the surface temperature of a copper pipe 17 from being raised and to effectively reduce the amount of adhesion of a scale.

In the heat exchanger according to the present embodiment, the pitch of the spring 110 gradually decreases from the upstream side to the downstream side, so that the pressure loss becomes smaller, as compared with that in a case where the pitch of the spring is set small in the whole space of the flow path. This results in improved heat exchange efficiency.

Furthermore, the pitch of the spring 110 is gradually reduced more easily, as compared with that in a case where the pitch of the spring is continuously reduced. Consequently, the spring 110 is easy to produce.

A plurality of springs respectively having different pitches may be used in place of the spring 110 whose pitch gradually decreases.

Another structure such as a rib (guide) functioning as a flow velocity conversion mechanism, a flow direction conversion mechanism, a turbulent flow generation mechanism, and an impurity removal mechanism may be provided integrally with the case 8 or a sheathed heater 7 in place of the spring 110.

Nineteenth Embodiment

Figure 24:
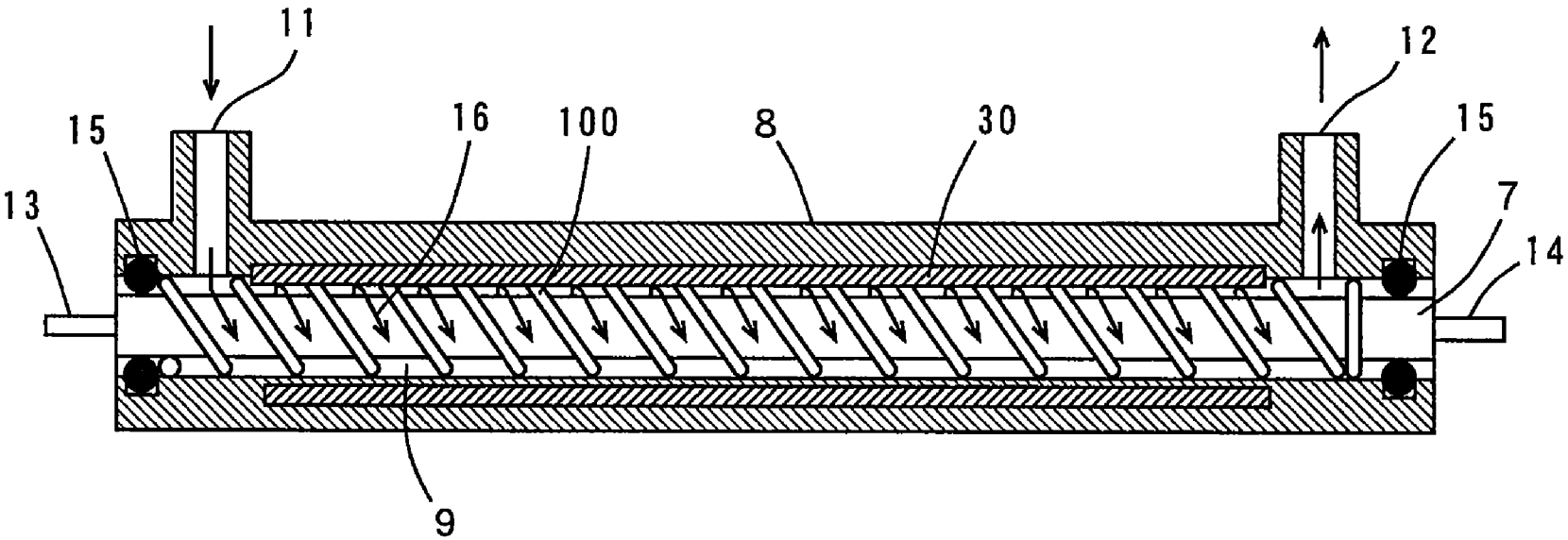
FIG. 24 is a cross-sectional view in the axial direction of a heat exchanger in a nineteenth embodiment of the present invention.
Figure 25:
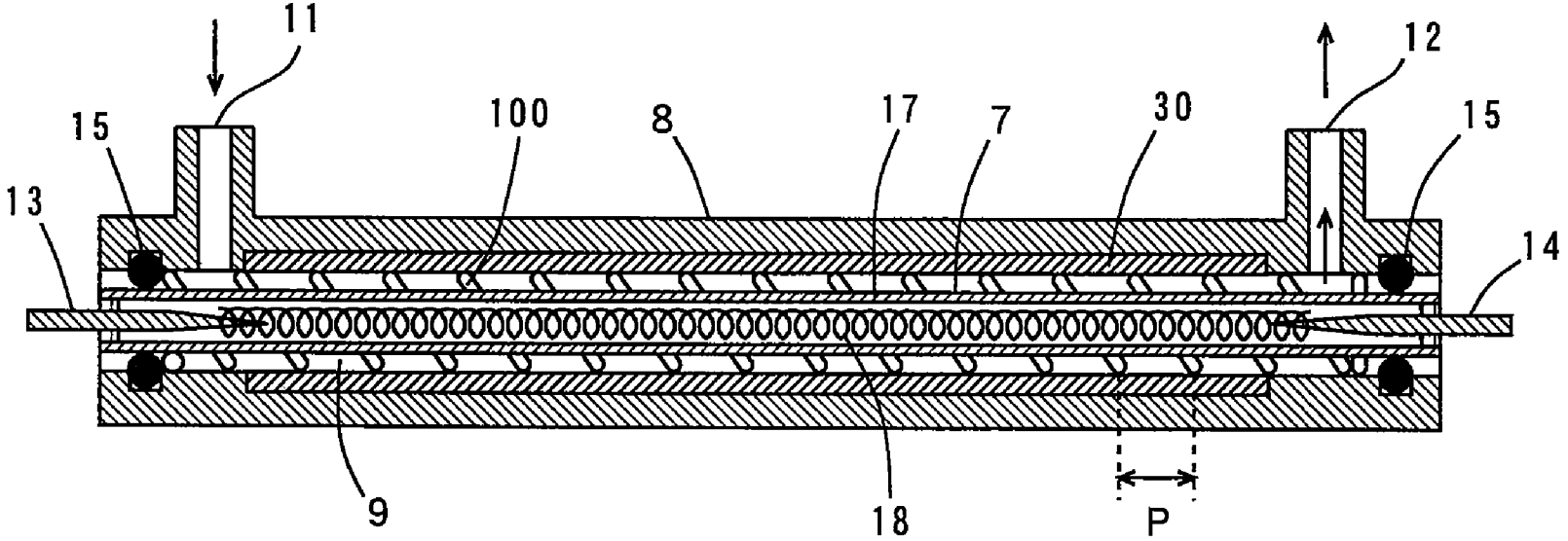
FIG. 25 is a cross-sectional view in the axial direction of the heat exchanger in the nineteenth embodiment of the present invention.

FIGS. 24 and 25 are cross-sectional views in the axial direction of a heat exchanger in a nineteenth embodiment of the present invention, where FIG. 24 illustrates a cross section of a case and a side surface of a sheathed heater, and FIG. 25 illustrates respective cross sections of the case and the sheathed heater.

The heat exchanger according to the nineteenth embodiment differs from the heat exchanger according to the first embodiment in that it is provided on an inner peripheral surface of a case 8 such that a water reducing material 30 composed of a magnesium alloy faces a spiral flow path 9. In this case, an outer peripheral surface of a sheathed heater 7, the water reducing material 30, and a spring 100 form the spiral flow path 9. Magnesium may be used as the water reducing material 30.

The operation and the function of the heat exchanger shown in FIGS. 24 and 25 are the same as those of the heat exchanger shown in FIGS. 1 and 2.

In the heat exchanger according to the present embodiment, water comes into contact with the water reducing material 30 composed of a magnesium alloy. Thus, magnesium reacts with water, to generate hydrogen gas. The generated hydrogen gas is dissolved in water so that an oxidation/reduction potential of water is lowered. A scale is easily dissolved in water having a low oxidation/reduction potential. Consequently, the scale that has adhered to the sheathed heater 7 is dissolved so that the scale can be stripped from the sheathed heater 7.

In the heat exchanger according to the present embodiment, the spring 100 thus functions as a flow velocity conversion mechanism, a flow direction conversion mechanism, a turbulent flow generation mechanism, and an impurity removal mechanism, so that the adhesion of the scale on a surface of the sheathed heater 7 can be prevented or reduced. Water within the spiral flow path 9 comes into contact with the water reducing material 30. Even when the scale adheres to the surface of the sheathed heater 7, therefore, the scale can be dissolved and stripped by water whose oxidation/reduction potential is lowered. As a result, the adhesion of the scale can be reliably prevented or reduced.

Furthermore, water whose oxidation/reduction potential is lowered has not only the action of dissolving the scale but also the action of dissolving dirt. Therefore, the effect of local washing can be enhanced by using water whose oxidation/reduction potential is lowered for the local washing of the human body. The oxidation of an odorous component can be restrained by the action of reducing water whose oxidation/reduction potential is lowered, so that odor of a toilet bowl can be reduced.

In a case where a film of a magnesium oxide is formed on a surface of the water reducing material 30, the film can be removed by being heated using the sheathed heater 7. Consequently, water whose oxidation/reduction potential is lowered can be continuously obtained.

In a case where the heat exchanger according to the present embodiment is used for the main body of a sanitary washing apparatus, it is feasible to miniaturize the main body of the sanitary washing apparatus. Since the washing nozzle is prevented from being clogged with fractions of the scale, a sanitary washing apparatus having a long life can be obtained. Further, the private parts of the human body are washed by water whose oxidation/reduction potential is lowered so that detergency can be enhanced. Therefore, a sanitary washing apparatus having a high washing effect can be obtained.

Although in the present embodiment, the water reducing material 30 is arranged on an inner peripheral surface of the case 8, the spring 100 may be formed of a magnesium alloy. A plurality of springs may be arranged within the case 8, and any one of the springs may be formed of a magnesium alloy. In this case, the same effect can be also obtained.

Furthermore, magnesium may be used as the water reducing material 30.

Twentieth Embodiment

Figure 26:
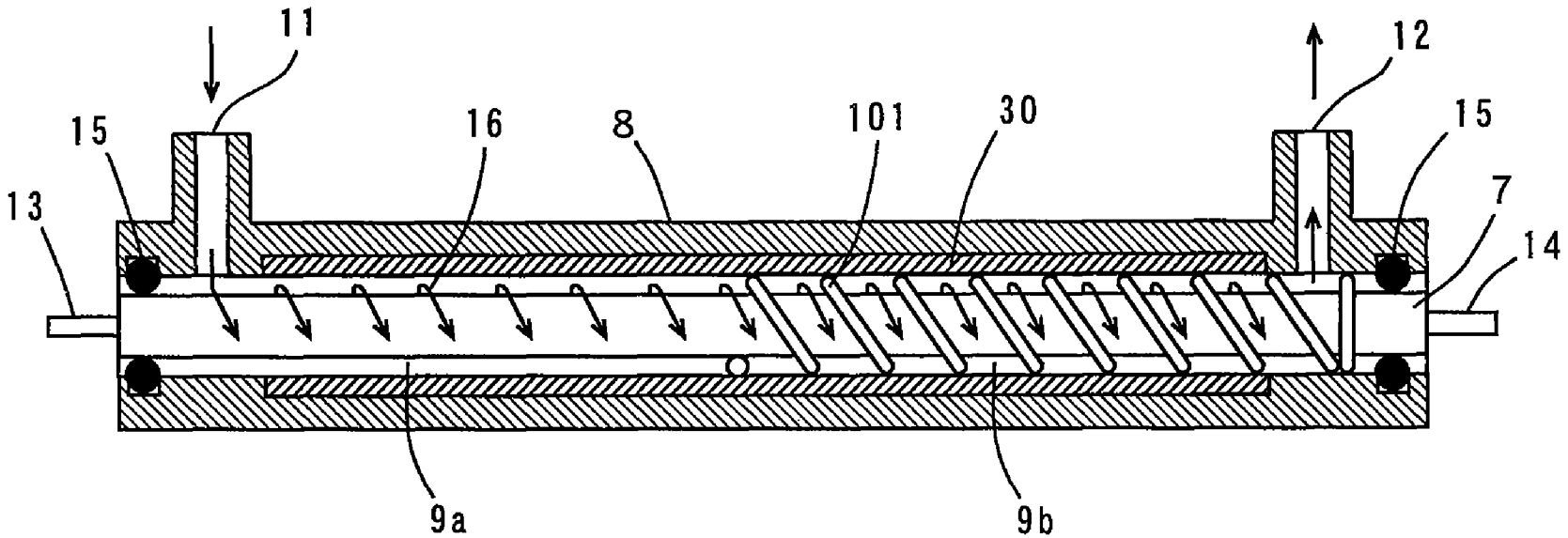
FIG. 26 is a cross-sectional view in the axial direction of a heat exchanger in a twentieth embodiment of the present invention.

FIG. 26 is a cross-sectional view in the axial direction of a heat exchanger in a twentieth embodiment of the present invention. The heat exchanger according to the twentieth embodiment differs from the heat exchanger according to the second embodiment in that it is provided on an inner peripheral surface of a case 8 such that a water reducing material 30 composed of a magnesium alloy faces a cylindrical flow path 9*a* and a spiral flow path 9*b*.

In the heat exchanger according to the present embodiment, the following effect is obtained in addition to the effect of the heat exchanger according to the second embodiment. Water within the cylindrical flow path 9*a* and the spiral flow path 96 comes into contact with the water reducing material 30. Even when a scale adheres to a surface of a sheathed heater 7, therefore, the scale can be dissolved and stripped by water whose oxidation/reduction potential is lowered. As a result, the adhesion of the scale can be reliably prevented or reduced.

Twenty-First Embodiment

Figure 27:
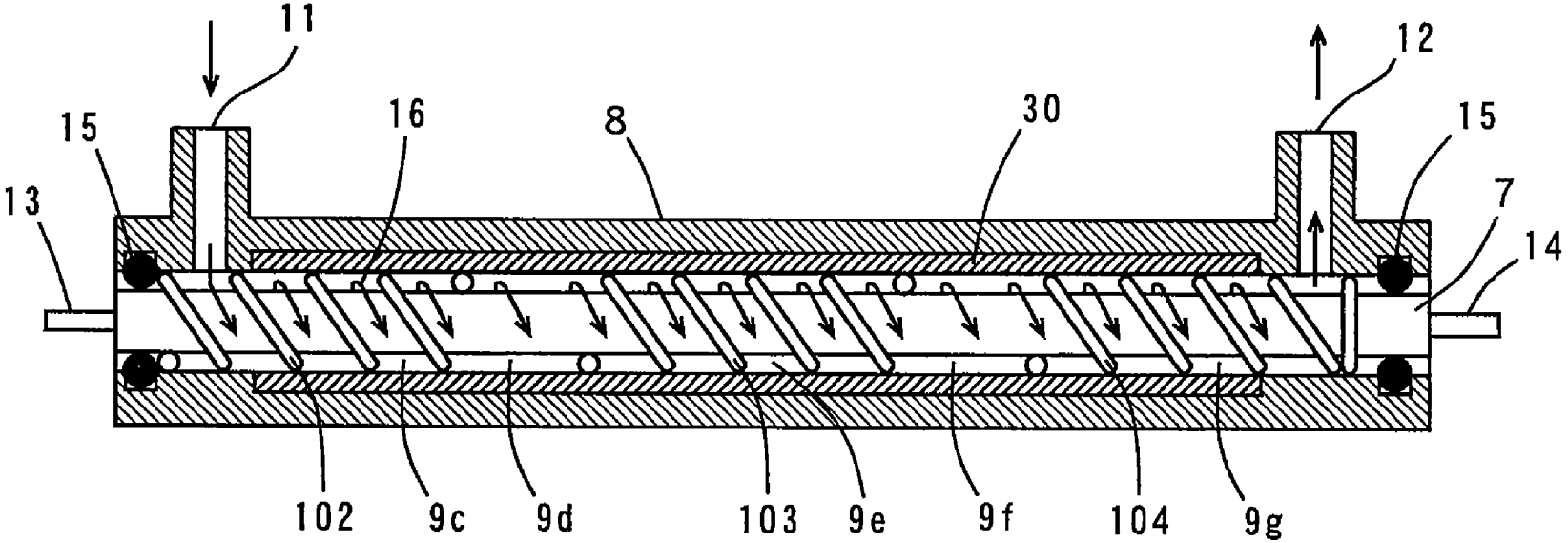
FIG. 27 is a cross-sectional view in the axial direction of a heat exchanger in a twenty-first embodiment of the present invention.

FIG. 27 is a cross-sectional view in the axial direction of a heat exchanger in a twenty-first embodiment of the present invention. The heat exchanger according to the twenty-first embodiment differs from the heat exchanger according to the third embodiment in that it is provided on an inner peripheral surface of a case 8 such that a water reducing material 30 composed of a magnesium alloy faces spiral flow paths 9*c*, 9*e*, and 9*g* and cylindrical flow paths 9*d* and 9*f*.

In the heat exchanger according to the present embodiment, the following effect is obtained in addition to the effect of the heat exchanger according to the third embodiment. Water within the spiral flow paths 9*c*, 9*e*, and 9*g* and the cylindrical flow paths 9*d* and 9*f* come into contact with the water reducing material 30. Even if a scale adheres to a surface of a sheathed heater 7, therefore, the scale can be dissolved and stripped by water whose oxidation/reduction potential is lowered. As a result, the adhesion of the scale can be reliably prevented or reduced.

Twenty-Second Embodiment

Figure 28:
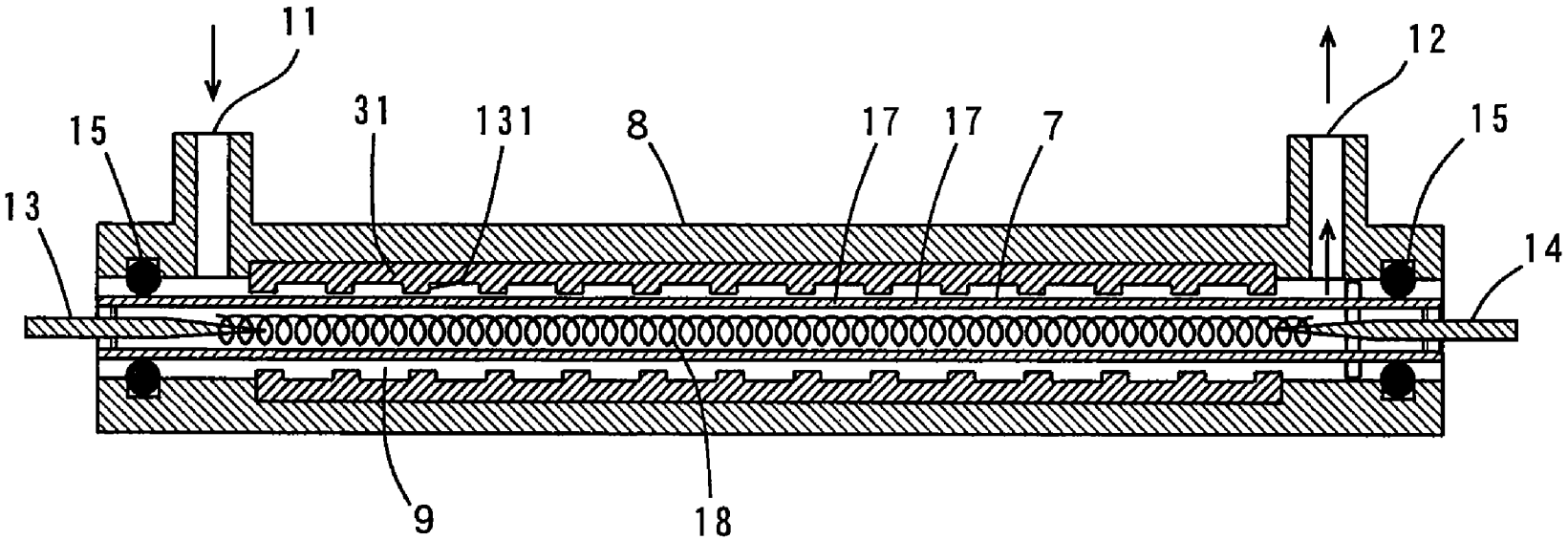
FIG. 28 is a cross-sectional view in the axial direction of a heat exchanger in a twenty-second embodiment of the present invention.

FIG. 28 is a cross-sectional view in the axial direction of a heat exchanger in a twenty-second embodiment of the present invention. The heat exchanger according to the twenty-second embodiment differs from the heat exchanger according to the fourth embodiment in that a water reducing material 31 having a spiral rib 131 composed of a magnesium alloy is provided on an inner peripheral surface of a case 8 in place of the rib 111. The water reducing material 31 is integrally formed by a mold in the case 8 composed of resin. In this case, the rib 131 functions as a water reducing material in addition to a flow velocity conversion mechanism, a flow direction conversion mechanism, a turbulent flow generation mechanism, and an impurity removal mechanism.

In the heat exchanger according to the present embodiment, the following effect is obtained in addition to the effect of the heat exchanger according to the fourth embodiment. Water within a spiral flow path 9 comes into contact with the water reducing material 31. Even if a scale adheres to a surface of a sheathed heater 7, therefore, the scale can be dissolved and stripped by water whose oxidation/reduction potential is lowered. As a result, the adhesion of the scale can be reliably prevented or reduced.

Twenty-Third Embodiment

Figure 29:
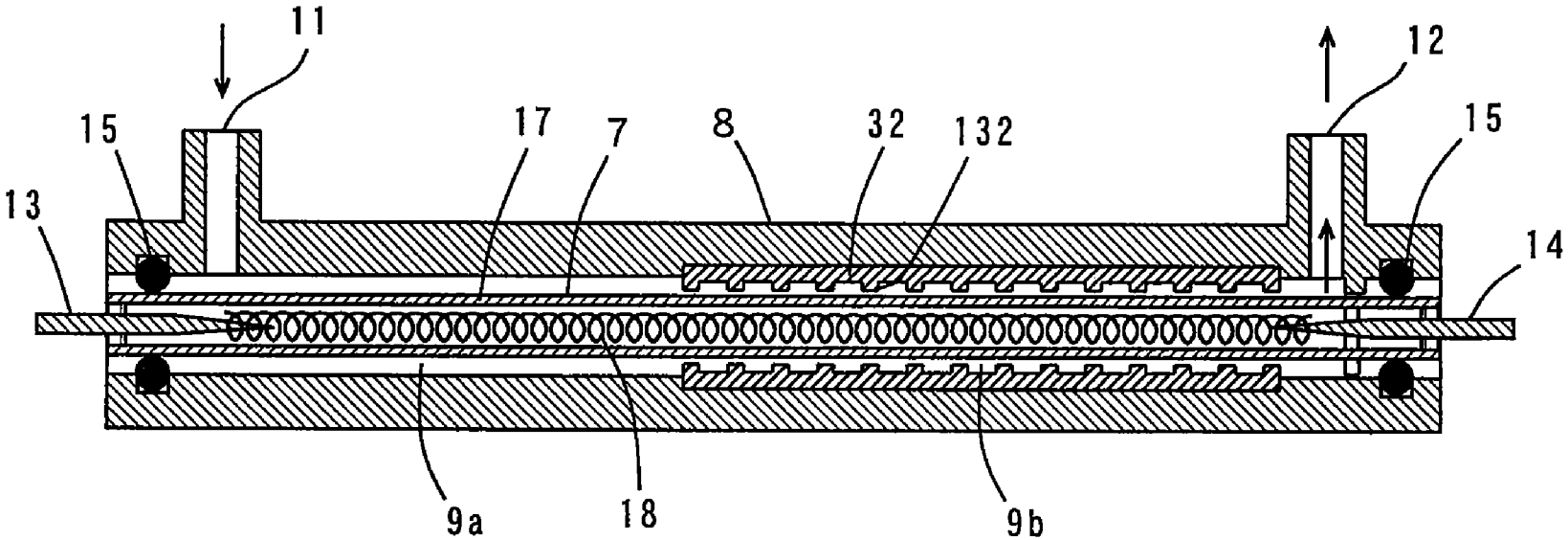
FIG. 29 is a cross-sectional view in the axial direction of a heat exchanger in a twenty-third embodiment of the present invention.

FIG. 29 is a cross-sectional view in the axial direction of a heat exchanger in a twenty-third embodiment of the present invention. The heat exchanger according to the twenty-third embodiment differs from the heat exchanger according to the fifth embodiment in that a water reducing material 32 having a spiral rib 132 composed of a magnesium alloy is provided on an inner peripheral surface on the downstream side of a case 8 in place of the rib 112. The water reducing material 32 is integrally formed by a mold in the case 8 composed of resin. In this case, the rib 132 functions as a water reducing material in addition to a flow velocity conversion mechanism, a flow direction conversion mechanism, a turbulent flow generation mechanism, and an impurity removal mechanism.

In the heat exchanger according to the present embodiment, the following effect is obtained in addition to the effect of the heat exchanger according to the fifth embodiment. Water within a spiral flow path 9 comes into contact with the water reducing material 32. Even if a scale adheres to a surface of a sheathed heater 7, therefore, the scale can be dissolved and stripped by water whose oxidation/reduction potential is lowered. As a result, the adhesion of the scale can be reliably prevented or reduced.

Twenty-Fourth Embodiment

Figure 30:
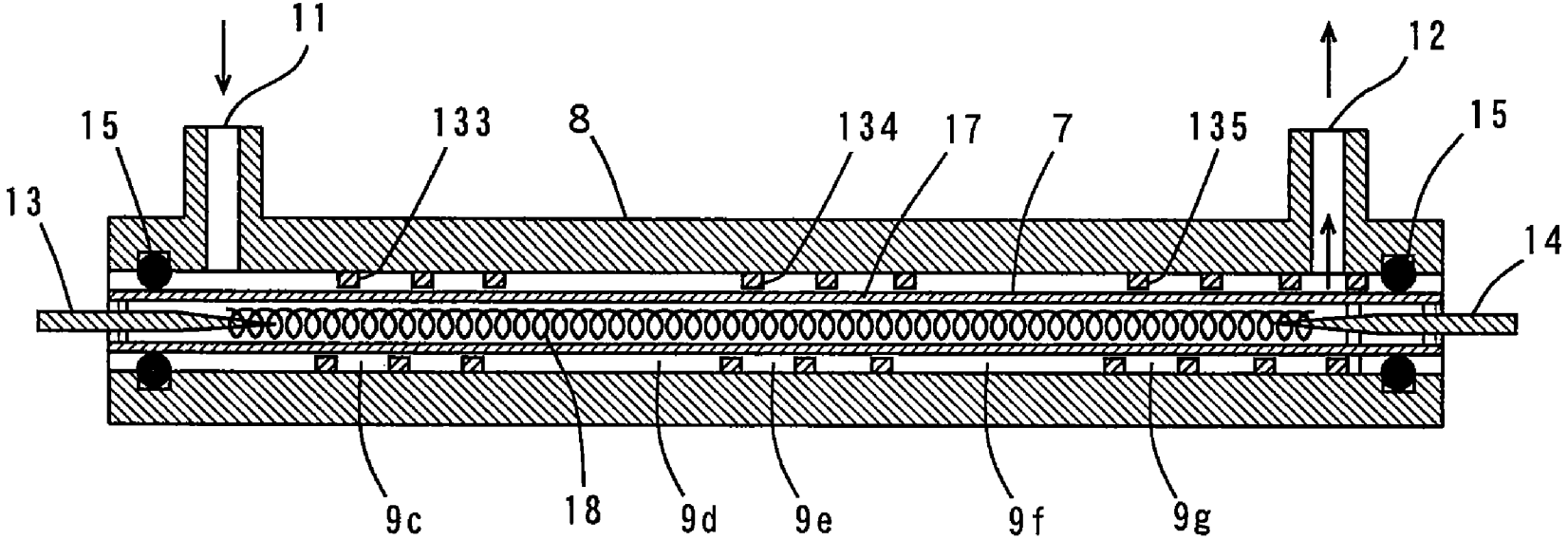
FIG. 30 is a cross-sectional view in the axial direction of a heat exchanger in a twenty-fourth embodiment of the present invention.

FIG. 30 is a cross-sectional view in the axial direction of a heat exchanger in a twenty-fourth embodiment of the present invention. The heat exchanger according to the twenty-fourth embodiment differs from the heat exchanger according to the sixth embodiment in that spiral ribs 133, 134, and 135 composed of a magnesium alloy are intermittently provided on an inner peripheral surface of a case 8 in place of the ribs 113, 114, and 115. The ribs 133, 134, and 135 are integrally formed by a mold in the case 8 composed of resin. In this case, the ribs 133, 134, and 135 function as a water reducing material in addition to a flow velocity conversion mechanism, a flow direction conversion mechanism, a turbulent flow generation mechanism, and an impurity removal mechanism.

In the heat exchanger according to the present embodiment, the following effect is obtained in addition to the effect of the heat exchanger according to the sixth embodiment. Water within a spiral flow path 9 comes into contact with the ribs 133, 134, and 135. Even if a scale adheres to a surface of a sheathed heater 7, therefore, the scale can be dissolved and stripped by water whose oxidation/reduction potential is lowered. As a result, the adhesion of the scale can be reliably prevented or reduced.

Twenty-Fifth Embodiment

Figure 31:
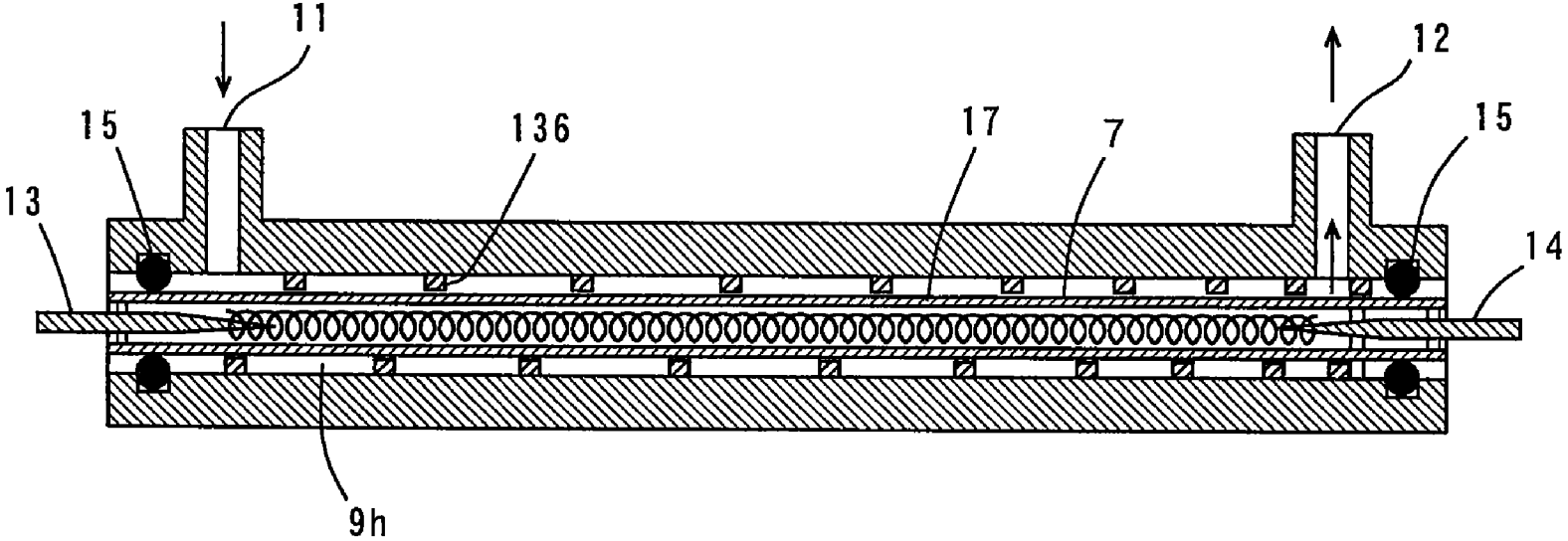
FIG. 31 is a cross-sectional view in the axial direction of a heat exchanger in a twenty-fifth embodiment of the present invention.

FIG. 31 is a cross-sectional view in the axial direction of a heat exchanger in a twenty-fifth embodiment of the present invention. The heat exchanger according to the twenty-fifth embodiment differs from the heat exchanger according to the seventh embodiment in that a spiral rib 136 composed of a magnesium alloy is provided on an inner peripheral surface of a case 8 in place of the rib 116. The rib 136 is integrally formed by a mold in the case 8 composed of resin. The pitch of the rib 136 continuously decreases from the upstream side to the downstream side. In this case, the rib 136 functions as a water reducing material in addition to a flow velocity conversion mechanism, a flow direction conversion mechanism, a turbulent flow generation mechanism, and an impurity removal mechanism.

In the heat exchanger according to the present embodiment, the following effect is obtained in addition to the effect of the heat exchanger according to the seventh embodiment. Water within a spiral flow path 9 comes into contact with the rib 136. Even if a scale adheres to a surface of a sheathed heater 7, therefore, the scale can be dissolved and stripped by water whose oxidation/reduction potential is lowered. As a result, the adhesion of the scale can be reliably prevented or reduced.

The spiral rib 136 may not be provided on an inner wall of the case 8, and the cylindrical inner wall of the case 8 may be provided with a taper such that the diameter of the cylindrical inner wall of the case 8 gradually decreases from the upstream side to the downstream side. In this case, a water reducing material is provided on the inner peripheral surface of the case 8.

Twenty-Sixth Embodiment

Figure 32:
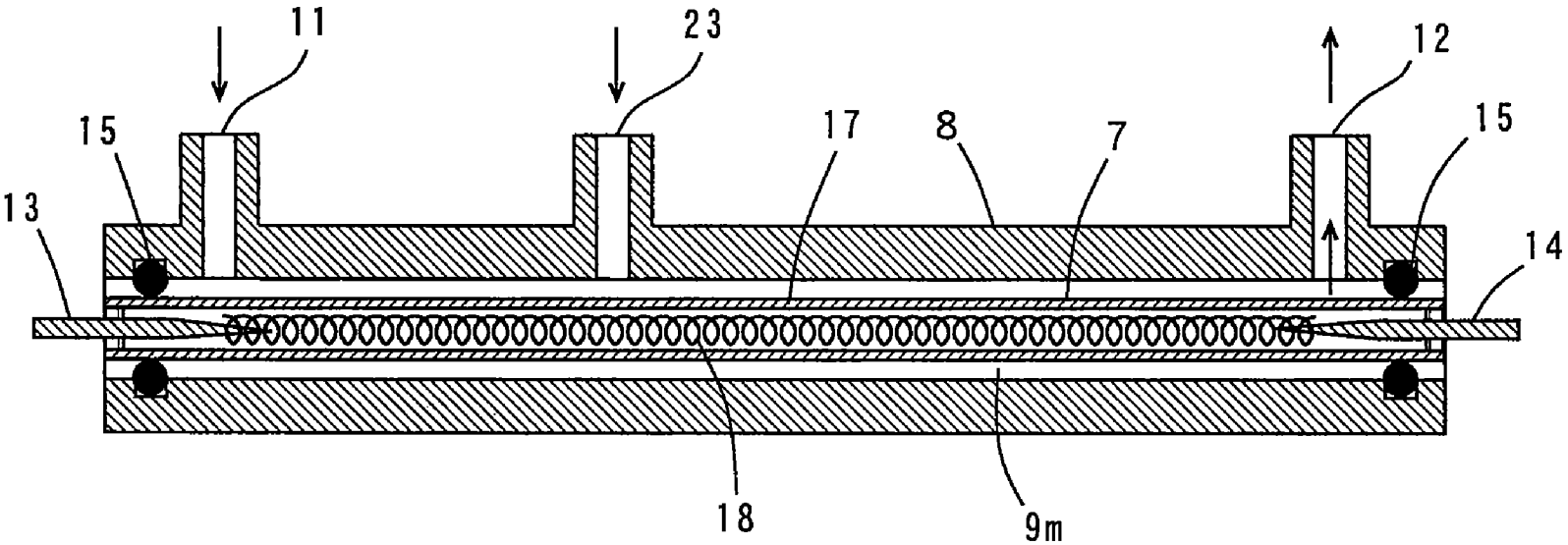
FIG. 32 is a cross-sectional view in the axial direction of a heat exchanger in a twenty-sixth embodiment of the present invention.

FIG. 32 is a cross-sectional view in the axial direction of a heat exchanger in a twenty-sixth embodiment of the present invention.

The heat exchanger according to the twenty-sixth embodiment differs from the heat exchanger according to the first embodiment in that a spring 100 is not provided, and a water inlet 23 is provided in the downstream of a water inlet 11 in a case 8. In this case, a cylindrical flow path 9*m* is formed between an outer peripheral surface of a sheathed heater 7 and an inner peripheral surface of the case 8.

The operation and the function of the heat exchanger according to the present embodiment will be described below. The water inlet 23 is provided so as to be eccentric from a central axis of the case 8 (a central axis of the cylindrical flow path 9*m*) on a side surface of the case 8. Consequently, water flowing into the case 8 from the water inlet 11 flows while swirling in a spiral shape along a copper pipe 17 in the sheathed heater 7, and the state of swirling flow continues.

When water reaches the vicinity of an intermediate point between the water inlet 11 and a water outlet 12, a flow component in the swirling direction is attenuated. When the cylindrical flow path 9*m* continues to the downstream side, there is no flow component in the swirling direction, and there is only a flow component in the axial direction. In the present embodiment, a water inlet 23 is provided in a portion where a flow component in the swirling direction starts to be attenuated, that is, in the vicinity of the center at which the flow velocity is reduced. Water is supplied from the water inlet 23 so that the flow component in the swirling direction is increased. As a result, the flow velocity on a surface of the copper pipe 17 in the sheathed heater 7 is raised in a downstream region where the scale easily adheres. As a result, the adhesion of the scale on the downstream side is prevented or reduced.

Since the plurality of water inlets 11 and 23 provided in a direction from the upstream side to the downstream side of the case 8 function as a flow velocity conversion mechanism, a flow direction conversion mechanism, a turbulent flow generation mechanism, and an impurity removal mechanism, so that the adhesion of the scale on the downstream side can be prevented or reduced.

Moreover, the spring 100 as in the first embodiment is not provided in a flow path within the case 8, and the flow path cross-sectional area is not reduced, so that the pressure loss in the heat exchanger can be reduced. This can result in further improved heat exchange efficiency.

Furthermore, the spring 100 need not be used, so that the number of components and the number of assembling steps can be reduced.

In the present embodiment, the water inlets 11 and 23 are provided so as to be eccentric from a central axis of the cylindrical flow path 9*m* so that the speed of swirling flow within the case 8 is increased. Even in a case where the water inlets 11 and 23 are not eccentric from the central axis of the cylindrical flow path 9*m*, however, the flow of water that has flown in from the water inlet 23 is further added to the flow of water that has flown in from the water inlet 11 so that the flow rate and the flow velocity of water are exerted so as to be increased on the downstream side from the center of the cylindrical flow path 9*m*. Consequently, the water inlet 23 may be provided so as not to be eccentric from the central axis of the cylindrical flow path 9*m*. In this case, the flow velocity on a surface of the copper pipe 17 in the sheathed heater 7 is raised, so that the adhesion of the scale on the downstream side can be prevented or reduced.

Even if not water but another fluid, for example, gas such as air is caused to flow in from the water inlet 23, the flow velocity of water within the cylindrical flow path 9*m* can be raised. That is, air from the water inlet 23 is injected into the flow of water flowing in from the water inlet 11 so that water within the cylindrical flow path 9*m* is exerted so as to be rapidly pushed out of the water outlet 12 by the volume of air. When air is intermittently supplied to the cylindrical flow path 9*m* from the water inlet 23 using an air supply device such as an air pump, therefore, the flow velocity on the surface of the copper pipe 17 in the sheathed heater 7 is intermittently raised. Thus, the adhesion of the scale on the downstream side can be prevented or reduced. Further, it is possible to obtain the action and the optional function of allowing the flow velocity of water flowing out of the water outlet 12 to be intermittently adjusted. The specific heat of gas is incomparably lower, as compared with the specific heat of water. Therefore, the sheathed heater 7 and water are not excessively deprived of heat.

The other fluid is thus caused to flow into the cylindrical flow path 9*m*, so that the effect of preventing or reducing the adhesion of the scale by raising the flow velocity as well as the optional function by the other fluid can be obtained.

Twenty-Seventh Embodiment

Figure 33:
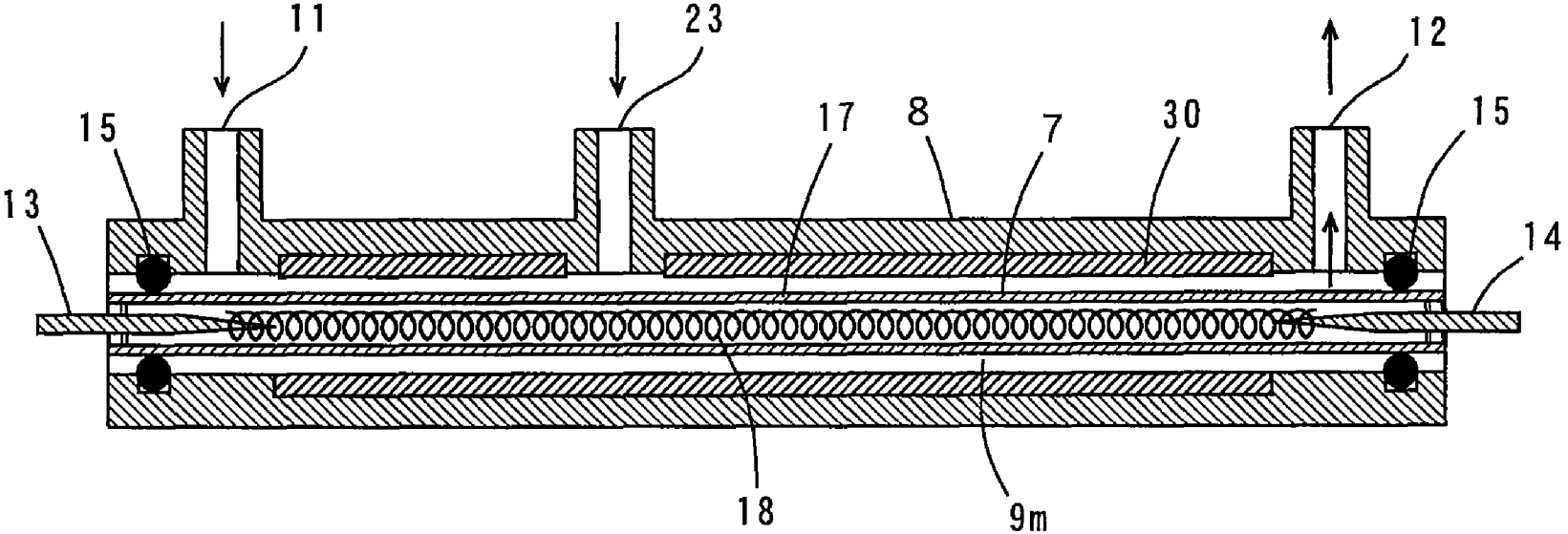
FIG. 33 is a cross-sectional view in the axial direction of a heat exchanger in a twenty-seventh embodiment of the present invention.

FIG. 33 is a cross-sectional view in the axial direction of a heat exchanger in a twenty-seventh embodiment of the present invention. The heat exchanger according to the twenty-seventh embodiment differs from the heat exchanger according to the twenty-sixth embodiment in that a water reducing material 30 composed of a magnesium alloy is provided on an inner peripheral surface of a case 8. The water reducing material 30 is integrally formed by a mold in the case 8 composed of resin.

In the heat exchanger according to the present embodiment, the following effect is obtained in addition to the effect of the heat exchanger according to the twenty-sixth embodiment. Water within a spiral flow path 9 comes into contact with the water reducing material 30. Even if a scale adheres to a surface of a sheathed heater 7, therefore, the scale can be dissolved and stripped by water whose oxidation/reduction potential is lowered. As a result, the adhesion of the scale can be reliably prevented or reduced.

Twenty-Eighth Embodiment

Figure 34:
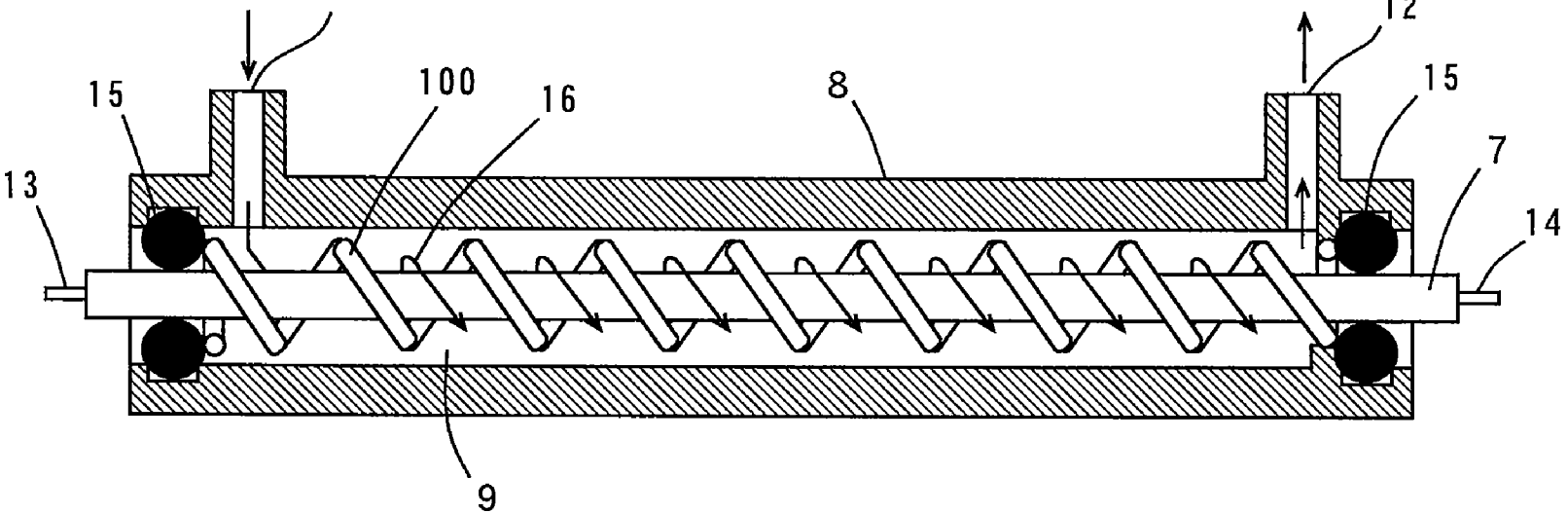
FIG. 34 is a cross-sectional view in the axial direction of a heat exchanger in a first embodiment of the present invention.
Figure 35:
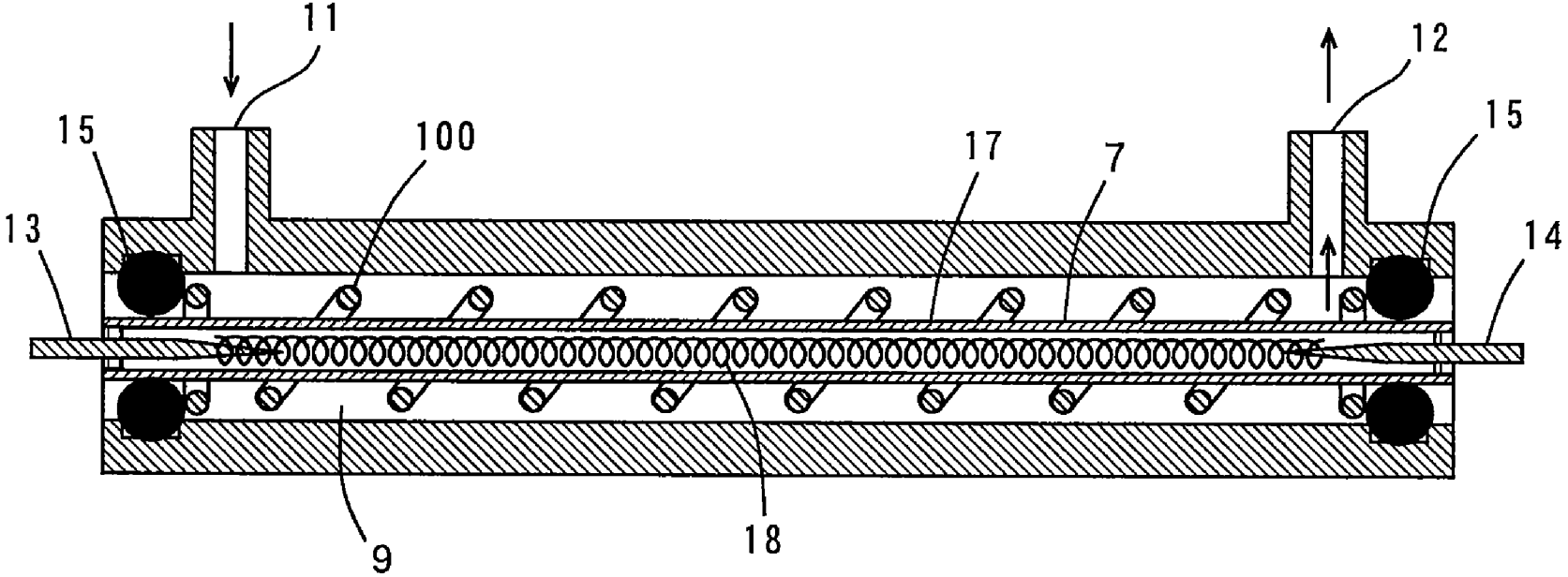
FIG. 35 is a cross-sectional view in the axial direction of the heat exchanger in the first embodiment of the present invention.

FIGS. 34 and 35 are cross-sectional views in the axial direction of a-heat exchanger in a twenty-eighth embodiment of the present invention, where FIG. 34 illustrates a cross section of a case and a side surface of a sheathed heater, and FIG. 35 illustrates respective cross sections of the case and the sheathed heater.

The heat exchanger according to the twenty-eighth embodiment differs from the heat exchanger according to the eighth embodiment in that one end of a spring 100 on the side of a water outlet 12 is fixed to a case 8, and the other end of the spring 100 on the side of a water inlet 11 is not fixed but brought into a free end. The spring 100 functions as a flow velocity conversion mechanism, a flow direction conversion mechanism, a turbulent flow generation mechanism, and an impurity removal mechanism.

Figure 36:
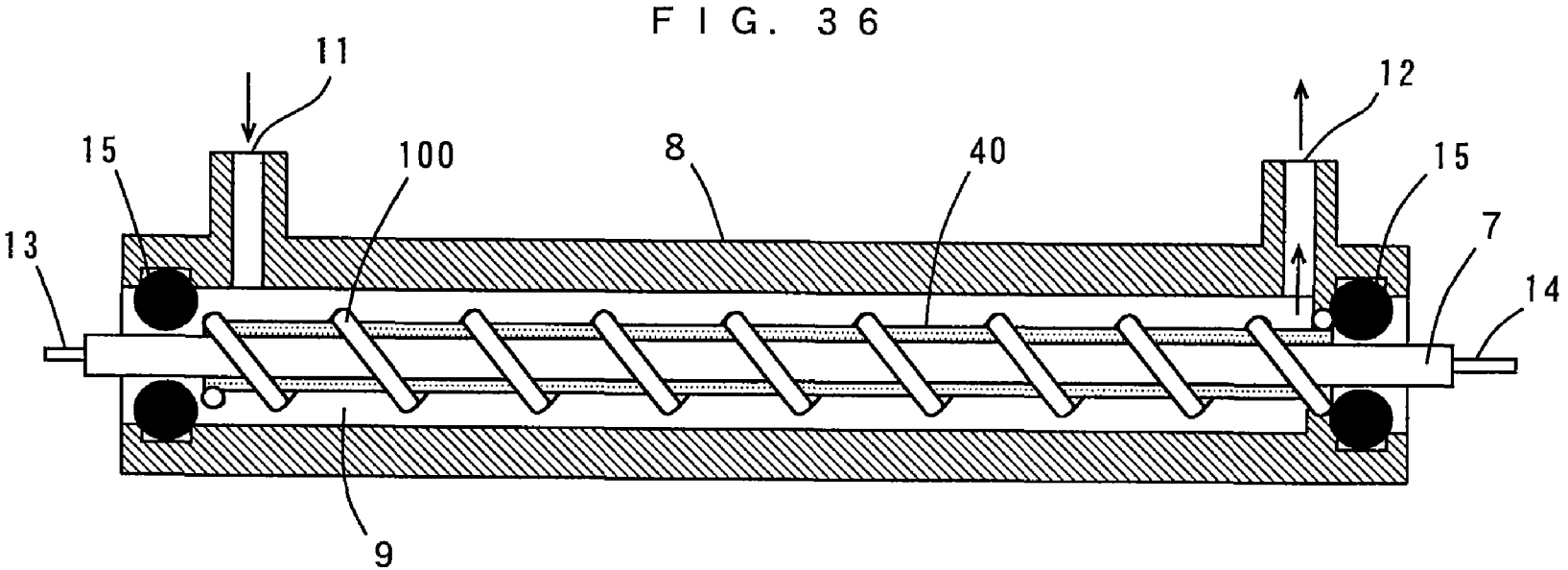
FIG. 36 is a cross-sectional view in the axial direction showing a state where a scale adheres to a sheathed heater 7.
Figure 37:
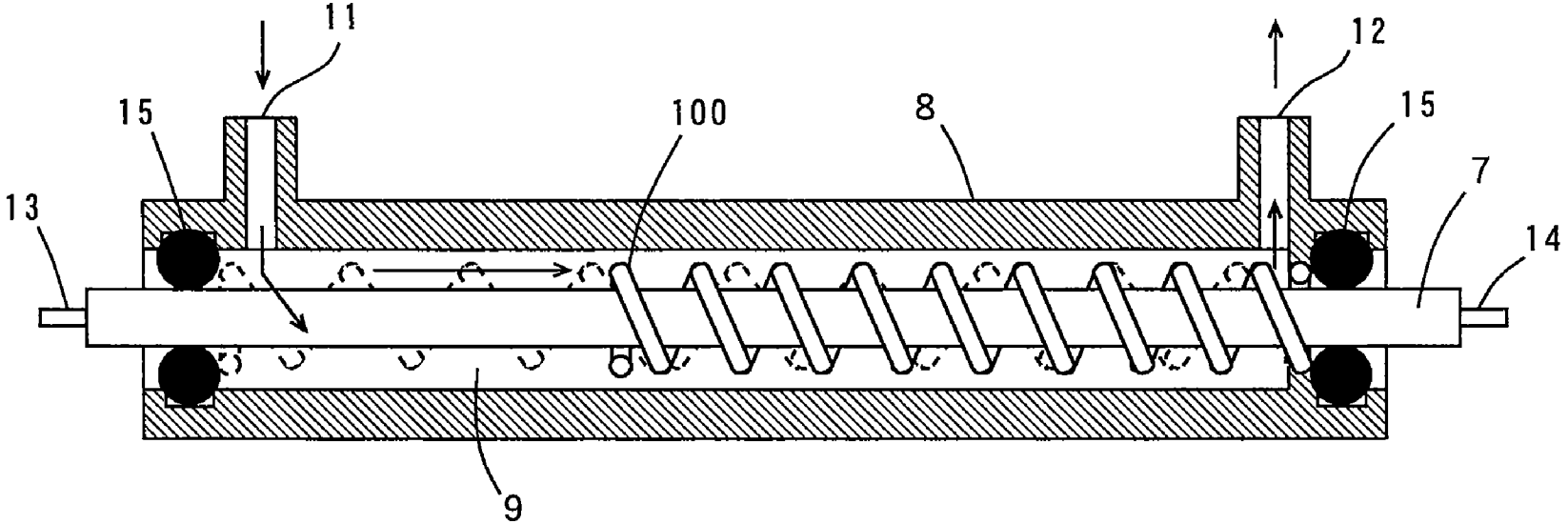
FIG. 37 is a cross-sectional view in the axial direction for explaining an operation for washing a heat exchanger.

FIG. 36 is a cross-sectional view in the axial direction showing a state where a scale adheres to a sheathed heater 7. FIG. 37 is a cross-sectional view in the axial direction for explaining an operation for washing the heat exchanger.

Figure 41:
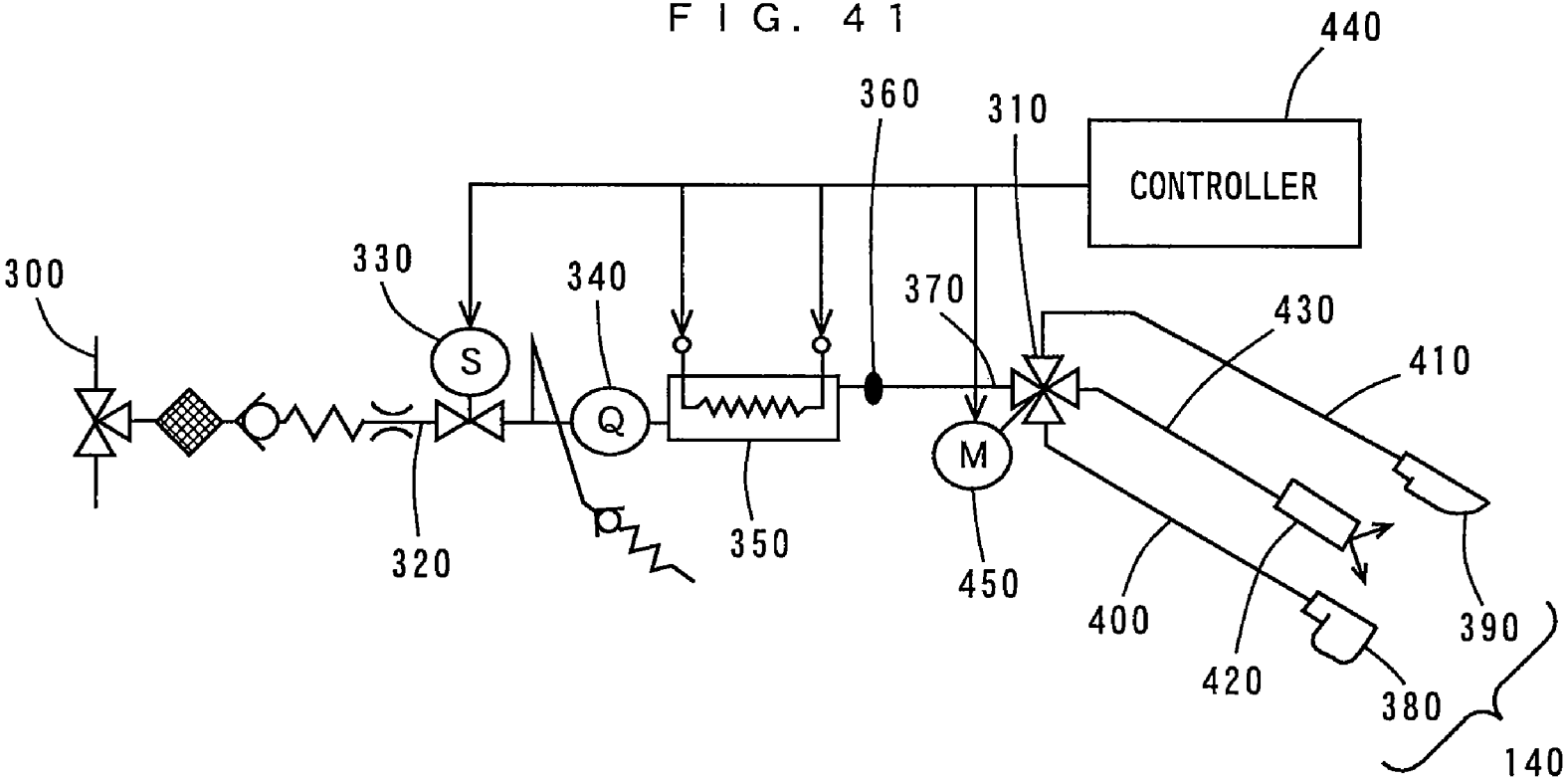
FIG. 41 is a schematic view showing a water circuit in the sanitary washing apparatus 600 shown in FIG. 39.
Figure 44:
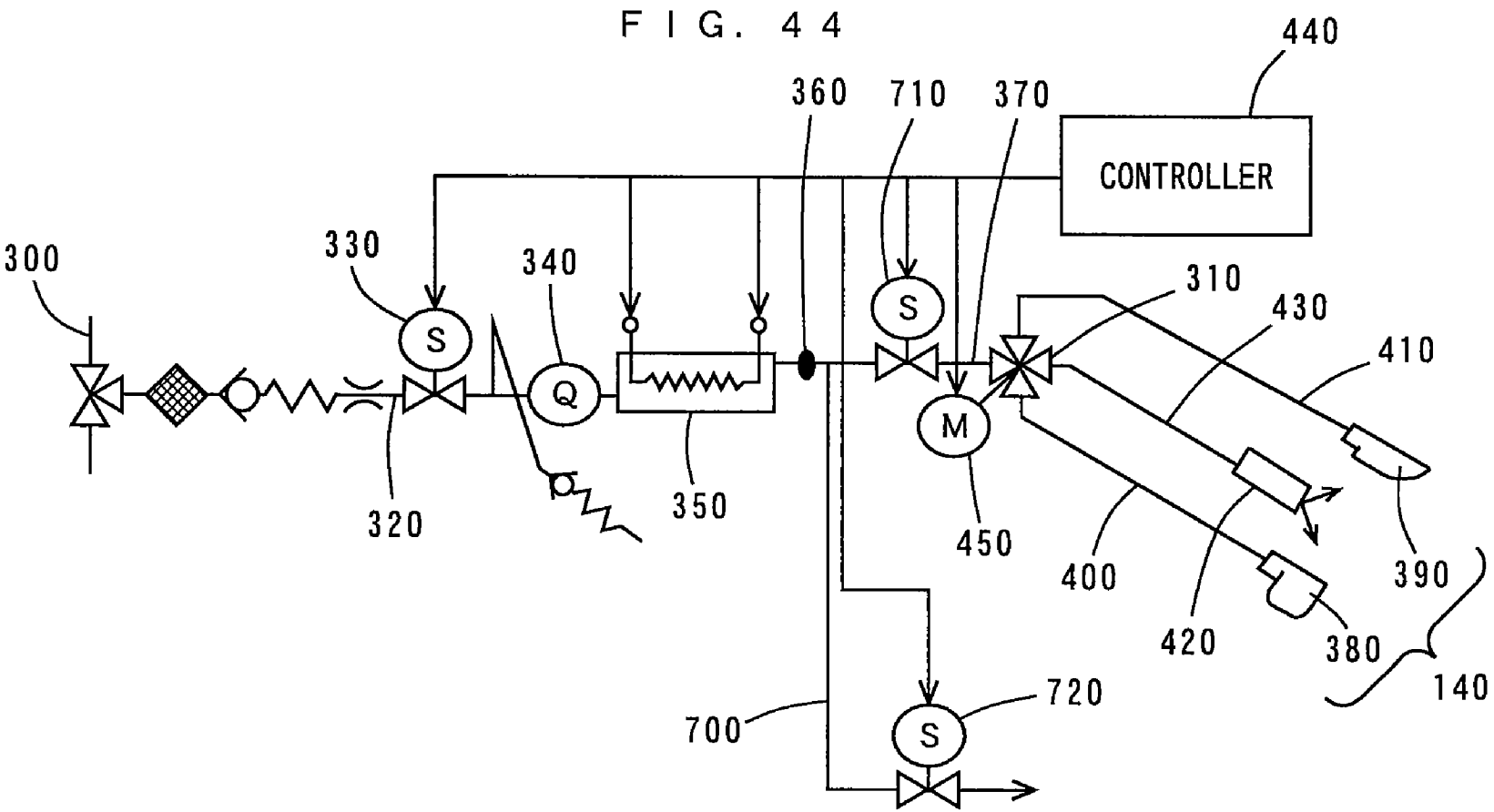
FIG. 44 is a schematic view showing a water circuit in a sanitary washing apparatus in a thirty-first embodiment of the present invention.

In the heat exchanger according to the present embodiment, the amount of energization of the sheathed heater 7 and the flow rate of water within a spiral flow path 9 are controlled by a microcomputer and a controller 440 composed of its peripheral circuit (FIGS. 41 and 44).

The controller 440 stops the energization of the sheathed heater 7 when it accepts a command to perform the operation for washing the heat exchanger from a remote controller 150 (FIG. 40), while supplying water to the heat exchanger at a predetermined flow rate by controlling a switching valve 310 functioning as a flow path switcher and a flow rate adjustor (FIGS. 41 and 44). At this time, a sufficient washing effect can be exhibited by supplying water at a higher flow rate than that at the time of normal fluid heating.

The controller 440 presumes the surface temperature of the sheath heater 7 from the amount of energization of the sheathed heater 7, to perform the operation for washing the heat exchanger after the presumed surface temperature becomes not less than a predetermined temperature.

In a case such as a case where warm water having a high temperature is obtained, a case where a large amount of warm water is obtained, or a case where a water inlet temperature is low, when the controller 440 increases the amount of energization of the sheathed heater 7, the surface temperature of the sheathed heater 7 is increased. As a result, the temperature of water in a boundary layer in a flow velocity between the sheathed heater 7 and water is raised. When the heat exchanger is employed for a long time period, therefore, a scale 40 is deposited on a surface of the sheathed heater 7, as shown in FIG. 36, resulting in reduced heat exchange efficiency. When the scale 40 is further deposited on the surface of the sheathed heater 7, the spiral flow path 9 is closed by the spring 100. As a result, there arises a boil-dry state where heating is performed in a state where no water flows.

In the heat exchanger according to the present embodiment, the scale 40 that has deposited on the sheathed heater 7 can be removed by the operation of the spring 100, described below. The controller 440 presumes the surface temperature of the sheathed heater 7 from the amount of energization of the sheathed heater 7. The controller 440 controls the switching valve 310 in a state where after the energization, the sheathed heater 7 is not energized, and causes water to flow from the water inlet 11 to the water outlet 12 through the spiral flow path 9 at a higher flow rate than that at the time of normal fluid heating in a case where it is presumed that the surface temperature of the sheathed heater 7 becomes not less than a predetermined temperature (preferably, not less than 60° C. and more preferably not less than 40° C.).

In this case, only one end of the spring 100 on the side of the water outlet 12 is fixed to the case 8, and the other end of the spring 100 on the side of the water inlet 11 is brought into a free end. Therefore, the spring 100 contracts from the water inlet 11 to the water outlet 12 by a force of water, as indicated by an arrow in FIG. 37. A scale that has adhered to the sheathed heater 7 is stripped by the movement of the spring 100 at this time.

In this case, the stripped scale is pulverized by swirling flow in a turbulent flow state within the spiral flow path 9 and is caused to flow toward the downstream side. Thus, the heat exchanger is not clogged with the scale on the downstream side. In such a way, the heat exchanger is sufficiently washed.

Here, it is preferable that the spring constant of the spring 100 is set such that the spring 100 hardly expands and contracts at a flow rate of water at the time of normal fluid heating, and expands and contracts at a flow rate of water at the time of the operation for washing the heat exchanger.

Thus, the spring 100 is expanded and contracted with a force of water flowing within the case 8 so that the scale can be easily removed in a simple configuration.

Only one end of the spring 100 is fixed so that the amount of expansion and contraction of the spring 100 can be increased. Thus, the scale can be effectively stripped.

Since water flows within the case 8 at a higher flow rate, as compared with that at the time of normal fluid heating. Therefore, the spring 100 can be greatly expanded and contracted utilizing a strong force of water flow. Thus, the effect of stripping the scale can be enhanced.

Furthermore, the operation for washing the heat exchanger is performed in a state where the sheathed heater 7 is not energized, so that a temperature difference occurs between the sheathed heater 7 and the scale, as compared with that at the time of normal fluid heating. The sheathed heater 7 and the scale 40 differ in coefficients of thermal expansion/contraction, so that the scale 40 is liable to be broken and stripped by the temperature difference between the sheathed heater 7 and the scale.

Furthermore, the surface temperature of the sheath heater 7 is presumed on the basis of the amount of energization of the sheathed heater 7, and the operation for washing the heat exchanger is performed after the presumed surface temperature becomes not less than a predetermined temperature. Thus, the scale can be removed immediately after situations where it easily adheres. As a result, the life of the heat exchanger can be lengthened.

As described in the foregoing, in the heat exchanger according to the present embodiment, even if the scale adheres to the sheathed heater 7, impurities such as a scale can be physically stripped and removed by an operation for expanding and contracting the spring 100. Consequently, it is possible to reduce the heat exchange efficiency by depositing impurities such as a scale and prevent the flow path from being clogged. As a result, heat exchange between the sheathed heater 7 and water is stably carried out, which makes it feasible to lengthen the life of the heat exchanger.

In order to generally miniaturize the heat exchanger and to allow for high-speed response, when the watt density of the sheathed heater 7 is increased, the surface temperature of the sheathed heater 7 is raised. Thus, the scale is easily deposited, so that the life of the heat exchanger is shortened. In the heat exchanger according to the present embodiment, even if the surface temperature of the sheathed heater 7 is raised, the adhesion of the scale is prevented or reduced by the spring 100. Consequently, the watt density of the sheathed heater 7 can be improved. As a result, it is feasible to miniaturize the heat exchanger and to allow for high-speed response.

Although in the present embodiment, the controller 440 presumes the surface temperature of the sheath heater 7 from the amount of energization, the controller 440 may presume the surface temperature of the sheathed heater 7 on the basis of an inlet water temperature, a warm water outlet temperature, a flow rate, and so on. The surface temperature of the sheathed heater 7 may be directly or indirectly detected using various types of detectors.

Although in the present embodiment, only one end of the spring 100 is fixed, the scale may be stripped by rotating the spring 100 in the circumferential direction with a force of water without fixing both ends of the spring 100.

Furthermore, although in the present embodiment, the spring 100 is provided in the whole of the flow path, the spring 100 may be provided in a part of the flow path. Even in this case, the spring 100 functions as a flow velocity conversion mechanism, a flow direction conversion mechanism, a turbulent flow generation mechanism, and an impurity removal mechanism, so that the adhesion of the scale can be prevented or reduced.

Twenty-Ninth Embodiment

Figure 38:
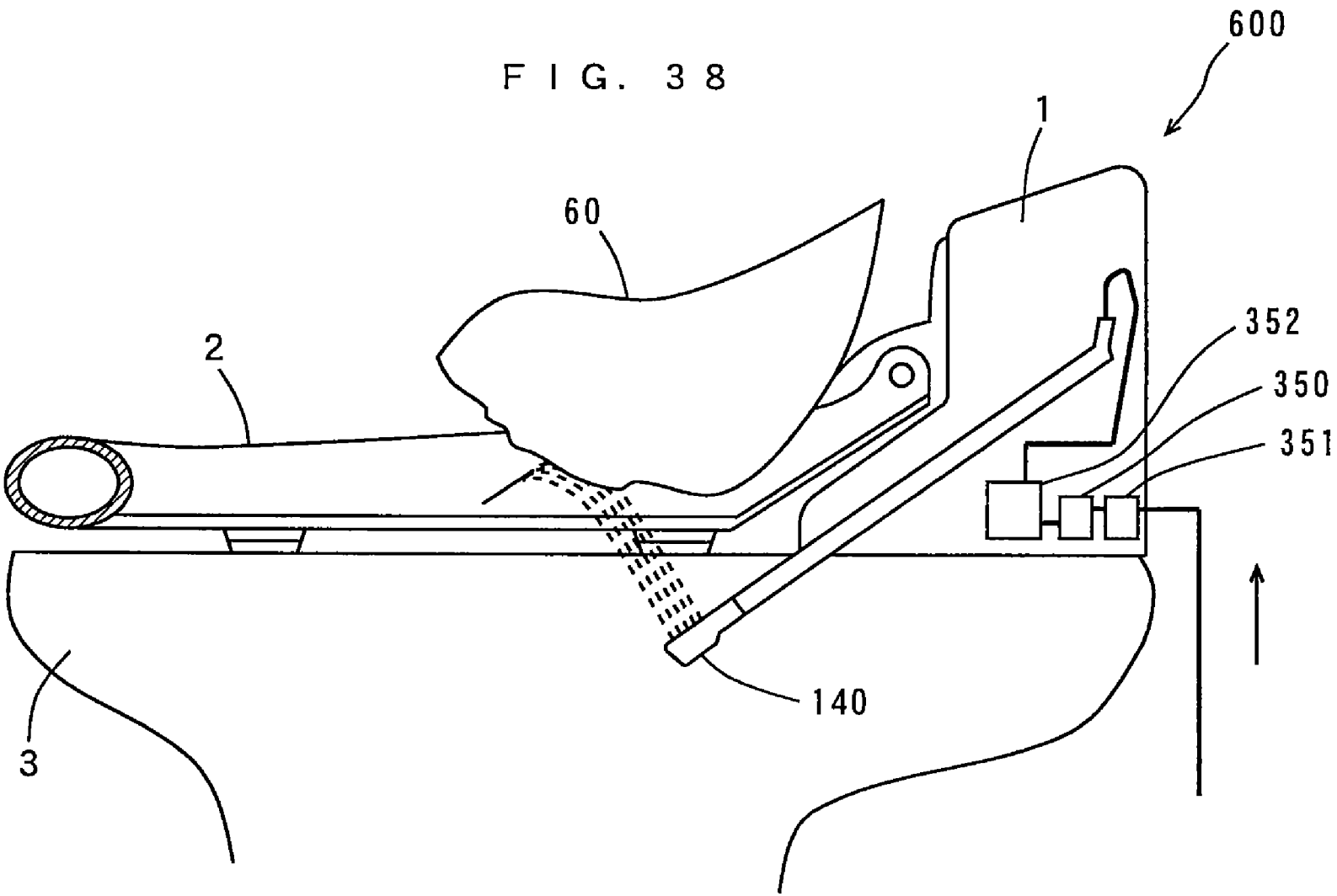
FIG. 38 is a schematic sectional view of a sanitary washing apparatus in a twenty-ninth embodiment of the present invention.

FIG. 38 is a schematic sectional view of a sanitary washing apparatus in a twenty-ninth embodiment of the present invention. In the heat exchanger according to the present embodiment, any one of the heat exchangers according to the first to twenty-eighth embodiments is used.

A sanitary washing apparatus 600 shown in FIG. 38 comprises a main body 1 and a warm toilet seat 2. The main body 1 and the warm toilet seat 2 are mounted on a toilet bowl 3. A heat exchanger 350, a cutoff valve 351, and a flow rate control device 352 are provided as main components within the main body 1. The illustration of other components such as a control substrate contained in the main body 1 is not repeated. As the heat exchanger 350, any one of the heat exchangers according to the first to twenty-ninth embodiments is used.

Warm water obtained by heat exchange of the heat exchanger 350 is sprayed from a human body washing nozzle 140. Thus, the private parts of the human body 60 are washed.

It is feasible to miniaturize the main body 1 of the sanitary washing apparatus 600 by containing the heat exchanger 350, which is small in size and in which the adhesion of a scale is prevented and reduced, in the main body 1. Since the heat exchanger 350 is not clogged with the scale, the life of the sanitary washing apparatus 600 can be lengthened, and not only a heating operation of the heat exchanger 350 but also a washing operation of the sanitary washing apparatus 600 can be stabilized.

Particularly, in the heat exchanger 350, a flow path is provided in the outer periphery of the sheathed heater 7, so that thermal insulation is provided by the flow path, as described above. Thus, a thermal insulating layer need not be provided, so that the heat exchanger 350 can be miniaturized. Since the outer periphery of a heating element is surrounded by the flow path, heat generated by the sheathed heater 7 hardly escapes out of the case 8. Consequently, a small-sized sanitary washing apparatus 600 can be realized with a small heat radiation loss and saved energy by using such a heat exchanger 350.

In the sanitary washing apparatus 600, the human body washing nozzle 140 that expands and contracts is installed in the main body 1 so that a dead space occurs at the bottom of the human body washing nozzle 140. Since the heat exchanger 350 is in a cylindrical shape and is small in size, it can be installed in a lower space of the human body washing nozzle 140. Consequently, the main body 1 can be miniaturized by using the heat exchanger 350.

Since the scale does not easily adhere to the heat exchanger 350, and the outflow of the scale is restrained, the flow rate control device 352 or a washing nozzle 390 is not clogged with the scale. Consequently, the flow rate control device 352 and the human body washing nozzle 140 can be employed for a long time period in a stable operation. Consequently, the sanitary washing apparatus 600 can be employed for a long time period in a stable operation by using the heat exchanger 350 for the sanitary washing apparatus 600.

Thirteenth Embodiment

Figure 39:
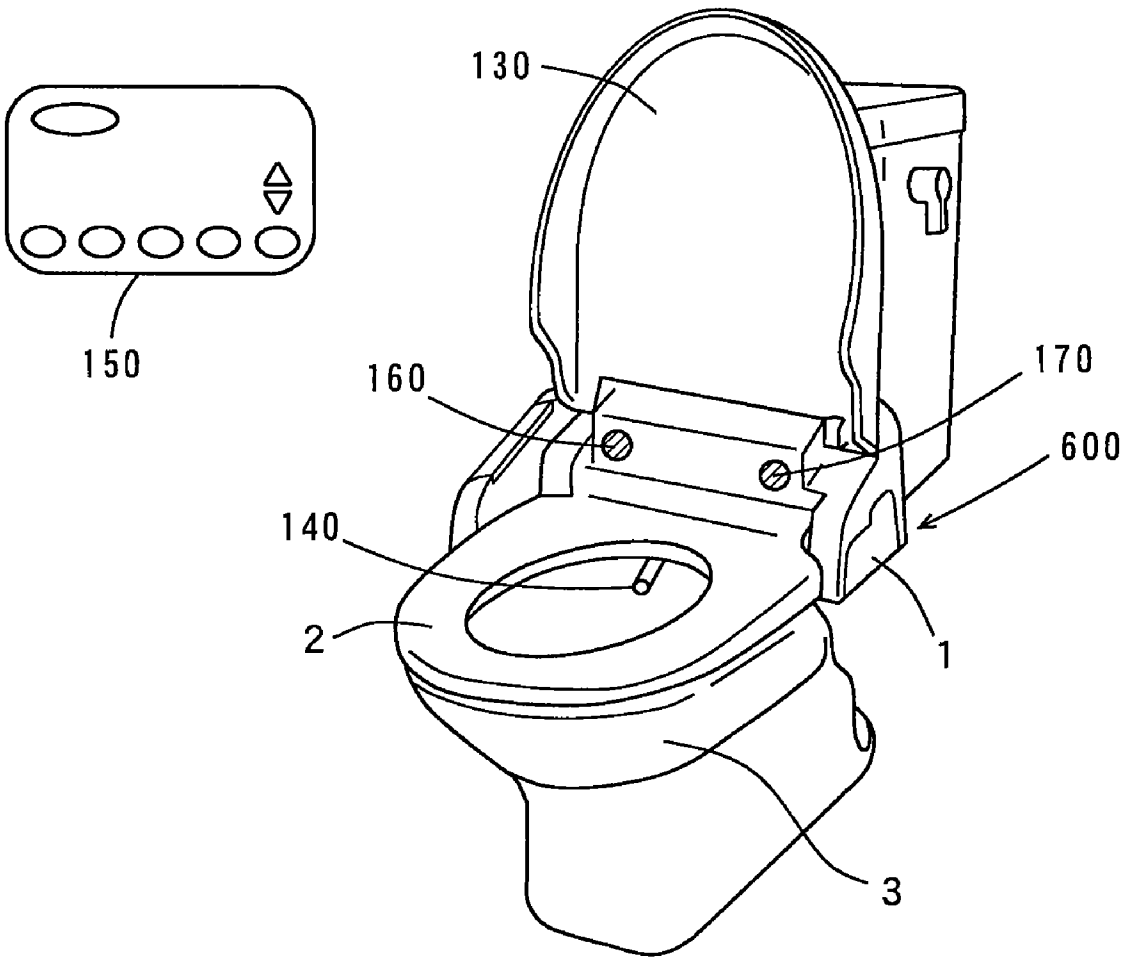
FIG. 39 is a schematic sectional view of a sanitary washing apparatus in a thirtieth embodiment of the present invention.

FIG. 39 is a perspective view of the appearance of a sanitary washing apparatus in a thirtieth embodiment of the present invention. Any one of the heat exchangers according to the first to twenty-eighth embodiments is used for the sanitary washing apparatus according to the present embodiment.

In FIG. 39, a sanitary washing apparatus 600 comprises a main body 1, a warm toilet seat 2 on which a user is to be seated, a toilet cover 130, and a human body washing nozzle 140 for washing the private parts of the human body. The main body 1 and the warm toilet seat 2 are mounted on a toilet bowl 3.

The main body 1 has a water supply pipe (not shown) for supplying washing water from a water supply source and an electric cable (not shown) for feeding power from a commercial power supply. The sanitary washing apparatus 600 has a posterior washing function for the user washing the anus, a bidet washing function for washing the female private parts after urine, a drying function for drying the private parts of the human body after washing, a room heating function for warming a toilet space at the cold time, and so on (all are not illustrated), and each of the functions is operated by a remote controller 150.

The main body 1 is provided with a seating detector 160 that detects that a user has been seated and a human body detector 170 that detects that the user has entered or left a toilet room.

Figure 40:
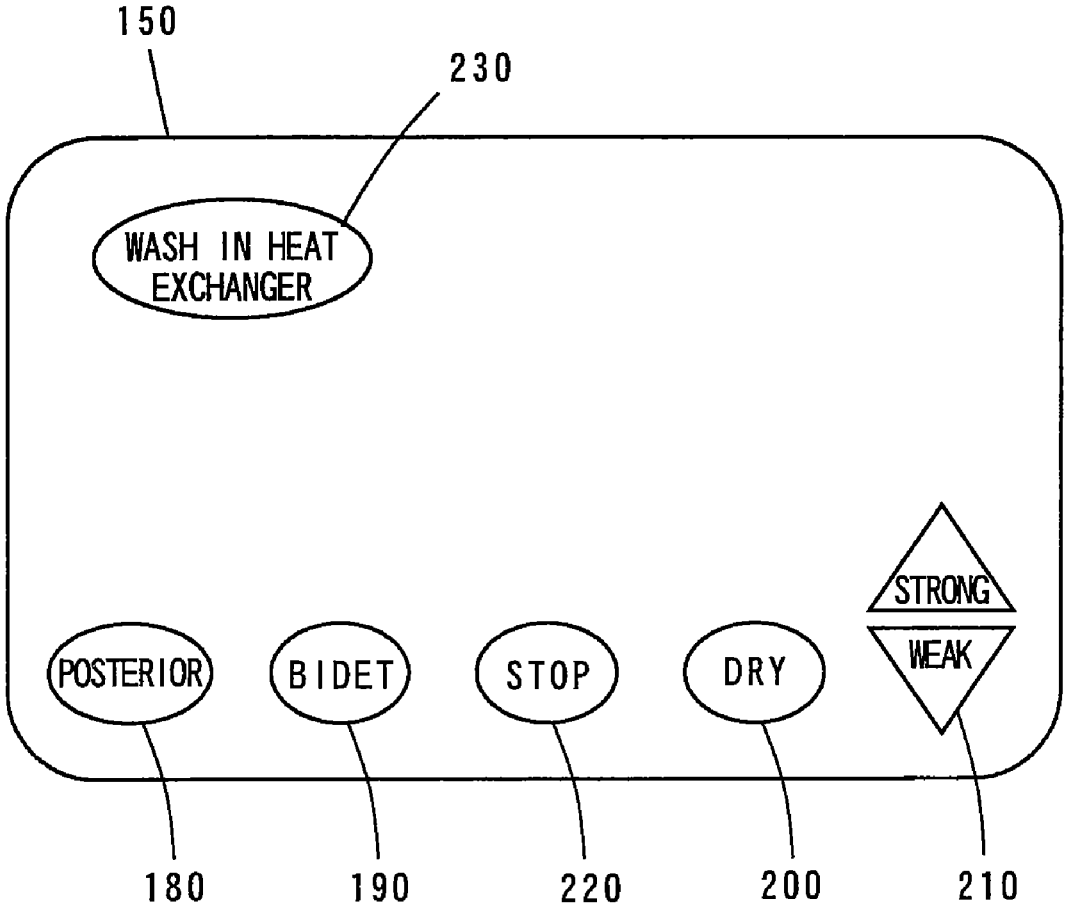
FIG. 40 is a schematic view of a remote controller 150 in a sanitary washing apparatus 600 shown in FIG. 39.

FIG. 40 is a schematic view of a remote controller 150 in the sanitary washing apparatus 600 shown in FIG. 39. The remote controller 150 has a posterior washing switch 180, a bidet washing switch 190, a drying switch 200, an adjustment switch 210, a stop switch 220, a heat exchanger washing switch 230, and so on.

An operation signal based on an operation performed by the user is transmitted to the main body 1 in the sanitary washing apparatus 600 by a radio signal such as infrared rays. When the heat exchanger washing switch 230 is pressed, an operation for washing the heat exchanger 350, described later, is performed. Here, an operation for supplying washing water to the heat exchanger 350 at a higher flow rate than that at the time of an operation for washing the human body by the human body washing nozzle 140 is referred to as an operation for washing the heat exchanger 350.

FIG. 41 is a schematic view showing a water circuit in the sanitary washing apparatus 600 shown in FIG. 39. In FIG. 41, a water supply pipe 320 is provided so as to branch off from tap water piping 300 serving as a water supply source. The water supply pipe 320 is provided with an electromagnetic valve 330 serving as water stop means, a flow sensor 340 for measuring the flow rate of washing water, a heat exchanger 350 for generating warm water, a temperature sensor 360 for sensing the temperature of warm water, and soon. Any one of the heat exchangers according to the first to twenty-eighth embodiments is used as the heat exchanger 350.

Furthermore, a switching valve 310 is connected to the downstream side of the temperature sensor 360. The switching valve 310 is one in which a flow rate adjuster for adjusting the flow rate and a flow path switcher for switching the flow path are integrally formed.

An inlet flow path 370, a first outlet flow path 400, a second outlet flow path 410, and a third outlet flow path 430 are connected to the switching valve 310. The inlet flow path 370 introduces warm water obtained by the heat exchanger 350 into the switching valve 310. The first outlet flow path 400 and the second outlet flow path 410 respectively correspond to main flow paths, to introduce the warm water from the switching valve 310 to a posterior nozzle 380 and a bidet nozzle 390. The posterior nozzle 380 and the bidet nozzle 390 constitute the human body washing nozzle 140 shown in FIG. 39. The third outlet flow path 430 corresponds to a sub-flow path, to introduce warm water from the switching valve 310 to a nozzle washer 420 for washing respective surfaces of the posterior nozzle 380 and the bidet nozzle 390.

A motor is operated by a signal from a controller 440 so that the switching valve 310 selectively communicates the inlet flow path 370 to the first outlet flow path 400, the second outlet flow path 410, or the third outlet flow path 430.

Figure 42:
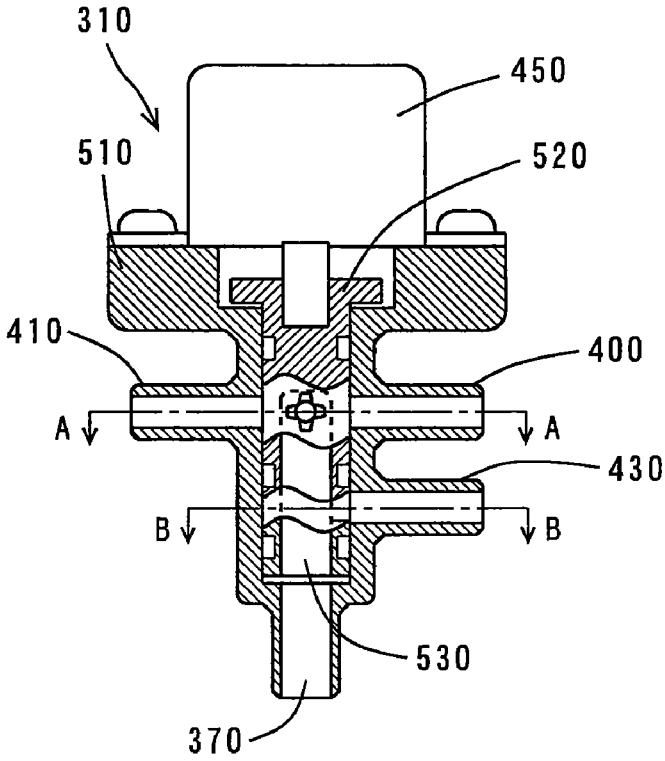
FIG. 42 is a vertical sectional view of a switching valve 310 shown in FIG. 41.
Figure 43A:
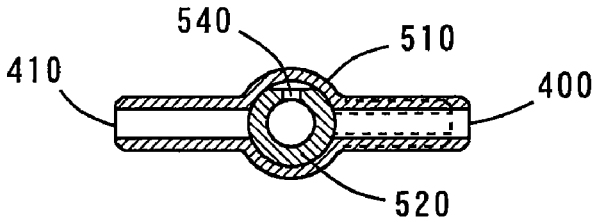
FIG. 43*a* is a cross-sectional view taken along a line A-A of the switching valve 310 shown in FIG. 42.
Figure 43B:
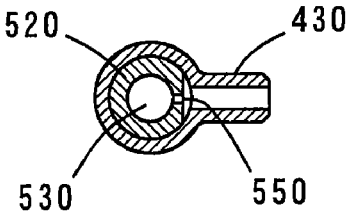
FIG. 43*b* is a cross-sectional view taken along a line B-B of the switching valve 310 shown in FIG. 42.

FIG. 42 is a vertical sectional view showing the switching valve 310 shown in FIG. 41, FIG. 43*a* is a cross-sectional view taken along a line A-A of the switching valve 310 shown in FIG. 42, and FIG. 43*b* is a cross-sectional view taken along a line B-B of the switching valve 310 shown in FIG. 42.

The switching valve 310 shown in FIGS. 42 and 43 integrally comprises a flow rate adjuster (a flow rate adjustment valve) and a flow path switcher (flow path switching valve). The switching valve 310 comprises a housing 510, a valve member 520, and a motor 450. The valve member 520 is inserted in to the housing 510 so as to be rotatable. The motor 450 is driven to rotate the valve member 520.

An inlet flow path 370, a first outlet flow path 400, a second outlet flow path 410, and a third outlet flow path 430 are provided in the housing 510. The valve member 520 has an inner flow path 530. The inner flow path 530 always communicates with the inlet flow path 370 in a state where it is inserted into the housing 510. In the valve member 520, a first valve member outlet 540 and a second valve member outlet 550 are provided so as to branch off from the inner flow path 530.

The first valve member outlet 540 is provided at a position corresponding to the first outlet flow path 400 and the second outlet flow path 410 in the housing 510, and the second valve member outlet 550 is provided at a position corresponding to the third outlet flow path 430 in the housing 510.

The degrees of communication between the inlet flow path 370 and the first outlet flow path 400 and between the second outlet flow path 410 and the third outlet flow path 430 (the flow path cross-sectional areas) can be respectively changed depending on the rotation angle of the valve member 520.

Although an O-ring is mounted as a sealing member in order to prevent internal leaks or external leaks in the inlet flow path 370, the first outlet flow path 400, the second outlet flow path 410, and the third outlet flow path 430, it is effective to use a special O-ring such as an X-ring or a V packing in order to reduce a load on the motor 450.

Furthermore, in the present embodiment, a reduction gear contained stepping motor allowing positioning with high precision even in open control is employed as the motor 450, and is attached such that its output shaft is inserted into the valve member 520.

If even the positioning precision can be ensured as the motor 450, a blush-type general-purpose CD motor or the like can be utilized in place of the stepping motor, and various types of actuators such as a rotation-type solenoid can be applied.

Although in the present embodiment, the rotation-type switching valve 310 is used, a plurality of flow paths may be switched using a direct acting valve member or diaphragm, or a plurality of flow paths may be switched using a disk-shaped valve member.

The operation and the function of the sanitary washing apparatus 600 configured as described above will be described. In the sanitary washing apparatus 600, the user is seated on the warm valve seat 2 and operates each of the switches in the remote controller 150 so that a human body washing function, a drying function, or the like is performed.

The heat exchanger washing switch 230 in the remote controller 150 is pressed so that an operation for washing the heat exchanger 350 is performed. In this case, when the user presses the heat exchanger washing switch 230, the seating detector 160 detects whether or not the user is seated, and the operation for washing the heat exchanger 350 is performed only when the user is not seated. Thus, the electromagnetic valve 330 is opened, so that washing water flows into the heat exchanger 350 through the flow rate sensor 340. The switching valve 310 communicates the inlet flow path 370 to the third outlet flow path 430. Thus, washing water is sprayed from the nozzle washer 420 on respective surfaces of the posterior nozzle 380 and the bidet nozzle 390. The flow rate of washing water at this time is controlled by the controller 440 so as to be higher than that at the time of the operation for washing the human body.

Consequently, the flow velocity of washing water flowing within the heat exchanger 350 is higher than the flow velocity of washing water flowing at the time of the operation for washing the human body. Thus, a scale that has been deposited on the surface of the sheathed heater 7 can be stripped upon receipt of a shock caused by water flow, so that the adhesion of the scale is reduced. As a result, the life of the sanitary washing apparatus 600 can be lengthened.

The flow velocity of spiral swirling flow is raised within each of the heat exchangers 350 according to the first to twenty-eighth embodiments by the configuration of the heat exchanger 350. Thus, the adhesion of the scale can be sufficiently prevented or reduced.

As described in the foregoing, any one of the heat exchangers 350 according to the first to twenty-eighth embodiments is used, and washing water is supplied to the heat exchanger 350 at a higher flow rate than that at the time of the operation for washing the human body by the switching valve 310, so that the adhesion of the scale within the heat exchanger 350 can be sufficiently prevented or reduced. As a result, the life of the sanitary washing apparatus 600 can be lengthened.

Although in the present embodiment, any one of the heat exchangers according to the first to twenty-eighth embodiments is used to raise the flow velocity within the heat exchanger 350, the flow velocity within the heat exchanger 350 may be raised by another configuration.

The heat exchanger 350 may not have a configuration in which the flow velocity is raised. In this case, washing water is supplied to the heat exchanger 350 at a higher flow rate than that at the time of the operation for washing the human body by the switching valve 310 so that the adhesion of the scale within the heat exchanger 350 can be prevented or reduced.

The switching valve 310 can also adjust the flow rate of washing water supplied to the human body washing nozzle 140, so that the flow rate adjuster for adjusting the flow rate of washing water supplied to the human body washing nozzle 140 at the time of the operation for washing the human body need not be separately provided. Thus, it is feasible to miniaturize the sanitary washing apparatus 600 and reduce the cost thereof.

The switching valve 310 switches the first outlet flow path 400 and the second outlet flow path 410 that communicate with the human body washing nozzle 140 and the third outlet flow path 430 that communicates with the nozzle washer 420 other than the human body washing nozzle 140. Even if washing water is supplied to the heat exchanger 350 at a high flow rate when washing water is supplied to the third outlet flow path 430, therefore, the washing water is not supplied to the first outlet flow path 400 and the second outlet flow path 410. Thus, no washing water is sprayed from the human body washing nozzle 140, so that washing water does not strike the human body. Consequently, the sanitary washing apparatus 600 can be employed safely and comfortably.

Since the flow rate adjuster and the flow path switcher are integrally provided in the switching valve 310, it is possible to miniaturize the sanitary washing apparatus 600 and reduce the cost thereof.

The third outlet flow path 430 communicates with the nozzle washer 420 that washes the surface of the human body washing nozzle 140, so that the surface of the human body washing nozzle 140 can be washed and kept clean.

Since the heat exchanger washing switch 230 for performing the operation for washing the heat exchanger 350 is provided in the remote controller 150, the operation for washing the heat exchanger 350 can be reliably performed by pressing the heat exchanger washing switch 230 when the toilet must be cleaned, for example.

Another names such as a boost washing switch and a scale removal switch may be used as the name of the heat exchanger washing switch 230.

Although in the present embodiment, the remote controller 150 is provided with the heat exchanger washing switch 230, the heat exchanger washing switch 230 may be provided in other portions such as the main body 1.

The operation for washing the heat exchanger 350 is not performed when the seating detector 160 detects that the user has been seated on the warm toilet seat 2, while being performed only when the user is not seated. Even if the user erroneously presses the heat exchanger washing switch 230 while he or she is seated, therefore, the operation for washing the heat exchanger 350 is not performed. Even when the switching valve 310 is stopped at the position where washing water is supplied to the human body washing nozzle 140 due to a fault or the like, washing water is prevented from being sprayed at a high flow rate as at the time of the operation for washing the heat exchanger 350 from the human body washing nozzle 140 while the user is seated. As a result, the safety of the sanitary washing apparatus 600 is improved.

After the operation for washing the human body, the operation for washing the heat exchanger 350 is automatically performed. After the operation for washing the human body, therefore, the inside of the heat exchanger 350 can be washed before the scale is fixed in the heat exchanger 350. Thus, the adhesion of the scale can be sufficiently reduced.

Since the operation for washing the heat exchanger 350 is reliably performed for each use of the sanitary washing apparatus 600, the adhesion of the scale within the heat exchanger 350 can be reliably reduced.

The operation for washing the heat exchanger 350 may be performed after an elapse of several minutes of the operation for washing the human body if the adhesion of the scale can be reduced.

When the human body detector 170 that detects the human body employing the toilet bowl detects the human body, the controller 440 may control the switching valve 310 such that the operation for washing the heat exchanger 350 is not performed. In this case, when the time of the operation for washing the heat exchanger 350 automatically performed after the operation for washing the human body and the time of male's urine or the like are overlapped with each other, for example, the operation for washing the heat exchanger 350 is not performed. Consequently, the sanitary washing apparatus 600 can be employed safely and comfortably.

In a case where the operation for washing the heat exchanger 350 is performed by the operation of the heat exchanger washing switch 230, the controller 440 may be configured such that a detection signal from the human body detector 170 is canceled. In this case, such a problem that the operation for washing the heat exchanger 350 is not performed irrespective of the press of the heat exchanger washing switch 230.

The amount of energization of the heat exchanger can be adjusted when the operation for washing the heat exchanger 350 is performed. When the energization of the heat exchanger 350 is turned on or off, for example, therefore, a thermal shock can be applied to the scale deposited due to thermal expansion and thermal contraction of the heat exchanger 350. As a result, the scale can be stripped, so that the adhesion of the scale can be prevented or reduced. Consequently, the life of the sanitary washing apparatus 600 is lengthened. The amount of energization may be adjusted in place of the turn-on or turn-off of the energization of the heat exchanger 350. In this case, the effect of preventing or reducing the adhesion of the scale can be also obtained.

Thirty-First Embodiment

FIG. 44 is a schematic view of a water circuit in a sanitary washing apparatus according to a thirty-first embodiment of the present invention. Any one of the heat exchangers according to the first to twenty-eighth embodiments is used for the sanitary washing apparatus according to the present embodiment.

The water circuit shown in FIG. 44 differs from the water circuit shown in FIG. 41 in that a bypass flow path 700 in a case where an operation for washing a heat exchanger 350 is performed is further provided, and cutoff valves 710 and 720 for switching a flow path are further provided.

The bypass flow path 700 is provided so as to branch off from the downstream of the heat exchanger 350. The cutoff valve 710 is provided between the heat exchanger 350 and a switching valve 310, and the cutoff valve 720 is provided in the bypass flow path 700. The pressure loss in the bypass flow path 700 is smaller than respective pressure losses in the switching valve 310 and the human body washing nozzle 140.

The operation and the function of the sanitary washing apparatus 600 configured as described above will be described. In a case where the operation for washing the heat exchanger 350 is performed, the cutoff valve 710 provided in the downstream of the heat exchanger 350 is closed, so that the cutoff valve 720 provided in the downstream of the bypass flow path 700 is opened. Thus, a flow path for the operation for washing the heat exchanger 350 is ensured.

At the time of the operation for washing the human body, the cutoff valve 710 provided in the downstream of the heat exchanger 350 is opened, and the cutoff valve 720 provided in the downstream of the bypass flow path 700 is closed. Thus, a flow path for the operation for washing the human body is ensured.

At the time of the operation for washing the heat exchanger 350, therefore, washing water discharged from the heat exchanger 350 is introduced into the bypass flow path 700 having a small pressure loss. Since washing water can be caused to flow in the heat exchanger 350 at a high flow rate, it is possible to strip a scale deposited within the heat exchanger 350 upon application of a shock. As a result, the adhesion of the scale is prevented or reduced, so that the life of the sanitary washing apparatus is realized.

A front end of the bypass flow path 700 may be connected to a nozzle washer 420. In this case, a human body washing nozzle 140 can be washed using washing water having a higher flow rate.

For example, the operation for washing the heat exchanger 350 may be routinely performed using a third outlet flow path 430, while being performed using the bypass flow path 700 once a month.

In this case, the operation for washing the heat exchanger 350 using the third outlet flow path 430 or the operation for washing the heat exchanger 350 using the bypass flow path 700 is selected depending on a method of operating the heat exchanger washing switch 230 in the remote controller 150. For example, the operation for washing the heat exchanger 350 using the bypass flow path 700 is selected when the heat exchanger washing switch 230 is pressed once, while being selected using the bypass flow path 700 when the heat exchanger washing switch 230 is pressed once. The method of selecting the operation for washing the heat exchanger 350 is not limited to this method.

Thirty-Second Embodiment

Figure 45:
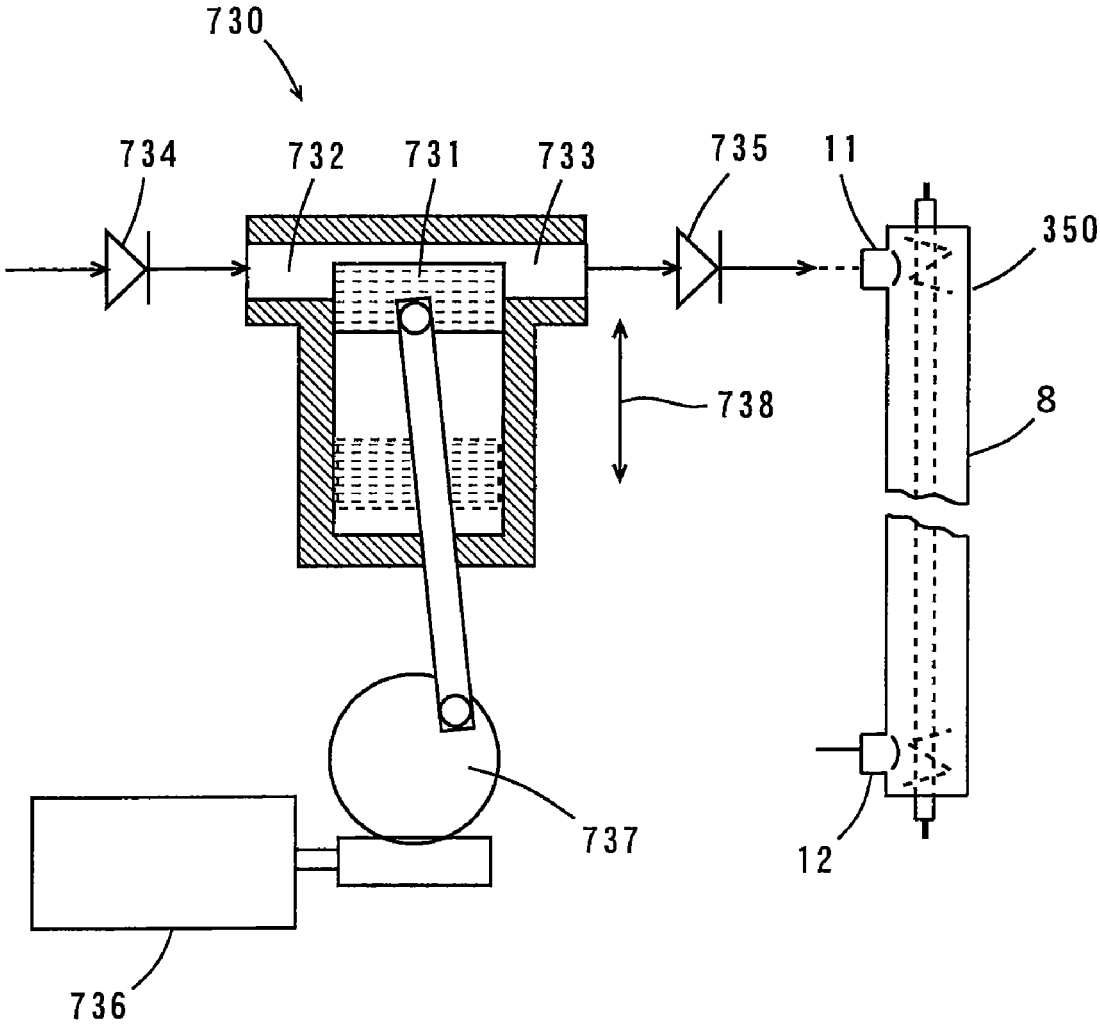
FIG. 45 is a schematic view mainly showing a heat exchanger in a sanitary washing apparatus in a thirty-second embodiment of the present invention.

FIG. 45 is a schematic view mainly showing a heat exchanger in a sanitary washing apparatus according to a thirty-second embodiment of the present invention. The heat exchanger according to the twenty-eighth embodiment is used as the sanitary washing apparatus according to the present embodiment.

In the sanitary washing apparatus according to the present embodiment, a piston-type pump 730 is provided in the upstream of a heat exchanger 350. The heat exchanger according to the twenty-eighth embodiment is used as the heat exchanger 350. The configuration of other portions is the same as that in the thirtieth or thirty-first embodiment.

A check valve 734 is connected to a water inlet 731 in the piston-type pump 730, and the water inlet 11 in the heat exchanger 350 is connected to a water outlet 733 in the pump 730 through a check valve 735. A piston 731 in the pump 730 reciprocates, as indicated by an arrow 738, so that water is sucked in from the water inlet 732, while being discharged from the water outlet 733. At this time, backflow of water is prevented by the check valves 734 and 735.

First, a motor 736 is rotated by control of the controller 440 (see FIGS. 41 and 44). An operation for rotating the motor 736 is converted into the reciprocating operation of the piston 731, as indicated by the arrow 738, by a gear 737. Thus, water is supplied to the heat exchanger 350 in the downstream of the pump 730. In this case, water supplied to the heat exchanger is pulsated in response to the reciprocating operation of the piston 731. Thus, the spring 100 within the heat exchanger 350 is vibrated.

In the present embodiment, the spring 100 in the heat exchanger 350 is vibrated utilizing the pulsation of water discharged from the pump 730 so that scales respectively adhering to surfaces of the spring 100 and the sheathed heater 7 can be removed. Such a configuration is particularly effective in a case where hard and breakable impurities, for example, scales, are deposited within the heat exchanger 350.

In the present embodiment, water is pulsated by using the piston-type pump 730, the present invention is not limited to the same. The same effect can be obtained even if another pressure device that can pulsate water, for example, a plunger pump or a diaphragm pump is used.

Although in the present embodiment, the pump 730 is provided in the upstream of the heat exchanger 350, the pump 730 may be provided in the downstream of the heat exchanger 350 in a case where a user desires to use water or warm water having pulsation. In this case, the pulsation is not weakened while water or warm water passes through the heat exchanger 350, the user can employ water or warm water having strong pulsation.

Any one of the heat exchangers according to the first to twenty-seventh embodiments may be used as the heat exchanger 350 for the sanitary washing apparatus according to the present embodiment. In this case, the adhesion of the scale can be also prevented or reduced utilizing the pulsation of water.

Furthermore, the operation for washing the heat exchanger 350 in the thirtieth or thirty-first embodiment and the washing operation utilizing the pulsation of water in the present embodiment may be combined.

Thirty-Third Embodiment

Figure 46:
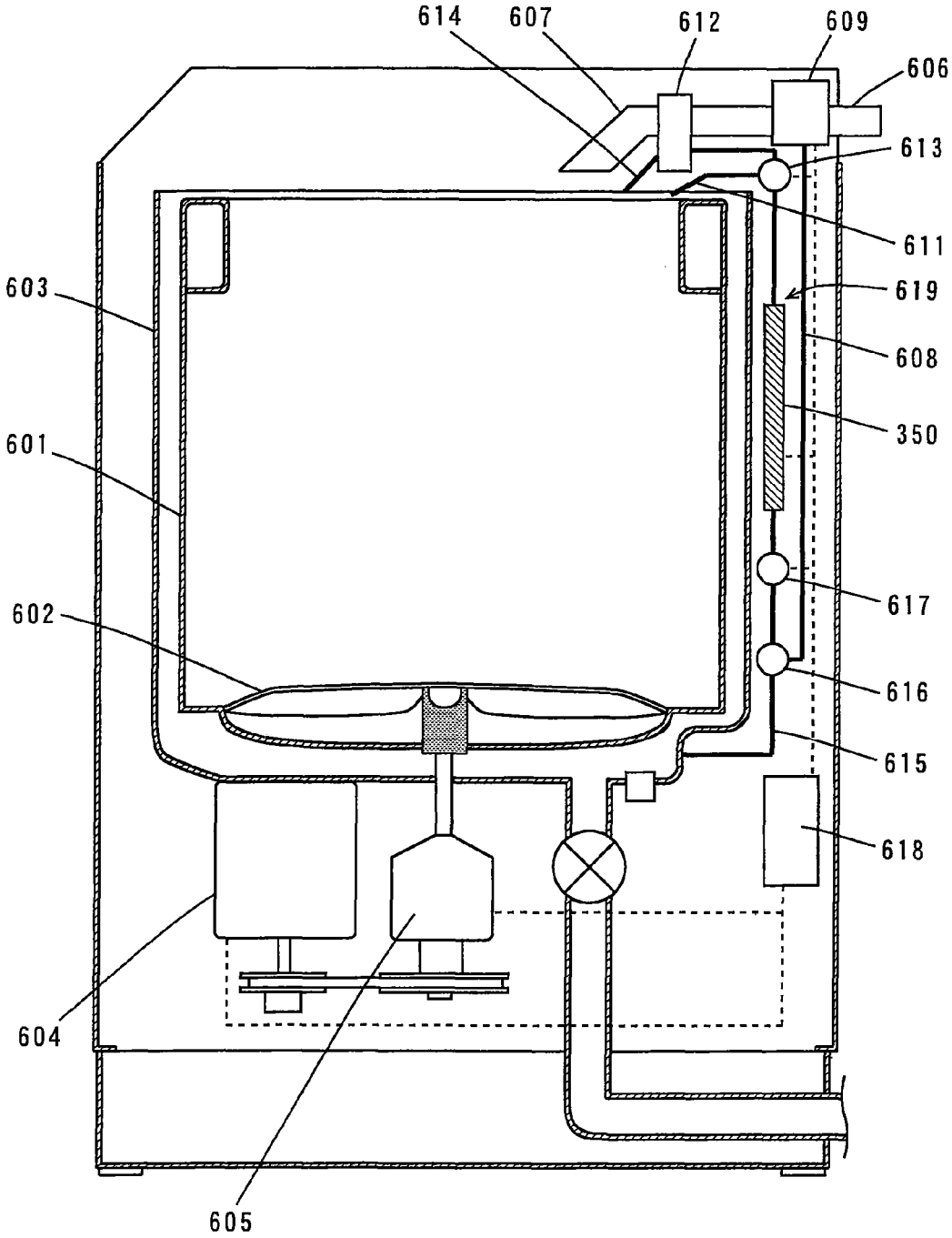
FIG. 46 is a schematic sectional view of a clothes washing apparatus (a washing machine) in a thirty-third embodiment of the present invention.

FIG. 46 is a schematic sectional view of a clothes washing apparatus (washing machine) in a thirty-third embodiment of the present invention. Any one of the heat exchangers according to the first to twenty-eighth embodiments is used for the clothes washing apparatus according to the present embodiment.

A clothes washing apparatus shown in FIG. 46 comprises an inner tub 601 and a washing tub 603 for storing washing water. The inner tub 601 is provided within the washing tub 603, and an agitating blade 602 is attached to the bottom of the inner tub 601. A motor 604 serving as a driving device and a bearing 605 are arranged below the washing tub 603. A rotation force from the motor 604 is selectively transmitted to the inner tub 601 and the agitating blade 602 by the bearing 605.

A water supply port 606, a main water path 607, a bypass path 608, and the flow path switching valve 609 are arranged in a space leading to the side from above the washing tub 603. The water supply port 606 branches into the main water path 607 and the bypass path 608 through the flow path switching valve 609. That is, the main water path 607 and the bypass path 608 constitute a water supply path leading from the water supply port 606 to the washing tub 603. The flow path switching valve 609 is also used as a flow ratio control valve for controlling the ratio of the flow rate of the main water path 607 to the flow rate of the bypass path 608 in the water supply path.

A water inlet switching valve 616 is connected to the downstream of the bypass path 608. A pump 617, a heat exchanger 350, and a switching valve 613 are connected in this order to one water outlet in the water inlet switching valve 616, and a suction path 615 is connected to the other water outlet. The suction path 615 is connected to the bottom of the washing tub 603.

A detergent injector 612 is connected to the one water outlet of the switching valve 613, and a warm water discharge port 611 is connected to the other water outlet. The switching valve 613 selectively communicates the water outlet of the heat exchanger 350 to the warm water discharge port 611 or the detergent injector 612. The detergent injector 612 discharges a melted detergent from a detergent water outlet 614.

The water inlet switching valve 616 selectively switches a path from a water system and a path from the washing tub 603. The pump 617 supplies water from the selected path to the heat exchanger 350 while controlling the flow rate of the water. A controller 618 carries out control related to switching of the path, adjustment of the flow rate and the temperature of water, and washing.

The heat exchanger 350 has a cylindrical shape, and is installed in the vertical direction at a corner 619 of the clothes washing apparatus. Thus, space saving is achieved.

The operation and the function of the clothes washing apparatus configured as described above will be described. First, the water inlet switching valve 616 is set such that water in the bypass path 608 is supplied to the heat exchanger 350. Tap water is supplied to the flow path switching valve 609 from the water supply port 606. A part of water is supplied to the bypass path 608 by the flow path switching valve 609, and is supplied to the heat exchanger 350 via the water inlet switching valve 616 and the pump 617. Water is heated to a suitable temperature by the heat exchanger 350.

The water inlet switching valve 616 is set such that water stored in the washing tub 603 is supplied to the pump 617 when the temperature of the water in the washing tub 603 is low. Water is supplied to the heat exchanger 350 by the pump 617. Water is heated to a suitable temperature by the heat exchanger 350, and is returned to the washing tub 603. When the temperature of water within the washing tub 603 becomes a predetermined temperature, the operation of the heat exchanger 350 is terminated. Thus, it is possible to do washing using warm water, so that detergency can be improved.

A part of water is supplied to the bypass path 608 by the flow path switching valve 609, so that a small amount of water can be heated by the heat exchanger 350 and employed as water for dissolving a detergent or the like. Thus, detergency can be improved by infiltrating clothes with a detergent having a high concentration. Further, the washing tub 603 is heated and sterilized by directly discharging water heated by the heat exchanger 350 to the washing tub 603 to obtain the action of bacterial killing and bacterial elimination.

The clothes washing apparatus according to the present embodiment uses the heat exchanger 350 capable of removing a scale and having a long life, so that the life of the clothes washing apparatus can be also lengthened. Since the heat exchanger 350 can be miniaturized by increasing the watt density of the sheathed heater 7, the whole clothes washing apparatus can be miniaturized.

A piston-type pump is used as the pump 617, and the heat exchanger according to the twenty-eighth embodiment is used so that the spring 100 may be vibrated by the pulsation of water to strip the scale, as in the sanitary washing apparatus according to the thirty-second embodiment.

Even if impurities such as a detergent cake adhere to the inside of the heat exchanger 350, the impurities can be removed by the spring 100 functioning as an impurity removal mechanism. Consequently, the heat exchange efficiency of the heat exchanger 350 is not reduced, and the flow path is not clogged, for example.

Thirty-Fourth Embodiment

Figure 47:
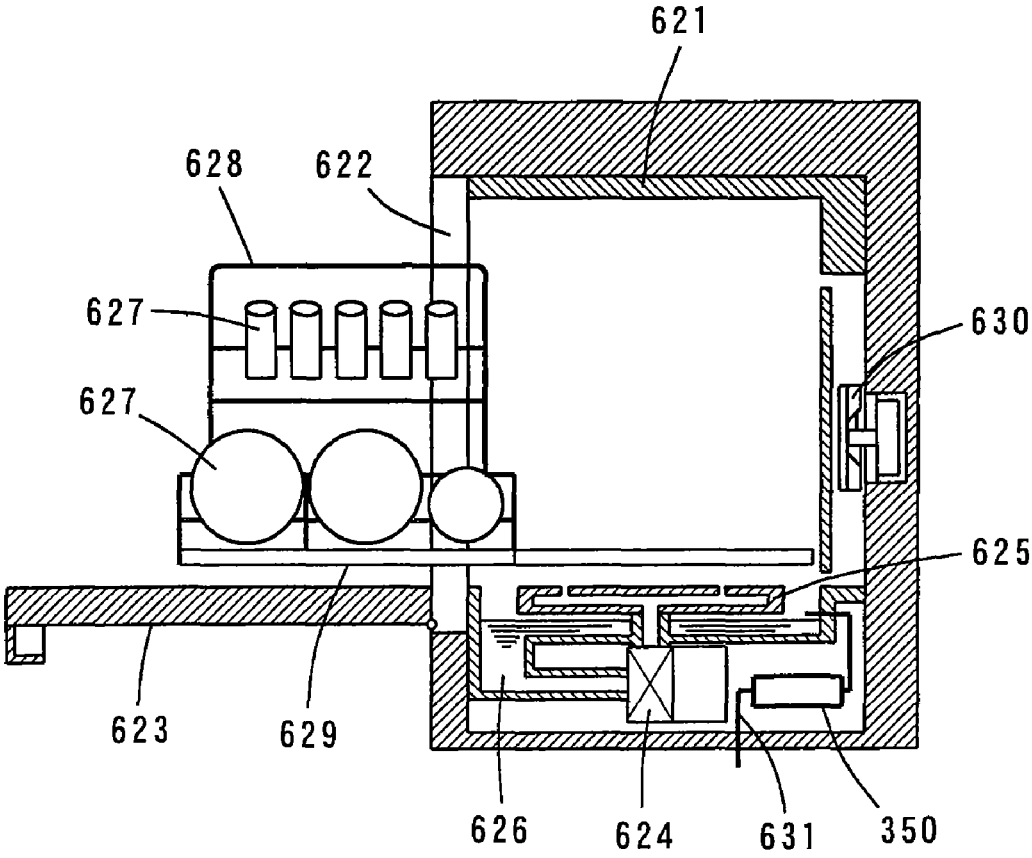
FIG. 47 is a schematic sectional view of a dish washing apparatus in a thirty-fourth embodiment of the present invention.
Figure 48:
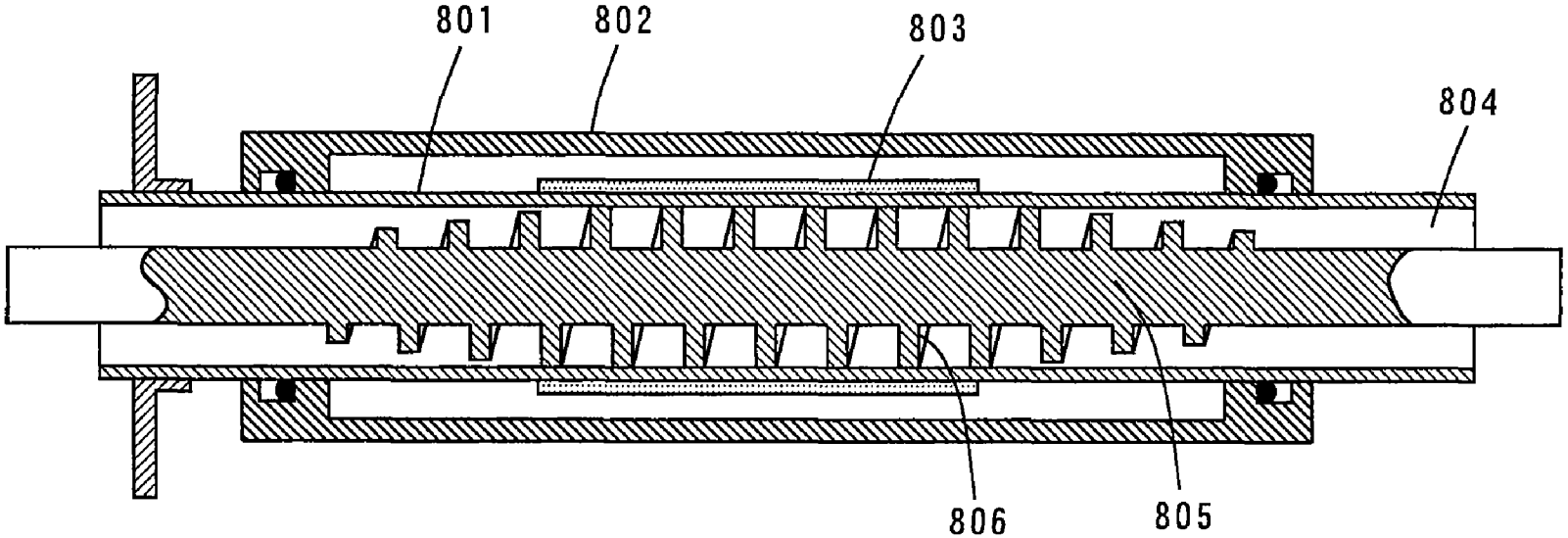
FIG. 48 PRIOR ART
FIG. 48 is a schematic sectional view of a conventional heat exchanger.

FIG. 47 is a schematic sectional view of a dish washing apparatus in a thirty-fourth embodiment of the present invention. Any one of the heat exchangers according to the first to twenty-eighth embodiments is used for the dish washing apparatus according to the present embodiment.

A dish washing apparatus shown in FIG. 47 comprises a washing tub 621. The washing tub 621 has an opening 622. A door 623 is provided so as to be capable of being opened or closed in the opening 622. A heat exchanger 350 and a pump 624 for circulating washing water are provided below the washing tub 621. Any one of the heat exchangers according to the first to twenty-eighth embodiments is used as the heat exchanger 350.

A spray device 625 that sprays washing water and a water receiver 626 that stores washing water are provided at the bottom of the washing tub 621. Within the washing tub 621, a washing basket 628 accommodating an object to be washed 627 such as a dish is supported so as to be movable by a rail 629. Further, there is provided a blast fan 630 for sending air into the washing tub 621. A water supply pipe 631 for supplying washing water is connected to a water inlet in the heat exchanger 350. A water outlet in the heat exchanger 350 communicates with the water receiver 626 within the washing tub 621.

In the dish washing apparatus according to the present embodiment, washing water is heated by the heat exchanger 350, and is pressurized by an operation of the pump 624 and fed to the spray device 625, and is vigorously sprayed from the spray device 625. The object to be washed 627 such as the dish that has accommodated in the washing basket 628 is washed by washing water sprayed from the spray device 625. After completion of the washing operation, a discharge valve (not shown) is opened so that washing water is discharged from the washing tub 621, and the object to be washed 627 such as the dish is dried by ventilation caused by an operation of the blast fan 630.

Since the dish washing apparatus according to the present embodiment uses the heat exchanger 350 capable of removing a scale and having a long life, the life of the dish washing apparatus can be also lengthened. Since the heat exchanger 350 can be miniaturized by increasing the watt density of the sheathed heater 7, the whole dish washing apparatus can be miniaturized.

A piston-type pump is used as the pump 624, and the heat exchanger according to the twenty-eighth embodiment is used so that the spring 100 may be vibrated by the pulsation of water to strip the scale.

Even if impurities such as a detergent cake adhere to the inside of the heat exchanger 350, the impurities can be removed by the spring 100 functioning as an impurity removal mechanism. Consequently, the heat exchange efficiency of the heat exchanger 350 is not reduced, and the flow path is not clogged, for example.

Another Embodiment

Furthermore, although in the heat exchangers according to the first to twenty-eighth embodiments, the sheathed heater 7 is used as a heating element, a ceramic heater or another heating element may be used as a heat source.

Correspondences Between Units in Embodiments and Elements in Claims

In the embodiments described above, the sheathed heater 7 corresponds to a heating element, the springs 100 to 110 correspond to a flow velocity conversion mechanism, a flow direction conversion mechanism, a turbulent flow generation mechanism, a spiral member, a spiral spring, or an impurity conversion mechanism, the ribs (guides) 111 to 117 and 121 correspond to a flow velocity conversion mechanism, a flow direction conversion mechanism, a turbulent flow generation mechanism, an impurity removal mechanism, a spiral member, or a guide, and the ribs (guides) 131 to 136 correspond to a flow velocity conversion mechanism, a flow direction conversion mechanism, an impurity removal mechanism, a spiral member, a guide, or a fluid reducing material.

The water inlets 11 and 23 correspond to a flow velocity conversion mechanism, a flow direction conversion mechanism, a turbulent flow generation mechanism, or an impurity removal mechanism, and the water reducing materials 30, 31, and 32 correspond to a fluid reducing material. The pump 730 corresponds to a fluid supply device, the switching valve 310 corresponds to a flow rate adjuster or a flow path switcher, the first outlet flow path 400 and the second outlet flow path 410 correspond to a main flow path, and the third outlet flow path 430 corresponds to a sub-flow path, and the bypass flow path 700 corresponds to a sub-flow path or a bypass flow path. The heat exchanger washing switch 230 corresponds to a switch, the human body washing nozzle 140 corresponds to a spray device, the controller 440 corresponds to a power controller, the washing tub 603 and the washing tub 621 correspond to a washing tub, and the spray device 625 and the warm water discharge port 611 correspond to a supply device.

The invention claimed is:

1. A washing apparatus that sprays a fluid supplied from a water supply source on a portion to be washed, comprising:

a heat exchanger that heats the fluid supplied from said water supply source;

a spray device that is connected to the downstream of said heat exchanger, to spray the fluid supplied from said heat exchanger on said portion to be washed; and a flow rate adjuster that adjusts the flow rate of the fluid supplied to said heat exchanger such that in an operation for washing said heat exchanger, the flow rate of the fluid supplied to said heat exchanger is higher than that at the time of an operation for washing said portion to be washed by said spray device.

2. The washing apparatus according to claim 1, wherein said flow rate adjuster adjusts the flow rate of the fluid supplied to said heat exchanger at the time of the operation for washing the portion to be washed by said spray device.

3. The washing apparatus according to claim 1, further comprising a main flow path that introduces the fluid into the spray device, a sub-flow path that introduces the fluid into a portion other than said spray device, and a flow path switcher that is provided between said heat exchanger and said spray device to selectively communicate one of said main flow path and said sub-flow path to said heat exchanger.

4. The washing apparatus according to claim 3, wherein said flow rate adjuster and said flow path switcher are integrally formed.

5. The washing apparatus according to claim 3, wherein said sub-flow path is provided so as to introduce the fluid into a surface of said spray device.

6. The washing apparatus according to claim 1, further comprising a bypath flow path that is provided so as to branch off from the downstream of said heat exchanger and to which the fluid discharged from said heat exchanger is supplied at the time of the operation for washing said heat exchanger.

7. The washing apparatus according to claim 1, further comprising a switch for issuing a command to perform the operation for washing said heat exchanger, said flow rate adjuster adjusting the flow rate of the fluid supplied to said heat exchanger in response to an operation of said switch such that the flow rate of the fluid supplied to said heat exchanger is higher than that at the time of the operation for washing the human body by said spray device.

8. The washing apparatus according to claim 1, further comprising a toilet seat, and a seating detector that detects seating on said toilet seat, said flow rate adjuster not adjusting the flow rate at the time of the operation for washing said heat exchanger when said seating detector detects the seating.

9. The washing apparatus according to claim 1, wherein said flow rate adjuster adjusts the flow rate of the fluid supplied to said heat exchanger such that after the operation for washing the human body by said spray device, the flow rate of the fluid supplied to said heat exchanger is higher than that at the time of the operation for washing the human body by said spray device.

10. The washing apparatus according to claim 1, wherein said washing apparatus is mounted on a toilet bowl, and further comprising a human body detector that detects the human body employing said toilet bowl, said flow rate adjuster not adjusting the flow rate at the time of the operation for washing said heat exchanger when said human body detector detects the human body.

11. The washing apparatus according to claim 1, further comprising a power controller that changes power supplied to said heat exchanger at the time of the operation for washing said heat exchanger.

12. A washing apparatus that sprays a fluid supplied from a water supply source on a portion to be washed of the human body, comprising:

a heat exchanger that heats the fluid supplied from said water supply source; and a spray device that sprays the fluid heated by said heat exchanger on said human body, said heat exchanger comprising a case, and a heating element accommodated in said case, a flow path being formed between an outer surface of said heating element and an inner surface of said case, said heat exchanger further comprising a flow velocity conversion mechanism that changes a flow velocity in at least a part of said flow path.

13. A washing apparatus that sprays a fluid supplied from a water supply source on a portion to be washed of the human body, comprising:

a heat exchanger that heats the fluid supplied from said water supply source; and a spray device that sprays the fluid heated by said heat exchanger on said human body, said heat exchanger comprising a case, and a heating element accommodated in said case, a flow path being formed between an outer surface of said heating element and an inner surface of said case, and said heat exchanger further comprising a fluid reducing material for lowering an oxidation/reduction potential of the fluid within said flow path.

14. A washing apparatus that sprays a fluid supplied from a water supply source on a portion to be washed of the human body, comprising:

a heat exchanger that heats the fluid supplied from said water supply source; and a spray device that sprays the fluid heated by said heat exchanger on said human body;

said heat exchanger comprising a case, and a heating element accommodated in said case, a flow path being formed between an outer surface of said heating element and an inner surface of said case, said heat exchanger further comprising an impurity removal mechanism that physically removes impurities within said fluid.

15. A washing apparatus that washes a washing object using a fluid supplied from a water supply source, comprising:

a washing tub accommodating said washing object;

a heat exchanger that heats the fluid supplied from said water supply source; and a supply device that supplies the fluid heated by said heat exchanger to said washing tub, said heat exchanger comprising a case, and a heating element accommodated in said case, a flow path being formed between an outer surface of said heating element and an inner surface of said case, said heat exchanger further comprising a flow velocity conversion mechanism that changes a flow velocity in at least a part of said flow path.

16. A washing apparatus that washes a washing object using a fluid supplied from a water supply source, comprising:

a washing tub accommodating said washing object;

a heat exchanger that heats the fluid supplied from said water supply source; and a supply device that supplies the fluid heated by said heat exchanger to said washing tub, said heat exchanger comprising a case, and a heating element accommodated in said case, a flow path being formed between an outer surface of said heating element and an inner surface of said case, said heat exchanger further comprising a fluid reducing material for lowering an oxidation/reduction potential of the fluid within said flow path.

17. A washing apparatus that washes a washing object using a fluid supplied from a water supply source, comprising:

a washing tub accommodating said washing object;

a heat exchanger that heats the fluid supplied from said water supply source; and a supply device that supplies the fluid heated by said heat exchanger to said washing tub, said heat exchanger comprising a case, and a heating element accommodated in said case, a flow path being formed between an outer surface of said heating element and an inner surface of said case, said heat exchanger further comprising an impurity removal mechanism that physically removes impurities within said fluid.

* * * * *

UNITED STATES PATENT AND TRADEMARK OFFICE

CERTIFICATE OF CORRECTION

PATENT NO. : 7,920,779 B2
APPLICATION NO. : 10/596355
DATED : April 5, 2011
INVENTOR(S) : S. Shirai et al.

It is certified that error appears in the above-identified patent and that said Letters Patent is hereby corrected as shown below:

Cover page 2, (Foreign Patent Documents) of the issued patent, please delete duplicate reference "JP8-094175 11/2000".

Cover page 2, (Foreign Patent Documents) of the issued patent, please delete duplicate reference "JP2000-279786 10/2001".

Signed and Sealed this
Eighth Day of November, 2011

David J. Kappos

David J. Kappos
*Director of the United States Patent and Trademark Office*